US008448797B2

(12) United States Patent
Cho

(10) Patent No.: US 8,448,797 B2
(45) Date of Patent: May 28, 2013

(54) BOTTLE CONTAINING TWO KINDS OF MATERIALS SEPARATELY IN TWO SPACES

(76) Inventor: Young-Kook Cho, Marietta, GA (US)

( * ) Notice: Subject to any disclaimer, the term of this patent is extended or adjusted under 35 U.S.C. 154(b) by 1867 days.

(21) Appl. No.: 10/580,903

(22) PCT Filed: Nov. 27, 2004

(86) PCT No.: PCT/KR2004/003100

§ 371 (c)(1),
(2), (4) Date: May 26, 2006

(87) PCT Pub. No.: WO2005/051775

PCT Pub. Date: Jun. 9, 2005

(65) Prior Publication Data

US 2007/0074979 A1 Apr. 5, 2007

(30) Foreign Application Priority Data

| | | |
|---|---|---|
| Nov. 28, 2003 | (KR) | 10-2003-0085594 |
| Dec. 31, 2003 | (KR) | 10-2003-0101455 |
| Jan. 20, 2004 | (KR) | 10-2004-0004133 |
| Apr. 19, 2004 | (KR) | 10-2004-0026786 |
| Jul. 20, 2004 | (KR) | 10-2004-0057404 |
| Oct. 7, 2004 | (KR) | 10-2004-0081154 |
| Oct. 27, 2004 | (KR) | 10-2004-0089087 |
| Nov. 5, 2004 | (KR) | 10-2004-0090078 |
| Nov. 25, 2004 | (KR) | 10-2004-0097728 |

(51) Int. Cl.

| | |
|---|---|
| ***B65D 41/50*** | (2006.01) |
| ***B65D 39/00*** | (2006.01) |
| ***B65D 41/34*** | (2006.01) |
| ***B65D 51/18*** | (2006.01) |

(52) U.S. Cl.

USPC ..... 215/228; 206/222; 215/252; 215/354; 220/522

(58) Field of Classification Search

USPC ..... 206/219, 221, 222; 215/DIG. 8, 215/250, 253, 228, 329, 354, 252; 220/521, 220/522

See application file for complete search history.

(56) References Cited

U.S. PATENT DOCUMENTS

| | | | | |
|---|---|---|---|---|
| 2,793,776 | A * | 5/1957 | Lipari | 206/221 |
| 3,924,741 | A * | 12/1975 | Kachur et al. | 206/221 |
| 4,132,308 | A * | 1/1979 | Goncalves | 206/219 |

(Continued)

FOREIGN PATENT DOCUMENTS

| | | |
|---|---|---|
| JP | 04-109030 | 4/1992 |

OTHER PUBLICATIONS

Office Action dated Nov. 9, 2011, issued in U.S. Appl. No. 12/862,046.

(Continued)

*Primary Examiner* — Robin Hylton
(74) *Attorney, Agent, or Firm* — Sheridan Ross P.C.

(57) ABSTRACT

The present invention relates to a bottle, which contains two kinds of materials separately in two spaces in a bottle body and communicates the separated spaces with each other as necessary so that the two materials can be mixed together. This bottle has a bottle body having a mouth; an additive storage container including an insertion part inserted into the mouth, an exposed part exposed outside the mouth; an additive storage container including an insertion part inserted into the mouth, an exposed part exposed outside the mouth and an additive storage space defined therein; an opening unit tightened to the mouth; and separation means for separating the additive storage container from the bottle body.

12 Claims, 57 Drawing Sheets

U.S. PATENT DOCUMENTS

| | | | | |
|---|---|---|---|---|
| 4,591,050 | A | 5/1986 | Finke et al. | |
| 4,793,475 | A | 12/1988 | Itzel | |
| 6,045,254 | A | 4/2000 | Inbar et al. | |
| 6,763,939 | B2 | 7/2004 | Alticosalian | |
| 7,172,095 | B2 | 2/2007 | Marshall | |
| 7,493,475 | B2 * | 2/2009 | Colavin | 712/214 |
| 7,546,919 | B2 * | 6/2009 | Lee | 206/221 |

OTHER PUBLICATIONS

Cross reference is made to U.S. Appl. No. 12/862,046, published as US-2011-0108442-A1.

* cited by examiner

BOTTLE CONTAINING TWO KINDS OF MATERIALS SEPARATELY IN TWO SPACES

TECHNICAL FIELD

The present invention relates, in general, to a bottle, which can not only contain two kinds of materials in two separate spaces in a bottle, but also cause the separate spaces to communicate with each other as necessary so that the two materials can be mixed to be used.

BACKGROUND ART

Most bottles currently traded on the market contain one material in each bottle. It is, however, often necessary to mix two kinds of different materials together in a variety of industrial fields. For example, a coffee-based beverage may be mixed with sugar or cream powder therein; medicines and chemicals are similar cases.

In order to mix two different kinds of materials together, however, it is necessarily to buy two bottles containing the two different materials therein. In addition, a measuring instrument also needs to be bought for accurate measurement. Without such a measuring instrument, it is very difficult to keep the mixture ratio exact.

DISCLOSURE OF THE INVENTION

Accordingly, the present invention has been made keeping in mind the above problems occurring in the prior art, and an object of the present invention is to provide a bottle which stores two kinds of materials separately in a bottle when the bottle is distributed on the market, thus saving resources, unlike conventional bottles, in which two bottles are required to store two materials therein.

Another object of the present invention is to provide a bottle which can mix two materials together at an exact mixture ratio using only a simple action.

A further object of the present invention is to provide a bottle which maintains a good seal on the interior space of an additive storage container that contains the additive therein, so that the additive is not oxygenated or spoiled and the additive storage container can be easily applied to the mouth of typical bottles.

Still another object of the present invention is to provide a bottle in which the additive storage container can be completely removed from a bottle body though an opening action of an opening unit.

In order to accomplish the above-mentioned objects, the present invention provides a bottle, comprising: a bottle body which has a mouth provided with an external thread around an outer circumferential surface thereof; an additive storage container that is open at both ends thereof and is provided with an insertion part inserted into the mouth of the bottle body and an exposed part externally exposed out of the mouth, and defines an additive storage space therein; an opening unit that engages with the external thread of the mouth through a screw-type engagement and is selectively isolated from or communicated with a material storage space of the bottle body; and a separation means for removing the additive storage container from the mouth of the bottle body.

The separation means may comprise: an elevating protrusion projecting externally in a radial direction from an intermediate portion of the outer circumferential surface of the additive storage container, so that the elevating protrusion engages and becomes locked with an internal thread provided on an inner circumferential surface of the opening unit.

The bottle may further comprise: a valve seat extending inward in a radial direction from a lower end of the insertion part of the additive storage container, with a discharge port formed at a center of the valve seat; a support shaft extending downward from a center of a lower surface of the opening unit in an axial direction; and a valve body provided at an end of the support shaft to close the discharge port, so that the additive storage space is isolated from the material storage space of the bottle body.

The opening unit may be provided with a cylindrical inside wall that extends downward in the axial direction at a position spaced apart from an outside wall of the opening unit by a predetermined distance, so that an outer circumferential surface of the inside wall of the opening unit is in movable contact with an inner circumferential surface of the exposed part of the additive storage container.

The outside and inside walls of the opening unit may have an outside injection hole and inside injection hole, respectively, on the same horizontal axis, and the exposed part of the additive storage container may have a communication hole that connects the outside injection hole and inside injection hole together at a predetermined position when the opening unit is rotating.

The communication hole may be configured as an elongate hole so that the outside injection hole and inside injection hole continue to communicate within an angular range having an angle larger than a predetermined angle when the opening unit is rotating.

The inner circumferential surface of the exposed part of the additive storage container may have a step which has a first seal groove, so that a lower end of the inside wall of the opening unit is axially inserted into the first seal groove to a predetermined depth.

The bottle may further comprise: a second seal groove formed in the opening unit at a position outside the inside wall so that an upper end of the exposed part of the additive storage container is axially inserted into the second seal groove to a predetermined depth.

The mouth of the bottle body may be formed through a double injection molding process in which a mouth piece is separately formed and then integrated with the mouth of the bottle body through injection molding.

In another aspect, the present invention provides a bottle, comprising: a bottle body having a mouth with a ring-type stopper formed around an outer circumferential surface of the mouth; an additive storage container provided with an insertion part inserted into the mouth of the bottle body and an exposed part externally exposed out of the mouth, and opened on an upper part thereof and provided with a discharge port at a lower part thereof, and defining an additive storage space therein; and an opening unit having a sealing part to open or close the upper part of the exposed part of the additive storage container, with a hook formed at an end of an outer circumferential surface of the sealing part and locked to the stopper of the mouth, and a valve body projecting in the sealing part and selectively isolating or communicating the additive storage space from or with a material storage space of the bottle body.

The sealing part of the opening unit may have a finger holding part extending outward from the sealing part in a radial direction.

In a further aspect, the present invention provides a bottle, comprising: a bottle body comprising a mouth on an upper part thereof, a communication hole formed on a sealed lower wall thereof, and an extension wall which extends downward from the lower wall and has a locking groove around an outer circumferential surface thereof; an additive storage container having a cylindrical shape and being opened at a side wall thereof, with an external thread provided around an outer circumferential surface of the additive storage container so that the container slides into the extension wall, and a valve body to open or close the communication hole; and an opening unit rotatably coupled to the extension wall of the bottle body and surrounding the additive storage container, and moving the additive storage container in an axial direction when rotating.

The opening unit may be provided on an open end thereof with a locking protrusion that movably engages with the locking groove of the extension wall, and provided on an inner surface thereof with an internal thread that engages with the external thread of the additive storage container and moves the additive storage container in the axial direction.

In yet another aspect, the present invention provides a bottle, comprising: a bottle body having a mouth having an external thread around an outer circumferential surface thereof and defining a material storage space therein; an additive storage container inserted into the mouth, and having an elevation protrusion on an outer circumferential surface thereof, and defining therein a plurality of additive storage spaces that selectively communicate with the material storage space of the bottle body; and an opening unit that comprises an outside wall engaging with the external thread of the mouth through a screw-type engagement, an inside wall inserted into the additive storage container, and a partition wall dividing the additive storage space into two isolated spaces.

In the bottle, a plurality of discharge ports may be formed on the lower part of the additive storage container, with a lower surface of the additive storage container gradually protruding upward to form a convex shape.

Furthermore, a seal piece may be provided on the lower surface at a position corresponding to each of the inside wall and the partition wall.

The opening unit may be provided with a seal groove into which the top end of the additive storage container is inserted.

The outside and inside walls of the opening unit may have an outside injection hole and an inside injection hole, respectively, to correspond to the additive storage spaces, and the additive storage container may have a communication hole that connects the outside injection hole and the inside injection hole together along the same horizontal axis at a predetermined position so that the additive storage spaces communicate with the atmosphere.

In still another aspect, the present invention provides a bottle, comprising: a bottle body having a mouth with an external thread formed around an outer circumferential surface of the mouth; an additive storage container inserted into the mouth, and having a cylindrical additive storage part opened at an upper end thereof and provided with a discharge port at a lower end thereof; and an opening unit having an end plate being in surface contact with the open end of the additive storage part, a main cap extending downward in an axial direction from an outer circumferential edge of the end plate and having an internal thread engaging with the external thread of the mouth through a screw-type engagement, and a slider extending downward in an axial direction from an inner circumferential edge of the end plate and movably inserted into the additive storage part, thus selectively opening or closing the discharge port.

The open end of the additive storage part may be integrally provided with a flange that has an outside protrusion extending outward in a radial direction from the additive storage part, the outer circumferential surface of the additive storage part may be provided at a predetermined position spaced apart from the flange by a predetermined distance with an external thread that has the same pitch as that of the external thread of the mouth, and the main cap may be provided at a predetermined position inside the internally threaded portion with an outside hooking protrusion that engages with the external thread of the additive storage part through a screw-type engagement and may be hooked by the outside protrusion, the outside hooking protrusion projecting inward from the main cap in a radial direction, so that, when the opening unit is rotated, the outside hooking protrusion is hooked by the outside protrusion, thus removing the additive storage part from the mouth.

The additive storage part may have an internal ratchet around a circumference of a root close to the flange, and an end of the outside hooking protrusion may be provided with an external ratchet that is allowed to rotate only in one direction relative to the internal ratchet.

The flange may further comprise another flange that has an inside protrusion extending inward in a radial direction, and an inside hooking protrusion to be hooked by the inside protrusion projects outward from the outer circumferential surface of the slider in a radial direction at a position corresponding to the outside hooking protrusion so that, when the opening unit is rotating, the inside hooking protrusion is hooked by the inside protrusion, thus removing the additive storage container from the mouth.

The outer circumferential edge of the end plate may be integrally formed with an upper cap that closes the upper part of the slider.

The end plate may be provided with at least one communication hole that is opened or closed by the flange.

The outer circumferential surface of the additive storage part may be provided with a plurality of sealing protrusions that are in contact with the inside surface of the mouth, thus maintaining a sealed state between the additive storage part and the mouth.

The lower surface of the additive storage container may gradually protrude upward to form a convex shape.

In the bottle, a seal piece may be inserted into the lower surface of the additive storage container at a position where the lower surface contacts the end of the slider.

In the bottle, an extension part may be formed in an axial direction around the outer circumferential edge of the end plate, with an upper cap selectively combined to the extension part.

In the bottle, a partition wall may integrally project upward from the lower surface of the additive storage container and divide the additive storage part into two parts, and the upper cap may be provided with an insertion groove into which an upper end of the partition wall is inserted.

The upper cap may be integrally connected to the main cap by a connection rib.

The extension part may be provided with an external thread which has the same pitch as that of the external thread of the mouth, and a sports cap having an internal thread may be combined to the external thread of the extension part through a screw-type engagement.

In still another aspect, the present invention provides a bottle, comprising: a bottle body having a mouth with an external thread formed around an outer circumferential surface of the mouth; an additive storage container inserted into the mouth, and having a cylindrical additive storage part having an open upper end and provided at a lower end thereof with a bursting part that is formed by a tear-off line; and an opening unit having an end plate being in surface contact with the open upper end of the additive storage part, a main cap extending downward in an axial direction from an outer circumferential edge of the end plate and having an internal thread combined to the mouth through a screw-type engagement, and a slider extending downward in an axial direction from an inner circumferential edge of the end plate and movably inserted into the additive storage part, and provided at a lower end thereof with a blade to cut the tear-off line.

The open upper end of the additive storage part may be integrally provided with a flange that has an outside protrusion extending outward in a radial direction from the additive storage part, the outer circumferential surface of the additive storage part may be provided at a position spaced apart from the flange by a predetermined distance with an external thread that has the same pitch as that of the external thread of the mouth, and the main cap may be provided at a predetermined position inside the internally threaded portion with an outside hooking protrusion that engages with the external thread of the additive storage part through by a screw-type engagement and is hooked by the outside protrusion, the outside hooking protrusion projecting inward from the main cap in a radial direction, so that, when the opening unit is rotated, the outside hooking protrusion is hooked by the outside protrusion, thus removing the additive storage part from the mouth.

The flange may further comprise an inside protrusion extending therefrom inward in a radial direction, and an inside hooking protrusion to be hooked by the inside protrusion projects outward from the outer circumferential surface of the slider in a radial direction at a position corresponding to the outside hooking protrusion so that, when the opening unit is rotating, the inside hooking protrusion is hooked by the inside protrusion, thus removing the additive storage container from the mouth.

The end plate may be provided with at least one communication hole that is opened or closed by the flange.

In the bottle, an extension part may be formed in an axial direction around the outer circumferential edge of the end plate, with an upper cap selectively combined to the extension part.

The upper cap may be integrally connected to the main cap by a connection rib.

The upper cap may be provided on an inner surface thereof with a plurality of seal protrusions spaced out at predetermined intervals, and the extension part may be integrally provided with a seal ring that is inserted into the seal protrusions.

The extension part may be provided with an external thread which has the same pitch as that of the external thread of the mouth, and a sports cap having an internal thread may be combined to the external thread of the extension part through a screw-type engagement.

In still another aspect, the present invention provides a bottle, comprising: a bottle body having a mouth with an external thread formed around an outer circumferential surface of the mouth; an additive storage container having a cylindrical additive storage part having an open upper end and provided with a discharge port at a lower end thereof, a cutting protrusion protruding in an axial direction from a lower end of the additive storage part and a hook integrally provided at a side of the discharge port; an opening unit having an end plate being in surface contact with the open upper end of the additive storage part, a main cap extending downward in an axial direction from an outer circumferential edge of the end plate and having an internal thread combined to the mouth through a screw-type engagement, a slider extending downward in an axial direction from an inner circumferential edge of the end plate and movably inserted into the additive storage part, and a bursting part provided on a lower part of the slider and having a hook ring which is hooked by the hook; and a separation means composed of a fixed ratchet formed as a ring shape on an inner surface of the open upper end of the additive storage container and a movable ratchet that is formed on an outer surface of the slider and interferes with the fixed ratchet at a predetermined position when the opening unit is released from the mouth.

The fixed ratchet and movable ratchet may be in surface contact with each other in an axial direction so that the fixed and movable ratchets are limited in rotation thereof when the opening unit is rotated to be released.

The fixed and movable ratchets may be inclined on rear surfaces thereof, thus allowing the slider to be inserted into the additive storage container.

In still another aspect, the present invention provides a bottle, comprising: a bottle body having a mouth with an external thread formed around an outer circumferential surface of the mouth; an additive storage container having a cylindrical additive storage part having an open upper end and provided with a discharge port at a lower end thereof, and a plurality of cutting tips provided around the discharge port in an axial direction; an opening unit having an end plate being in surface contact with the open upper end of the additive storage part, a main cap extending downward in an axial direction from an outer circumferential edge of the end plate and having an internal thread combined to the mouth through a screw-type engagement, a slider extending downward in an axial direction from an inner circumferential edge of the end plate and movably inserted into the additive storage part, and a bursting part provided on a lower part of the slider to be cut by the cutting tips; and a separation means comprising a fixed ratchet formed as a ring shape around the open upper end of the additive storage container and a movable ratchet formed on an inner surface of the end plate of the additive storage container at a position corresponding to the fixed ratchet, so that the movable ratchet is rotated in one direction relative to the fixed ratchet.

In still another aspect, the present invention provides a bottle, comprising: a bottle body having a mouth with an external thread formed around an outer circumferential surface of the mouth; an additive storage container having a cylindrical additive storage part an open upper end and provided with a discharge port at a lower end thereof, and a plurality of cutting tips provided around the discharge port in axial directions; an opening unit having an end plate being in surface contact with the open upper end of the additive storage part, a main cap extending downward in an axial direction from an outer circumferential edge of the end plate and having an internal thread combined to the mouth through a screw-type engagement, a slider extending downward in an axial direction from an inner circumferential edge of the end plate and movably inserted into the additive storage part, and a bursting part provided on a lower part of the slider to be cut by the cutting tips; and a separation means comprising a fixed ratchet formed as a ring shape around the discharge port of the additive storage container and a movable ratchet formed on a lower end of the slider of the opening unit at a position corresponding to the fixed ratchet, thus being allowed to be rotated in one direction relative to the fixed ratchet.

In the bottle, an inner circumferential surface of the open upper end of the additive storage container may be provided with a seal protrusion that is in movable contact with an outer circumferential surface of the slider.

In still another aspect, the present invention provides a bottle, comprising: a bottle body having a mouth with an external thread formed around an outer circumferential surface of the mouth; an additive storage container having an end plate being in surface contact with an open end of the mouth, a main cap extending in an axial direction from an outer circumferential edge of the end plate and having an internal thread engaging with the external thread of the mouth through a screw-type engagement, an inner cap extending in an axial direction from an inner circumferential edge of the end plate and movably inserted into the mouth, with a bursting part provided at a lower part of the inner cap; an opening unit comprising a finishing plate provided on an upper part of the inner cap, an upper cap extending in an axial direction from an outer circumferential edge of the finishing plate provided on an upper part and having an internal thread engaging with an outer circumferential surface of the inner cap, and a slider extending downward in an axial direction from the end plate and movably inserted into the additive storage container in an axial direction, with a cutting edge provided at a lower end of the slider to tear off the bursting part; and a fixed band provided on a lower part of the opening unit such that the fixed band is cut and limits downward movement of the opening unit.

The bursting part may have a thin circumferential edge at which the bursting part is firmly connected to the inner cap by a holder.

The slider may be provided on an inner surface thereof with a stirring protrusion that is formed along a length of the slider and internally projects in a radial direction.

The slider may be integrally provided therein with at least one stirring rod internally projecting in a radial direction.

In still another aspect, the present invention provides a bottle, comprising: a bottle body having a mouth with an external thread formed around an outer circumferential surface of the mouth; an additive storage container having an end plate being in surface contact with an open end of the mouth, a main cap extending downward in an axial direction from an outer circumferential edge of the end plate and having an internal thread combined to the mouth through a screw-type engagement, an inner cap extending in an axial direction from an inner circumferential edge of the end plate and being movably inserted into the mouth, with a discharge port and a hook protrusion provided on an end of the inner cap; and an opening unit comprising a finishing plate provided on an upper part of the inner cap, an upper cap extending in an axial direction from an outer circumferential edge of the finishing plate provided on an upper part and having an internal thread combined to the outer circumferential surface of the main cap, and a slider extending in an axial direction from the end plate and movably inserted into the additive storage container in an axial direction, and sealed by a plug at an end thereof.

The plug may be integrally provided at a lower end thereof with a hook that is hooked by the hook protrusion, so that the hook is allowed to engage with the hook protrusion and is then prevented from being separated from the hook protrusion.

The plug may have a seal protrusion that is combined to a seal groove formed on a lower end of the slider so that the plug is coupled to the slider to be separated from the slider.

The plug may be integrally formed on a lower end of the slider, with a thin tear-off line formed between the plug and the slider. The tear-off line may be an inclined line.

In the bottle, an upper part of the outer circumferential surface of the plug may be provided with a locking groove that engages with a locking protrusion that projects inward from an inner surface of the slider, so that the plug is coupled to the slider to be separated from the slider.

In the bottle, a seal ring may be provided between the plug and the slider.

In the bottle, an interference protrusion may be provided between the slider and the inner cap so that, when the slider and inner cap are moving relative to each other in axial directions, a sealed state between the slider and inner cap is maintained and a click sound is generated.

The finishing plate provided on an upper part may be provided with a sound port that emits the click sound generated from the interference protrusion to the atmosphere.

In still another aspect, the present invention provides a bottle, comprising: a bottle body having a mouth with an external thread formed around an outer circumferential surface of the mouth; an additive storage container having an end plate being in surface contact with an open end of the mouth, an inner cap extending downward in an axial direction from an inner circumferential edge of the end plate and movably inserted into the mouth in an axial direction, with a discharge port provided at an end of the inner cap, and an external thread that protrudes outward from an outer circumferential edge of the end plate in a radial direction to be continuous with the external thread of the mouth; an opening unit comprising a finishing plate provided on an upper part of the inner cap, an upper cap extending downward in an axial direction from an outer circumferential edge of the finishing plate provided on an upper part and having an internal thread engaging with the external threads of both the mouth and the end plate at the same time, and a slider extending in an axial direction from the finishing plate provided on an upper part and movably inserted into the additive storage container in an axial direction, with a discharge port provided at a lower part of the slider; and a bursting film that covers a lower end of the additive storage container and seals a gap between the slider and the inner cap.

The lower part of the slider may be provided with a wedge that prevents the additive storage container from rising higher than a predetermined position relative to the opening unit.

In the bottle, an upper end surface of the mouth may be provided with a lower ratchet and a lower surface of the additive storage container corresponding to the upper end surface of the mouth is provided with an upper ratchet, so that the additive storage container is allowed to rotate in one direction relative to the mouth.

In the bottle, an upper part of the additive storage container may be provided with a lower ratchet piece, and a lower surface of the opening unit corresponding to the upper part of the additive storage container may be provided with an upper ratchet piece that is allowed to rotate in one direction relative to the lower ratchet piece, so that rotational force of the opening unit is transmitted to the additive storage container.

In the bottle, ring-shaped seal protrusions may be provided around an outer circumferential surface of the slider at positions above and below the discharge port.

The slider may be provided therein with a partition wall that divides an additive storage space into two parts, with a discharge port and an open port formed on the two divided parts of the additive storage space.

The finishing plate provided on an upper part may be provided with at least one open port to supply the interior of the additive storage space with additive.

In still another aspect, the present invention provides a bottle, comprising: a bottle body having a mouth with an external thread formed around an outer circumferential surface of the mouth; an additive storage container having an end plate being in surface contact with an open end of the mouth, a main cap extending in an axial direction from an outer circumferential edge of the end plate and having an internal thread engaging with the external thread of the mouth through a screw-type engagement, an inner cap extending in an axial direction from an inner circumferential edge of the end plate and movably inserted into the mouth, with a bursting part provided at a lower part of the inner cap; an opening unit comprising a finishing plate provided on an upper part provided on an upper part of the inner cap, an upper cap extending in an axial direction from an outer circumferential edge of the finishing plate provided on an upper part and having an internal thread engaging with an outer circumferential surface of the inner cap, and a slider extending downward in an axial direction from the end plate and being movably inserted into the additive storage container in an axial direction, with a cutting edge provided at a lower end of the slider to tear off the bursting part; and a fixed band provided on a lower part of the opening unit such that the fixed band is cut and limits downward movement of the opening unit.

The bursting part may have a thin circumferential edge at which the bursting part is firmly connected to the inner cap by a holder.

The slider may be provided on an inner surface thereof with a stirring protrusion that is formed along a length of the slider and internally projects in a radial direction.

The slider may be integrally provided therein with at least one stirring rod internally projecting in a radial direction.

BRIEF DESCRIPTION OF THE DRAWINGS

FIGS. 31A and 32B are sectional views showing the operation of the 16$^{th}$ embodiment of the present invention;

BEST MODE

Figure 1:
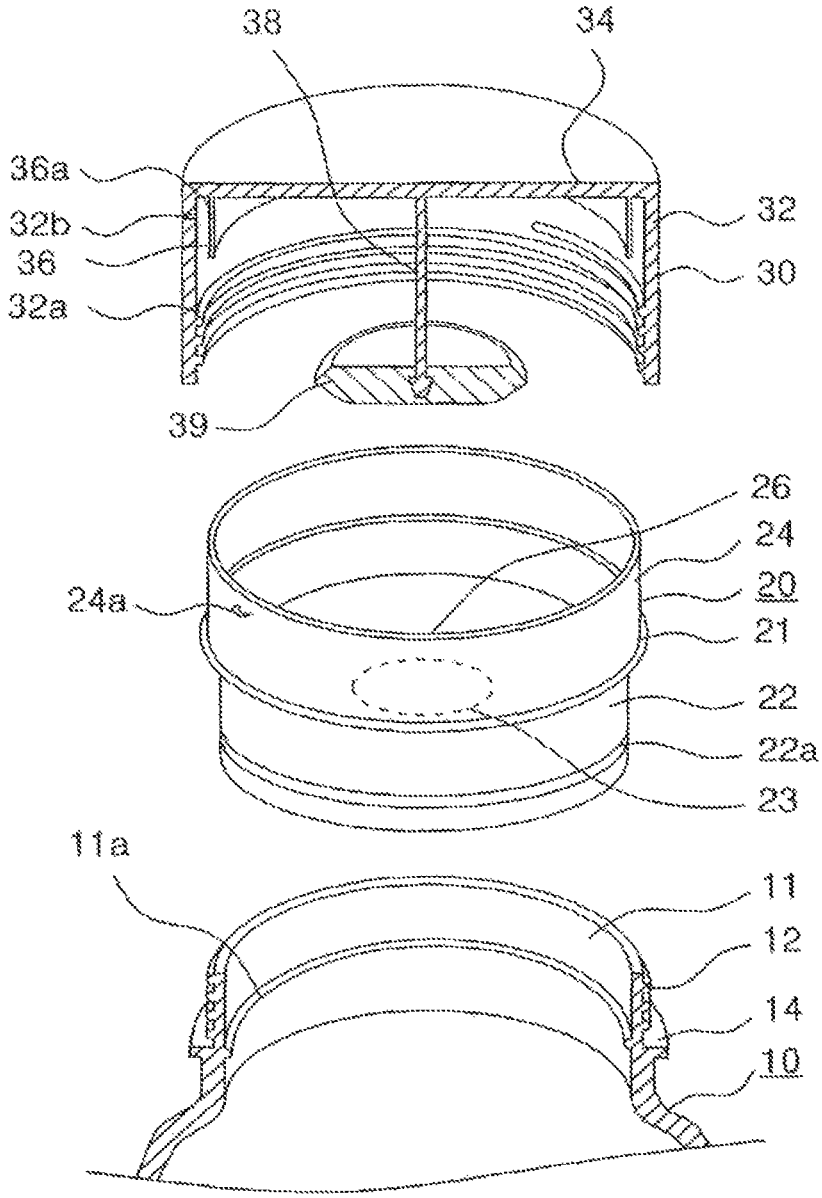
FIG. 1 is an exploded perspective view showing the construction of the 1$^{st}$ embodiment of the present invention.

FIGS. 1, 2A, 2D, and 2E show the 1$^{st}$ embodiment of the bottle according to the present invention. FIG. 1 is an exploded perspective view, FIGS. 2A through 2E show the operation of the bottle. As shown in the drawings, the bottle of the 1$^{st}$ embodiment comprises a bottle body 10, having a mouth 11; an additive storage container 20 that is combined to the inside of mouth 11 and provides an additive storage space 2 therein; and an opening unit 20 that is combined to the mouth of 11 through a screw-type engagement, is operated in conjunction with the additive storage container 20 and seals the additive storage space 2.

The bottle body 10 has an external thread 12 on the outer circumferential surface of the mouth 11 and a stop flange at a position below the external thread 12. In addition, the inner circumferential surface of the mouth 11 is provided with a spiral locking protrusion 11*a* that is formed around the inner circumferential surface.

The additive storage container 20 is a cylindrical body, upper and lower ends of which are opened. A ring-type elevating protrusion 21 is formed around the intermediate portion of the outer circumferential surface of the container 20. It is preferable to form the elevating protrusion 21 such that the protrusion 21 is inclined at an inclination angle corresponding to that of the external thread 1 of the mouth 11. In addition, part of the additive storage container 20 below the elevating protrusion 21 is inserted into the mouth 11 of the bottle body 10. This part is an insertion part 22. The opposite part of the container 20 is an exposed part 24 that is exposed outside of the mouth 11. The elevating protrusion 21 is larger than the mouth 11 in the outer diameter, so that the protrusion 21 remains exposed outside the mouth 11. The outer circumferential surface of the insertion part 220 is provided with a spiral locking groove 22*a* that engages with the spiral locking protrusion 11*a* formed on the inner circumferential surface of the mouth 11 and limits axial movement of the additive storage container 20. The exposed part 24 has a longitudinal communication hole 24*a*. In addition, the lower end of the insertion part 22 is provided with a valve seat 26 that projects inward in a radial direction and has a discharge port 23 on its central portion.

The opening unit 30 is a cylindrical body which is opened at an end thereof and is closed at the other end thereof. This opening unit 30 comprises a cylindrical outside wall 32 and an end wall 34 that closes an end of the outside wall. This opening unit 30 has an internal thread 32*a* that engages with the external thread 12 of the mouth 11, so that the unit 30 can be selectively tightened to or loosened from the bottle body 10. The center of the end wall 34 is provided with a support shaft 38 that extends downward from the center of the end wall in an axial direction. The support shaft 38 is provided at an end thereof with a valve body 39 that is in contact with the valve seat 26 and selectively opens or closes the discharge port 23. The valve body 39 is made of a soft material, so that the valve body 39 in contact with the valve seat 26 can be further elastically compressed under pressure and can come into close contact with the valve seat 26. This design provides a good sealing effect. In addition, the end wall 34 of the opening unit 30 is provided with a cylindrical inside wall 36 that extends downward in an axial direction from a position spaced apart from the outside wall 32 by a predetermined distance. The inside wall 36 is designed to be closely fitted into the inside of the exposed part 24 of the additive storage container 20. In the above state, the fitting allowance between the inside wall 36 and the exposed part 24 is preferably determined to provide a middle fitting state capable of providing a desired sealing performance. Furthermore, an outside injection hole 32*b* and an inside injection hole 36*a* are formed through the outside wall 32 and the inside wall 36, respectively, such that the holes 32*b* and 36*a* are placed on the same horizontal axis. The outside injection hole 32*b* and the inside injection hole 36*a* are designed to communicate with the communication hole 24*a* at a predetermined position when the additive storage container 20 is released from the mouth 11. Preferably, the two injection holes 32*b* and 36*a* and the communication hole 24*a* are placed on the same horizontal line when the opening unit 30 is released a predetermined distance from the mouth 11. The communication hole 24*a* of the additive storage container 20 is configured as an elongate hole, so that the two injection holes 32*b* and 36*a* continue to communicate within an angular range having an angle larger than a predetermined angle when the opening unit 30 is rotated.

In the present invention, the spiral locking protrusion 11*a* and the locking groove 22*a* limit the axial movement of the additive storage container 20 and seal the gap between the mouth 11 and the container 20. However, it should be understood that the spiral locking protrusion 11*a* and the locking groove 22*a* are not indispensable components but additional components. That is, the spiral locking protrusion 11*a* and the locking groove 22*a* are used only when resistance to undesired axial movement of the additive storage container 20 is needed due to a compressed material being contained in the storage space of the container 20 and generating pressure in the container 20.

Figure 2A:
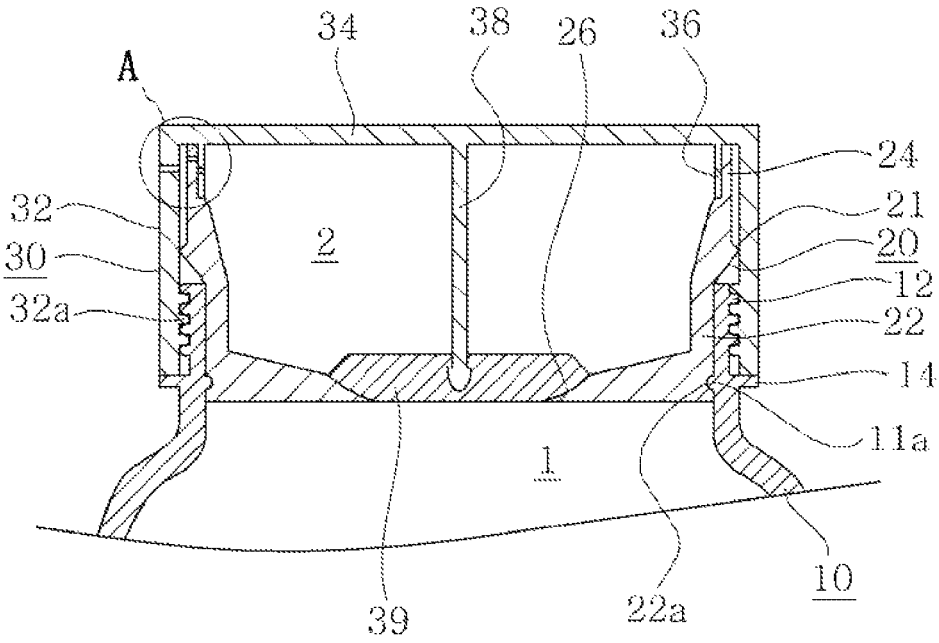
FIGS. 2A through 2D are sectional views showing the operation of the 1$^{st}$ embodiment of the present invention.

The above-mentioned bottle of the present invention is operated as follows (in the following description, the term 'material' means a material contained in the bottle body 10, and the term 'additive' means another material contained in the additive storage container 20). FIG. 2A shows a tightened and sealed state, which is an initial state of the product. This drawing illustrates that the material is contained in the sealed material storage space 1 and the additive is contained in the additive storage space 2 isolated from the material storage space. The additive storage space 2 is sealed by the inside wall 36, additive storage container 20, valve body 39 and valve seat 26. At this moment, the outside injection hole 32*b* and the inside injection hole 36*a* are placed in the bottle body 10 at positions below the communication hole 24*a*, so that the storage space of the additive storage container 20 is kept in a sealed state. The inside wall 36 of the opening unit 30 is inserted into the exposed part 24 of the additive storage container 20 and the locking protrusion 21 is in close contact with the inner circumferential surface of the outside wall 32 of the opening unit 30, so that the additive storage space 2 is kept in good sealed condition.

Figure 2B:
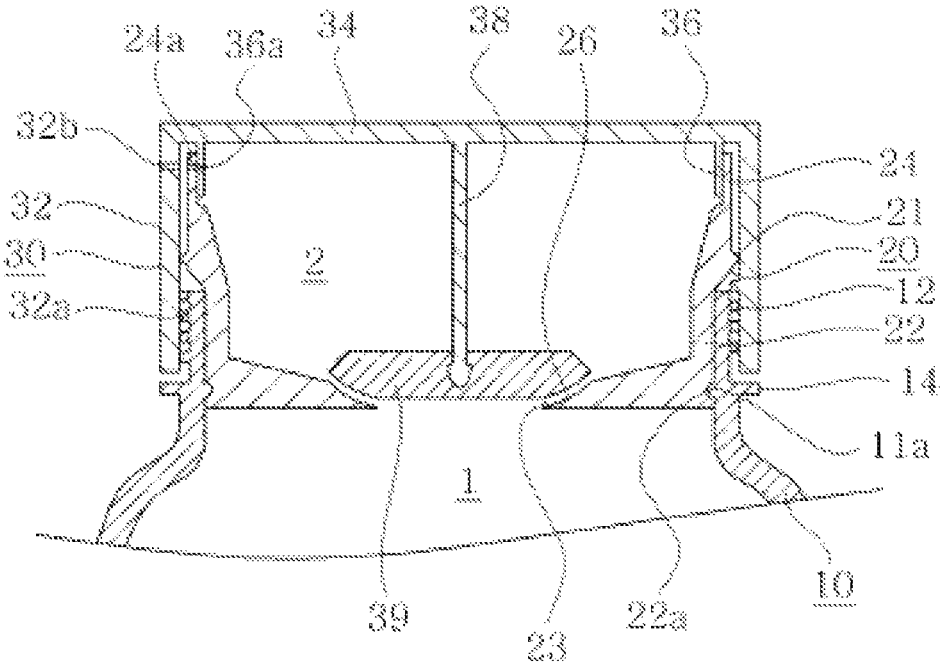

If a user rotates the opening unit 30 in an opening direction (counterclockwise direction) in the above-mentioned state, the valve body 39 rises up from the valve seat 26 as shown in FIG. 2B and a gap is created between the valve body 39 and the valve seat 26. Thus, the additive is discharged from the storage space 2 into the bottle body 10 and is mixed with the material contained in the bottle body 10. As the opening unit 30 is rotated as described above, the outside injection hole 32*b* and the inside injection hole 36*a* rise up along spiral tracks and meet the communication hole 24*a* of the additive storage container 20 at a predetermined position, so that atmospheric pressure acts in the additive storage space 2 and the additive can then be easily discharged into the bottle body 10. Although FIG. 2B shows that the outside injection hole 32*b*, the inside injection hole 36*a* and the communication hole 24*a* are placed on the same horizontal axis and, at the same time, the discharge port 23 is slightly opened, the three holes are placed on the same horizontal axis within a predetermined angular range. In the above state, the discharge port 23 is kept in a sealed state in an initial stage of the communication of the three holes 32*b*, 36*a* and 24*a* and starts to open after the opening unit 30 has rotated by a predetermined angle. The necessity of the above-mentioned positional relation will be appreciated in the description for FIG. 2C.

Figure 2C:
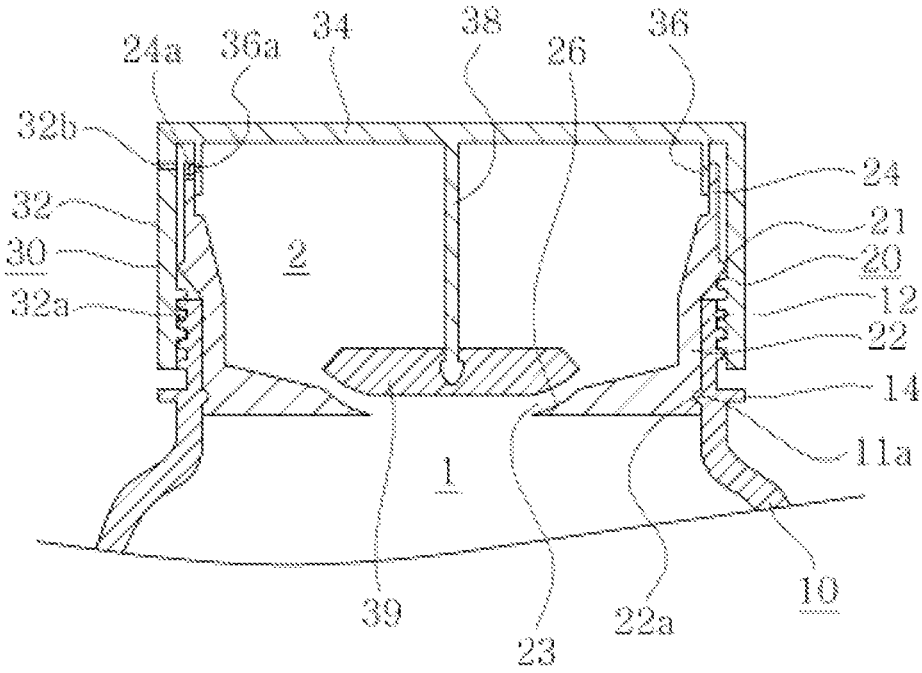
Figure 2E:
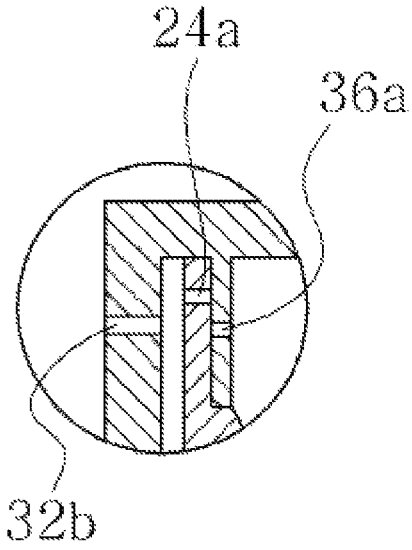
FIG. 2E is an enlarged view showing Area A of FIG. 2A.
Figure 2D:
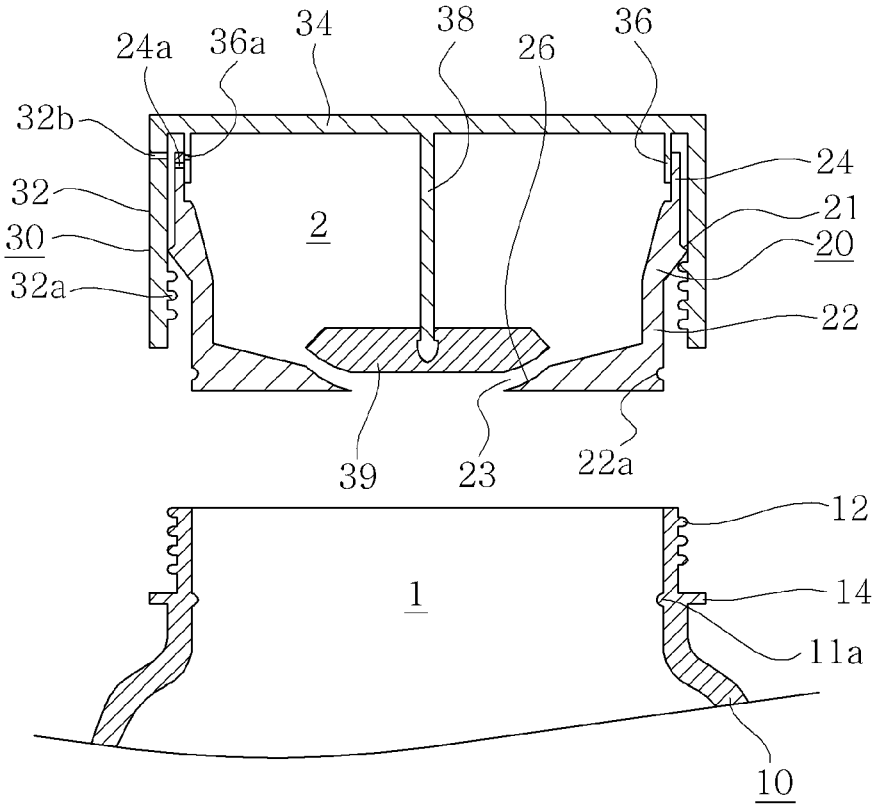

If the user further rotates the opening unit 30 counterclockwise, the internal thread 32*a* meets the elevating protrusion 21 of the additive storage container 20 as shown in FIG. 2C. If the user continues to rotate the opening unit 30 in the same direction, the additive storage container 20 will move in an axial direction due to the interference of the internal thread 32*a* and the elevating protrusion 21. If the user rotates the opening unit 30 further, the additive storage container 20 will be completely removed from the mouth 11 with its spiral locking groove 22*a* being separated from the spiral locking protrusion 11*a*.

The above description of this inventive bottle is based on the premise that an additive is loaded in the additive storage space of the bottle at the time the bottle is marketed. This bottle may be, however, supplied with the additive storage space empty. In this state, a user can load a desired additive into the additive storage space as necessary.

The outside injection hole 32*b* and the inside injection hole 36*a* will start to communicate with the communication hole 24*a* due to counterclockwise rotation of the opening unit 30 at a position just before the state of FIG. 2B, which is the state where a gap is made between the valve body 39 and valve seat 26. Thus, the user can maintain the communication between the outside injection hole 32*b* and the inside injection hole 36*a* thanks to the longitudinal communication hole 24*a* when the opening unit 30 is rotated at a predetermined angle. The additive will not, therefore, enter the bottle body 10 but will continue to be stored in the additive storage space 2 of the additive storage container 20 if the user inputs a desired amount of additive in such condition. If the user tightens the opening unit 30 clockwise in this condition, the valve body 39 will come into closer contact with the valve seat 26, thus restoring its original state. If the user releases the opening unit 30 counterclockwise, the additive will be input into the bottle body 10 as shown in FIG. 2B.

Figure 3:
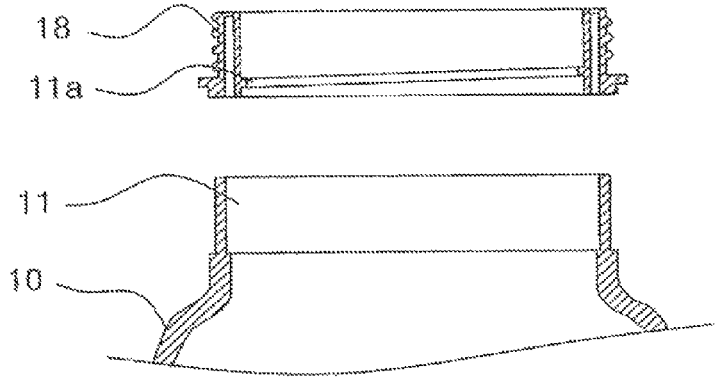
FIG. 3 is an enlarged sectional view showing how to mold the mouth of a bottle body of the present invention.

FIG. 3 shows an injection-molding process of forming the mouth of the bottle body. A mouth piece 18 is separately molded and then injection-molded with the mouth 11 of the bottle body 10, so that the spiral locking protrusion 11*a* of the mouth 11 of the bottle body 10 is effectively provided. That is, to form the mouth 11 of the bottle body 10, a double injection molding process is preferably used.

Figure 4:
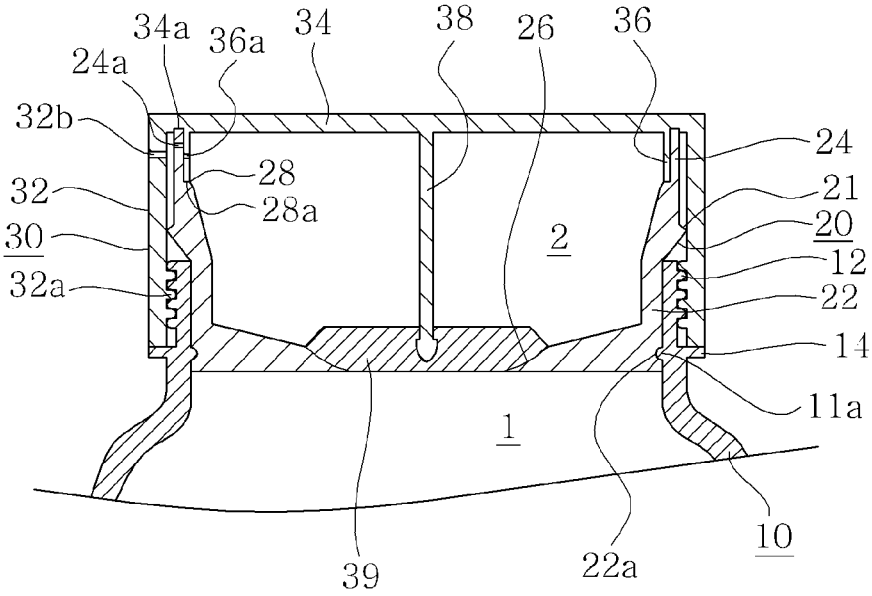
FIG. 4 is a sectional view showing the construction of the 2$^{nd}$ embodiment of the present invention.

FIG. 4 shows the construction of the $2^{nd}$ embodiment of the bottle according to the present invention. The $2^{nd}$ embodiment uses the same reference numerals as those used in the $1^{st}$ embodiment, without detailed description. The $2^{nd}$ embodiment indicates a structure needed for a tighter seal between the opening unit 30 and the additive storage container 20. To accomplish the above-mentioned object, a step 28 is formed on the inner circumferential surface of the exposed part of the additive storage container 20. A first seal groove 28*a* is formed on the step 28 so that the end of the inside wall 36 of the opening unit 30 can be inserted into the first groove 28*a* in an axial direction to a predetermined depth. In addition, a second seal groove 34*a* is formed in the opening unit 30 at a position outside the inside wall 36 so that the end of the opening unit 30 can be inserted into the second groove 34*a* in an axial direction to a predetermined depth.

The additive storage container 20 is coated with a soft material, such as elastic, flexible silicone, non-toxic rubber, non-toxic PVC, etc., on its surface, so that an effective seal is provided by the combination of the coated container 20 and the inside wall 36. With this structure, a user can efficiently prevent gas from leaking even if the additive in the additive storage space 2 contains gas, such as a carbonated beverage.

Figure 5:
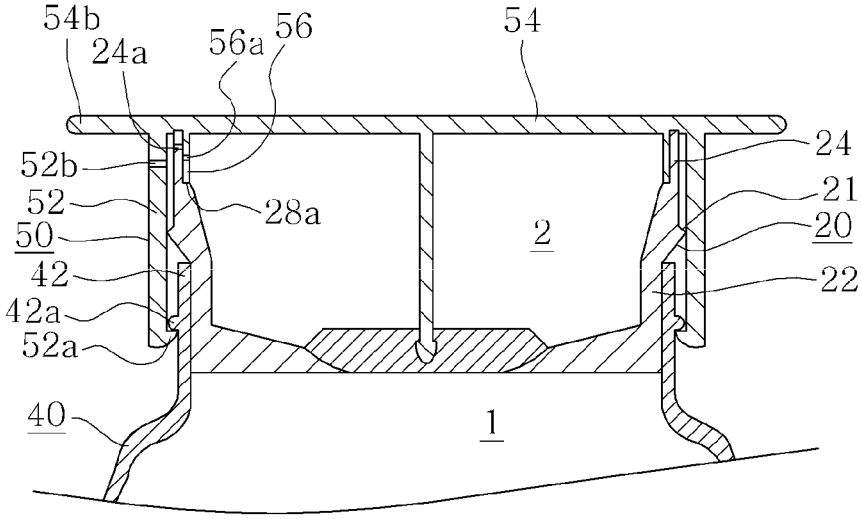
FIG. 5 is a sectional view showing the construction of the 3$^{rd}$ embodiment of the present invention.

FIG. 5 shows the $3^{rd}$ embodiment of the present invention. This drawing shows the embodiment of the inventive bottle when applied to some containers like flasks, test tubes, wine bottles, cans, etc., which do not have external threads on their mouths. This embodiment indicates that the outer circumferential surface of the mouth 42 is provided with a ring-type stopper 42*a* that projects externally in a radial direction.

The additive storage container 20 is designed to be the same as that of the $2^{nd}$ embodiment of the present invention. A detailed description is, therefore, not made of the container 20 with the same reference numerals as those used in the $2^{nd}$ embodiment. A step 28 is formed on the inner circumferential surface of the exposed part 24 of the additive storage container 20. A first seal groove 28*a* is formed on the step 28 so that the end of the inside wall 56 of the opening unit 50 can be inserted into the first groove 28*a* in an axial direction to a predetermined depth.

The opening unit 50 has a cylindrical shape which is open at one end thereof and is closed at the other end thereof. This opening unit 50 comprises a cylindrical outside wall 52 and a sealing part 54 that seals the end of the outside wall 52. The opening unit 50 has a hook 52*a* that is hooked by the stopper 42*a* of the mouth 42 on the inner circumferential surface of the open end. The sealing part 54 of the opening unit 50 is provided with a cylinder type inside wall 56 that projects in an axial direction from a position, inwardly spaced apart from the outside wall 52, to a predetermined distance. This inside wall 56 is designed to be fitted into the exposed part 24 of the additive storage container 20. A second seal groove 54*a* is made on the sealing part 54 of the inside wall 56 so that the end of the opening unit 24 can be inserted into the second groove 54*a* in an axial direction to a predetermined depth. In addition, the outside wall 52 and the inside wall 54 are provided with an outside injection hole 52*b* and an inside injection hole 56*a* respectively that are formed through their corresponding walls. The two injection holes 52*b* and 56*a* are designed to communicate with the communication hole 24*a* of the additive storage container 20 at a predetermined position. It is recommended that such injection holes 52*b* and 56*a* should be placed on the same line after the opening unit 50 moves upward alongside the axis from the mouth of the bottle body 40. In addition, two finger holding parts 54*b* extend outwards from the sealing part 54 of the opening unit 50 in radial directions so that the opening unit 50 can be conveniently removed from the mouth of the bottle body in an axial direction.

The 3$^{rd}$ embodiment is operated as follows. If the finger holding parts 54*b* are pulled in an axial direction, the hook 52*a* is separated from the stopper 42*a*. If the hook 52*a* moves a predetermined distance, the hook 52*a* is hooked by the elevating protrusion 21 so that the additive storage container 20 can be separated from the mouth 42. Thus, the additive contained in the additive storage space 2 is input into the material storage space 1 of the bottle body 40. The 3$^{rd}$ embodiment can be, therefore, used efficiently for bottles which do not have an external thread around the outer circumferential surface of the mouth.

Figure 6A:
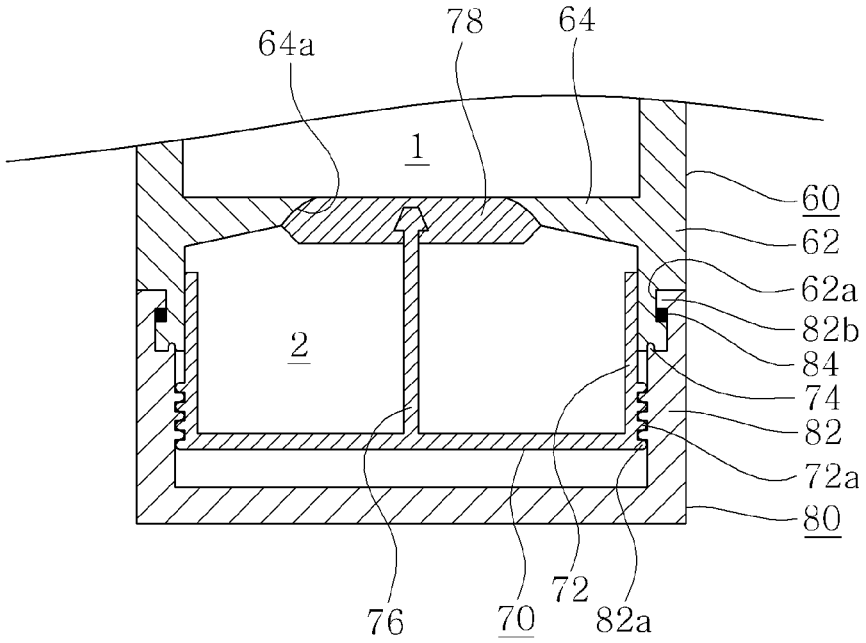
FIGS. 6A and 6B are sectional views showing the construction and operation of the 4$^{th}$ embodiment of the present invention.
Figure 6B:
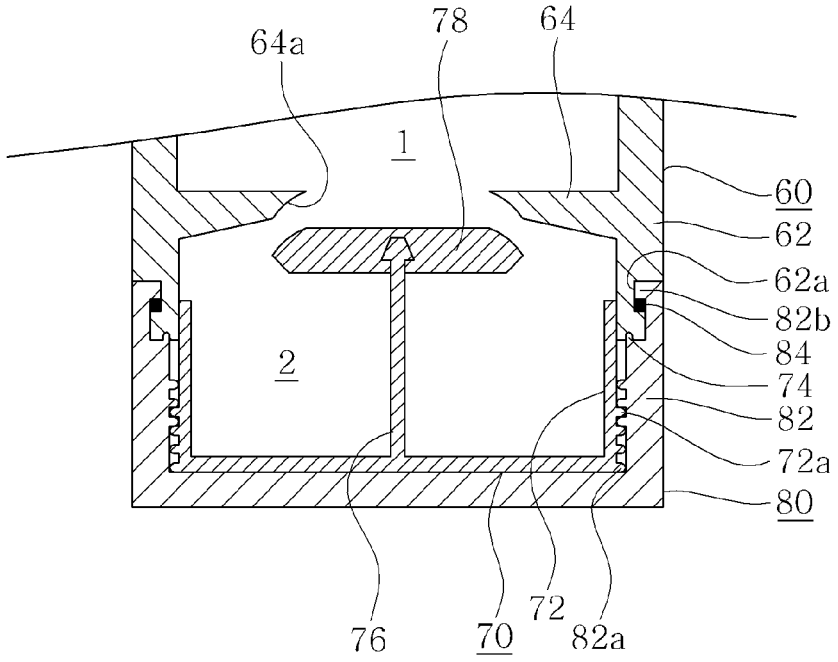

FIG. 6A and FIG. 6B show the 4$^{th}$ embodiment of the present invention. In this embodiment, the present invention is applied to the lower part of a bottle.

In this embodiment, the lower wall 64 of a bottle body 60 is provided with a communication hole 64*a*, an extension wall 62 that extends downward from the lower wall 64, and a locking groove 62*a* formed around the outer circumferential surface of the extension wall 62. An additive storage container 70 which is a cylindrical body open at one end is movably inserted upward into the extension wall 62. The center of the additive storage container 70 is provided with a support shaft 76 that extends upward in an axial direction. The support shaft 76 is provided at an end thereof with a valve body 78 that selectively opens or closes the communication hole 64*a*. An external thread 72*a* is formed around the outer circumferential surface of a cylinder part 72 of the additive storage container 70. A cylinder type opening unit 80 that is open at one end thereof is provided outside the additive storage container 70. The opening unit 80 has a cylinder type outside wall 82 that is closed at one end thereof. The inner circumferential surface of the outside wall 82 is provided with an internal thread 82*a* that engages with the external thread 72*a*. The outside wall 82 is provided with a locking ring 82*b* that is locked by the locking groove 62*a* of the extension wall 62. A sealing piece 84 is provided between the locking groove 62*a* and the locking ring 82*b*, thus preventing material from leaking. In addition, it is preferable to make a long passage by forming an axially inserted part 74 at the junction between the lower end of the extension wall 62 and the inside surface of the outside wall 82.

As shown in FIG. 6A, the 4$^{th}$ embodiment of the present invention is designed such that the valve body 78 closes the communication hole 64*a* when the bottle is marketed. Therefore, the additive storage space 2 and the material storage space 2 are isolated from each other. If a user rotates the opening unit 80, the additive storage container 70 falls down due to an interaction between the internal thread 82*a* and the external thread 72*a*. And then, the communication hole 64*a* is opened, so that the material storage space 1 and the additive storage space 2 communicate with each other. Thus, the user can mix the material and the additive in both spaces 1 and 2 by inverting the bottle or shaking the bottle up and down. This embodiment can be adapted to the case in which the user needs to input a large quantity of additive by placing the additive storage container at the lower part of the bottle.

Figure 7A:
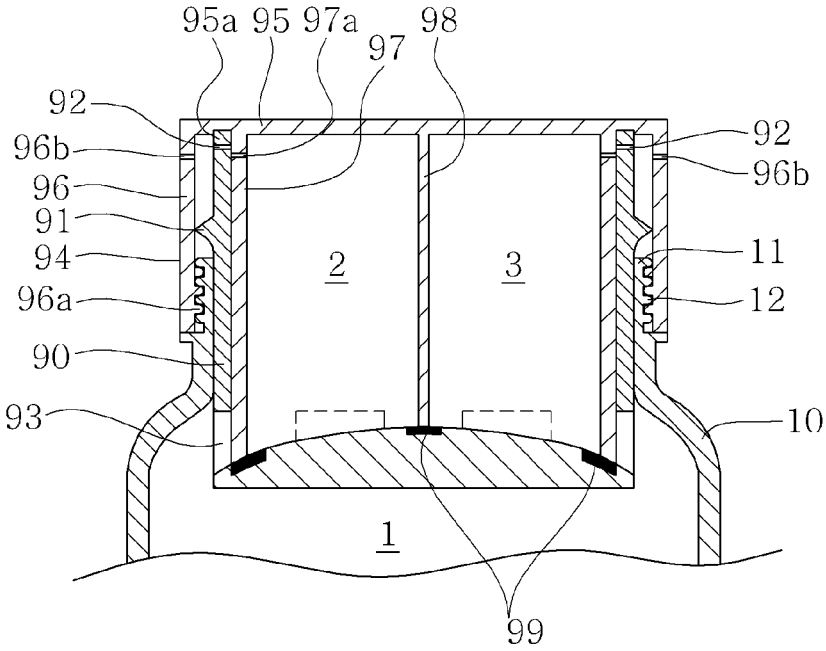
FIGS. 7A and 7B are sectional views showing the construction and operation of the 5$^{th}$ embodiment of the present invention.
Figure 7B:
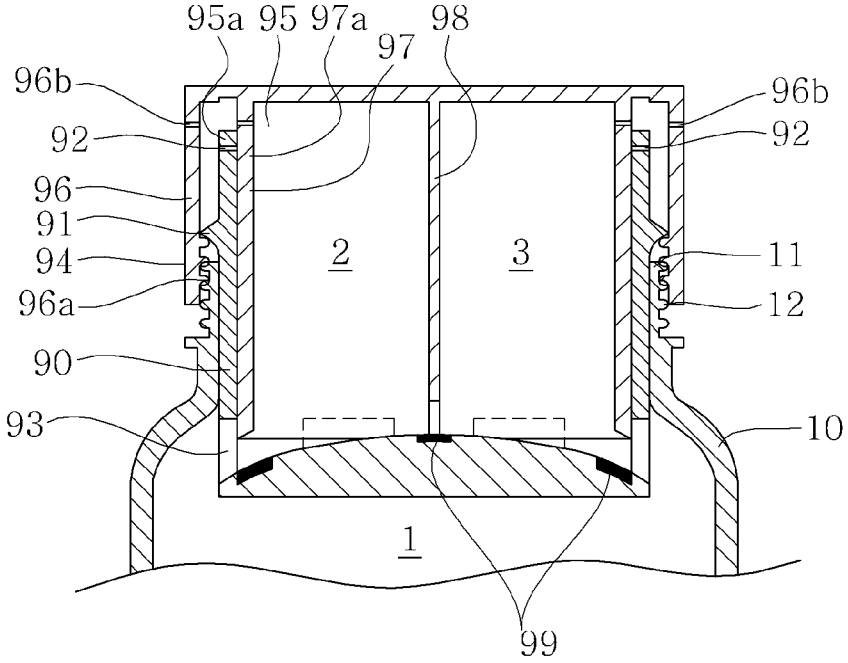

FIGS. 7A and 7B show the construction of the 5$^{th}$ embodiment of the present invention. In the 5$^{th}$ embodiment, there are two additive storage spaces in an additive storage container so that two kinds of additives can be used. In this embodiment, the same elements as those of the 1$^{st}$ embodiment will carry the same reference numerals and further explanation for the elements is deemed unnecessary. The bottle according to this embodiment comprises a bottle body 10 that is provided with a mouth 11 that has an external thread 12 on its outer circumferential surface, an additive storage container 90 that is fitted into the mouth 11 and make an additive storage space therein, and an opening unit 94 that is tightened to the mouth 11 through a screw-type engagement. The opening unit 94 is operated in conjunction with the additive storage container 90, thus sealing the additive storage space and partitioning the interior of the container 90 into two isolated spaces 2 and 3 to contain additives therein.

The additive storage container 90 has a cylindrical shape and is opened at an end thereof. The outer circumferential surface of its central part is provided with an elevating protrusion 91 that projects externally in a radial direction. The open end of the container 90 is provided with a communication hole 92. There are some discharge ports 93 around the lower part of the container 90. The lower surface of the container 90 gradually protrudes upwards to form a convex shape so that an additive can be easily input into the material storage space 1 of the bottle body 10. In addition, the lower surface of the container 90 is provided with a seal piece 99 at a position where the inside wall 7 comes into contact with the lower end of the partition wall 98 so that the additive storage spaces 2 and 3 can be effectively sealed.

The opening unit 94 is opened at an end thereof and has a cylinder-type outside wall 96 that is closed by the sealing part 95 on the other end. The sealing part 95 is provided with a seal groove 95*a* into which the upper end of the additive storage container 90 is inserted. The inner circumferential surface of the outside wall 96 is provided with an internal thread 96*a* that engages with the external thread 12 of the mouth 11 through a screw-type engagement. The center of the sealing part 95 is provided with a partition wall 98 that extends from the sealing part 95 downwards in an axial direction. The sealing part 95 of the opening unit 94 is also provided with a cylinder-type inside wall 97 that extends downwards in an axial direction from a position spaced inward apart from the outside wall 96 by a predetermined distance. This inside wall 97 is movably inserted into the additive storage container 90 in an axial direction. In addition, the outside wall 96 and the inside wall 97 are respectively provided with an outside injection hole 96*b* and an inside injection hole 97*a* that are formed through their corresponding walls. The construction and operation of the outside injection hole 96*b*, the inside injection hole 97*a* and the communication hole 92 are the same as those described for the 2$^{nd}$ embodiment.

In the bottle according to the 5$^{th}$ embodiment, different kinds of materials, such as sugar and cream powder, can be stored in the storage spaces isolated from each other by the partition wall 98 as shown in FIG. 7A. If a user rotates the opening unit 94 in the above state, the inside wall 7 rises up and the discharge ports 93 are opened as shown in FIG. 7B. Thus, the additives contained in the additive storage spaces 2 and 3 are input into the material storage space 1 of the bottle body 10. At this moment, the additives are easily input due to their weight because the lower surface protrudes to form the convex shape. In addition, if the opening unit 94 rotates further in the same direction, the additive storage container 90 is separated from the mouth 11 of the bottle body 10 due to the interaction between the internal thread 96*a* and the elevating protrusion 91.

This 5$^{th}$ embodiment allows a user to effectively store two kinds of additives in the additive storage container so that the user can use the additives by mixing them as necessary. Furthermore, the additive storage space of the storage container can be partitioned into three or more spaces by properly changing the design of the discharge ports 93 and the partition wall 98. The user can, therefore, use this bottle effectively even in the case in which the user needs various kinds of mixtures.

Figure 8:
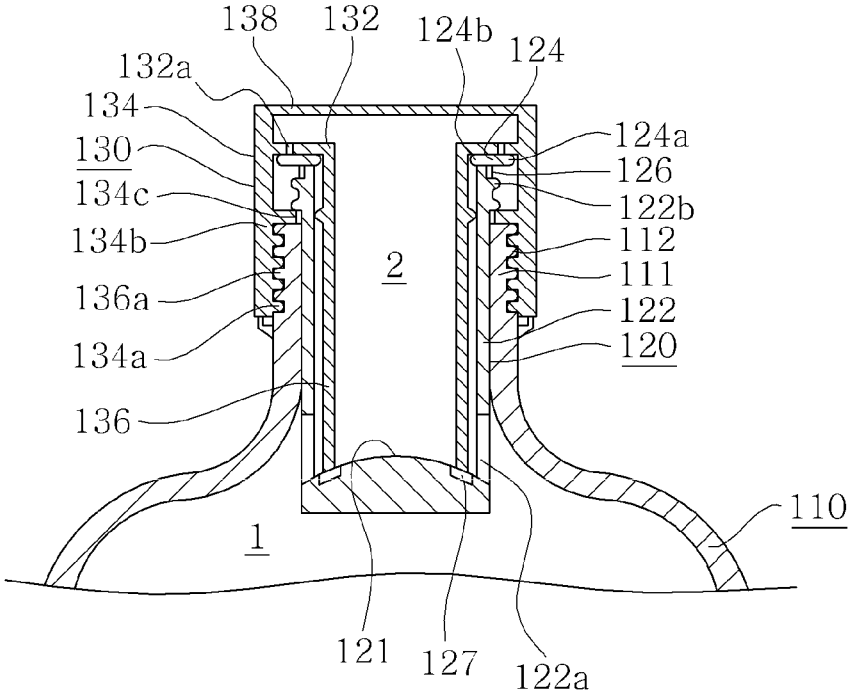
FIG. 8 is a sectional view showing the construction of the 6$^{th}$ embodiment of the present invention.

FIG. 8 shows the construction of the $6^{th}$ embodiment of the present invention regarding a bottle cap. This embodiment is configured such that the additive storage container can be effectively removed from a bottle body using a ratchet structure.

This embodiment comprises a bottle body 110 that has a mouth 111 which is provided with an external thread 112 on its outer circumferential surface. The additive storage container 120 is inserted into the mouth 111 of the bottle body 110 so that the container 120 can be separated from the bottle body 110. An opening unit 130 engages with the external thread 112 of the mouth 111 through a screw-type engagement. The opening unit 130 releases the additive from the additive storage container 120 through its interference with the container 120, and separates the additive storage container 120 from the mouth 111 of the bottle body 110 if the screw-type engagement part is loosened to a predetermined distance.

The additive storage container 120 is opened at the upper part thereof and has a sealed cylinder type additive storage part 122 at the lower part thereof. A plurality of discharge ports 122*a* are formed around the lower circumferential surface of the additive storage part 122. The open end of the container 120 is provided with a flange 124.

The opening unit 130 comprises an end plate 132 which is in contact with the open end of the additive storage part 122, an internally threaded main cap 134 which extends in an axial direction from the outer circumferential surface of the end plate 132 and is tightened to the mouth 111 through a screw-type engagement, and a slider 136 which extends in an axial direction from the inner circumferential surface of the end plate 132 and is movably inserted into the additive storage part 122 so that it is possible to selectively open or close the discharge ports 122*a*. The opening unit 130 is provided with a finish plate 138 that closes the upper part of the slider 136 outside the end plate 132.

The flange 124 of the additive storage part 122 is provided with an external protrusion 124*a* that extends externally in a radial direction from the additive storage part. The outer circumferential surface of the additive storage part 122 is provided with an external thread 122*b* that has the same pitch as that of the external thread 112 of the mouth 111, extending to a predetermined distance from the flange. The innermost part of a section of the main cap 134 having the internal thread 134*a* is provided with an outside hooking protrusion 134*b* which engages with the external thread 122*b* of the additive storage part 122 through a screw-type engagement and interferes with the outside protrusion 124*a* at a predetermined position. The outside hooking protrusion 134*b* protrudes inwards in a radial direction.

Figure 9:
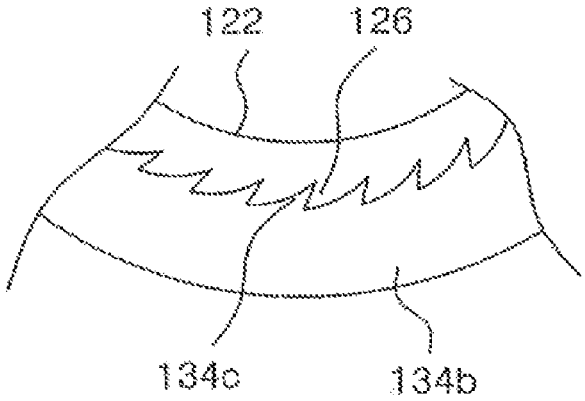
FIG. 9 is a plan view showing the structure of ratchets used for restriction of rotation of the opening unit relative to the additive storage container of the 6$^{th}$ embodiment of the present invention.

As shown in FIG. 9, the additive storage part 122 has an internal ratchet 126 around a circumference thereof close to the flange 122. The end of the outside hooking protrusion 134*b* is provided with an external ratchet 134*c* that allows the internal ratchet 126 to rotate only in one direction.

The flange 124 is provided with an inside protrusion 124*b* that extends internally in a radial direction. An inside hooking protrusion 136*a* engaging with the internal protrusion 124*b* protrudes externally in a radial direction at the position where the outside hooking protrusion 134*b* comes into contact with the outer circumferential surface of the slider 136.

The end plate 132 is provided with at least one communication hole 132*a* that is opened or closed by the flange 124. Here, the communication hole 132*a* is the one formed on the end plate 132 as shown in the drawing. In the present invention, however, the communication hole may be formed on the upper part of the slider 136. That is, the communication hole is closed by the inside wall of the additive storage part in a closed state, and it is released from the additive storage part if the opening unit rises up. As a result, the same operational effect can be accomplished.

Figure 10A:
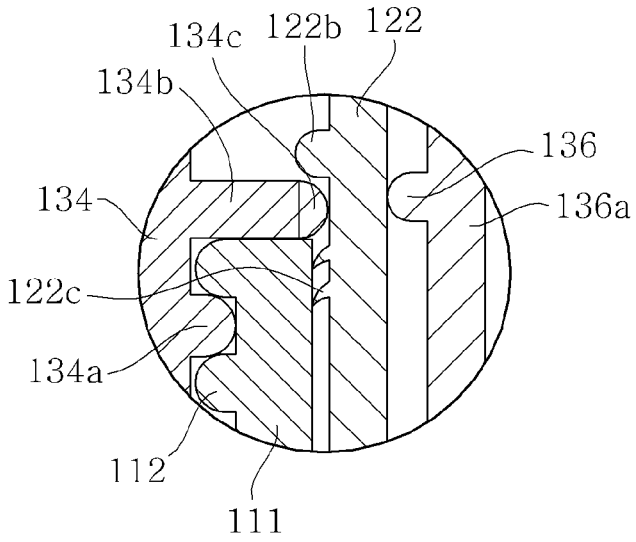
FIGS. 10A and 10B are enlarged sectional views showing a seal structure of the additive storage container and the mouth of a bottle body according to the 6$^{th}$ embodiment of the present invention.

FIG. 10A shows that the outer circumferential surface of the additive storage part 122 is provided with a plurality of seal protrusions 122*c* that are in contact with the inner circumferential surface of the mouth 111 and keep the bottle in a sealed state.

Figure 10B:
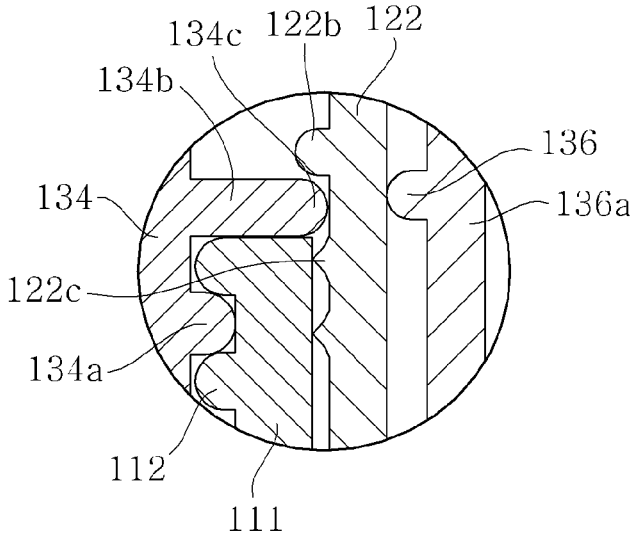

In the present invention, it is possible to design the seal protrusion in various forms. It is also recommended to design the seal protrusion as a wedge-shaped protrusion 122*d*, as shown in FIG. 10B.

The lower surface 121 of the additive storage container 120 is designed to gradually protrude upward to form a convex shape so that the additive contained in the additive storage space can be easily released.

A seal piece 127 is inserted into a part that is in contact with the end of the slider 136 on the lower surface 121 of the additive storage container 120, so that the seal effect expected when the seal piece 127 is inserted and closed can be enhanced.

Figure 11A:
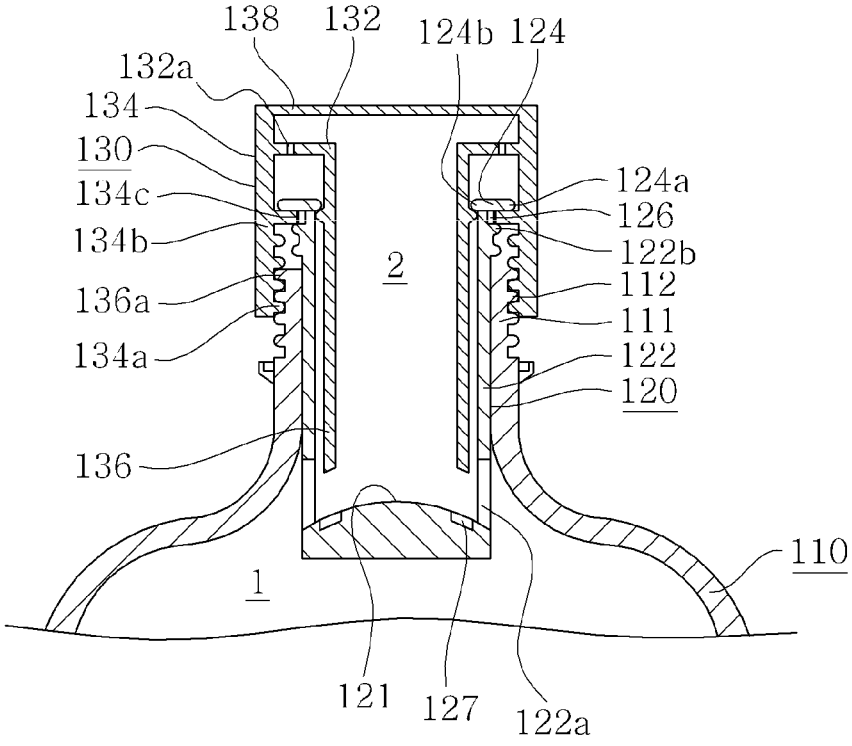
FIGS. 11A and 11B are sectional views showing the operation of the 6$^{th}$ embodiment of the present invention.
Figure 11B:
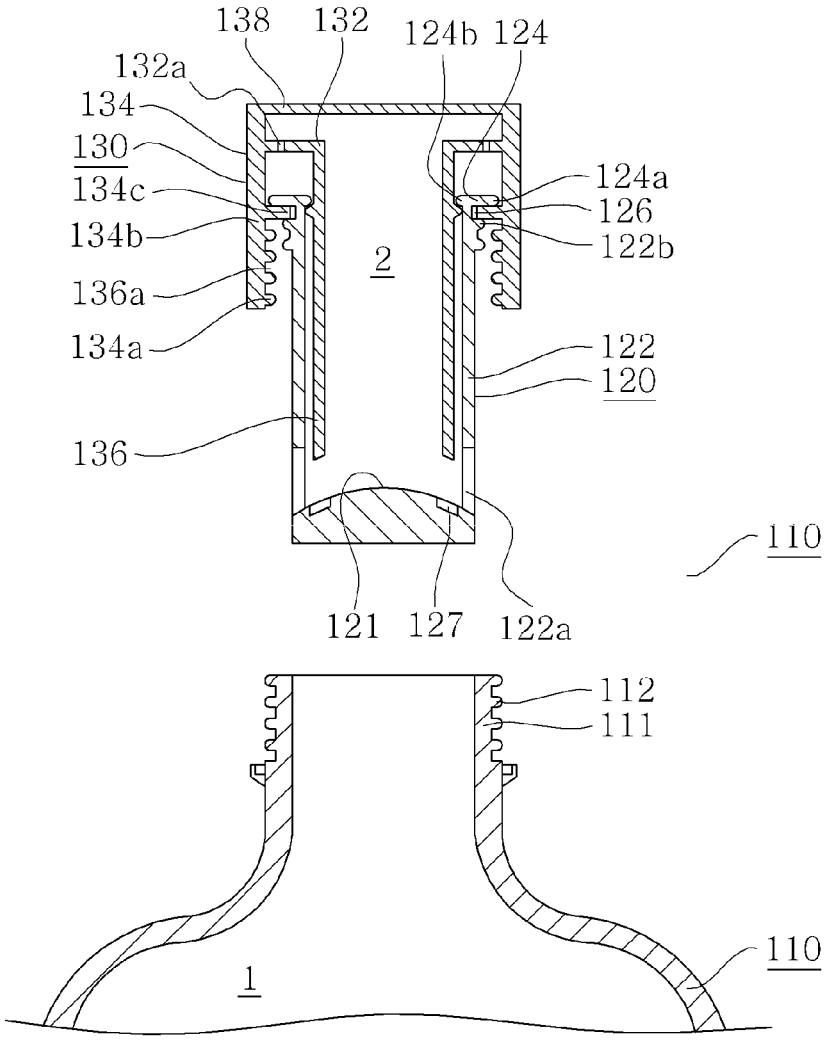

FIG. 11A and FIG. 11B show the operation of the $6^{th}$ embodiment of the present invention. The bottle according to this embodiment will be operated as follows. If a user rotates the opening unit 130 in an opening direction (counterclockwise) under a closed condition which is the initial condition as shown in FIG. 8, the internal thread 134*a* and the outside hooking protrusion 134*b* of the main cap 134 spirally move along the external thread 112 of the mouth 111 and the external thread 122*b* of the additive storage part 122, respectively. At this moment, the inside hooking protrusion 136*a* moves along the inner surface of the additive storage part 122 while rubbing and sliding. Once the opening unit 130 starts to rise up, the lower part of the slider 136 is separated from the lower surface 121 of the additive storage part 122 and the discharge ports 122*a* open, so that the additive of the container 120 is input into the space 1 of the bottle body 110. In addition, as soon as the opening unit 130 starts to rise up, the end plate 132 is separated from the flange 124 and the communication hole 132*a* opens. Thus, atmospheric air acts in the additive storage space 2, so that the additive can be easily released.

If such a rising-up action of the opening unit 130 continues, the outside hooking protrusion 134*b* comes into contact with the outer protrusion 124*a* as shown in FIG. 11A. At the same time, the inside hooking protrusion 136*a* also comes into contact with the inner protrusion 124*b*. In this situation, the bottle body 110 maintains a good seal. In other words, a plurality of seal protrusions 122*c* is provided on the outer circumferential surface of the additive storage part 122. The space is, therefore, sealed between the mouth 111 and additive storage part 122. In addition, the inside hooking protrusion 136*a* is brought into close contact with the inside wall of the additive storage part 122, so that a good seal is achieved. Even if a user mixes the material and the additive by inverting the bottle body 110 or shaking it up and down with the material and the additive already loaded, the mixture does not leak from the bottle.

Under the conditions as shown in FIG. 11A, the outer ratchet 134*c* provided on the end of the outside hooking protrusion 134*b* interferes with the inner ratchet 126 of the additive storage part 122, so that rotation of the opening unit 130 relative to the additive storage container 120 is restricted. Therefore, the rotation of the opening unit 130 also makes the additive storage container 120 rotate. In this state, if the user rotates the opening unit 130 further in the same direction, the internal thread 134*a* of the main cap 134 will be separated from the external thread 112 of the mouth 111. If the user pulls out the opening unit 130 in an axial direction while rotating it, the additive storage container 120 will rotate with the opening unit 130 and will then be removed from the mouth 111 of the bottle body 110 as shown in FIG. 11B.

Figure 12:
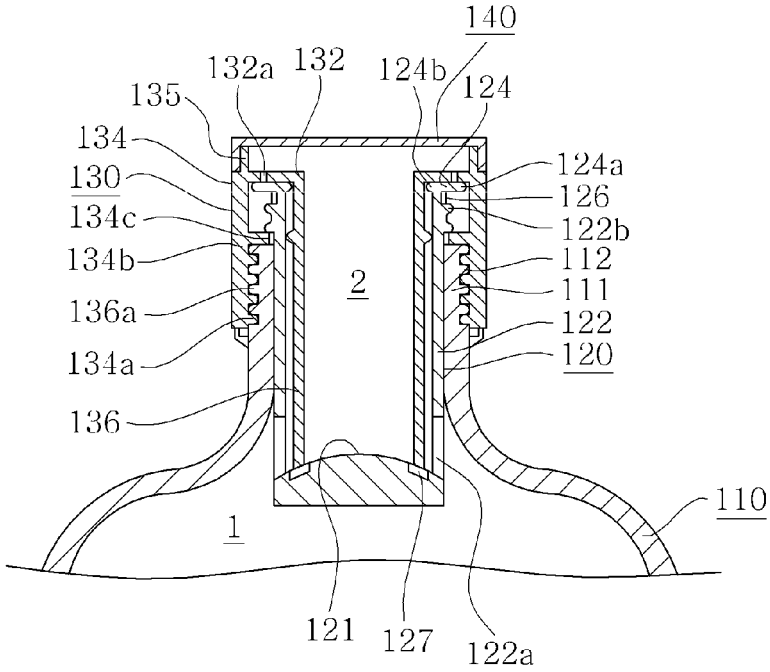
FIG. 12 is a sectional view showing the assembled construction of the 7$^{th}$ embodiment of the present invention.

FIG. 12 shows the construction of the $7^{th}$ embodiment of the present invention. For the elements the same as or similar to those of the $6^{th}$ embodiment, the same reference numerals used in the $6^{th}$ embodiment will be used and further explanation is deemed unnecessary. In this embodiment, the finish plate is configured as a separate member unlike the $6^{th}$ embodiment.

The outer circumferential surface of the end plate 132 is provided with an extension part 135 in an axial direction. Furthermore, an upper cap 140 is provided to selectively engage with the extension part 135.

In the $7^{th}$ embodiment of the present invention, the bottle does not contain any additive when it is supplied, so that a user can input a desired additive into the additive storage space 2 after opening the upper cap 140 as necessary. That is, it is possible to input a desired additive into the storage space 2. In addition, even in the case in which the bottle is sold with an additive contained therein, the user can use the bottle after having used it with the original additive.

Figure 13:
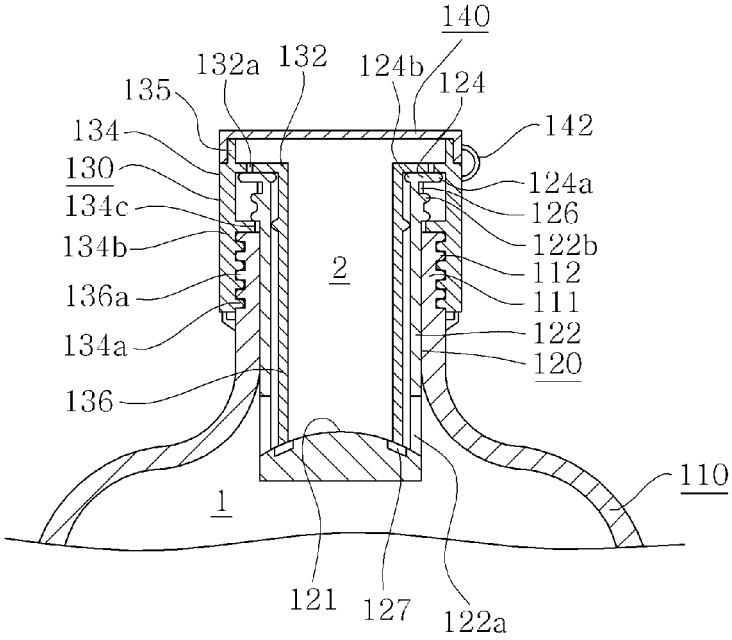
FIG. 13 is a sectional view showing the assembled construction of the 8$^{th}$ embodiment of the present invention.

FIG. 13 shows the $8^{th}$ embodiment of the present invention. In this embodiment, the upper cap 140 is integrally formed in the opening unit 130.

The upper cap 140 is integrated with the main cap 134 of the opening unit 130 by means of a connection rib 142. The upper cap 140 is produced by molding together with the opening unit 130. In the $8^{th}$ embodiment of the present invention, the upper cap 140 is always coupled to the opening unit 130 even when the upper cap 140 is opened, so that a user can easily manage the upper cap 140 without worrying about the loss of the upper cap 140.

Figure 14:
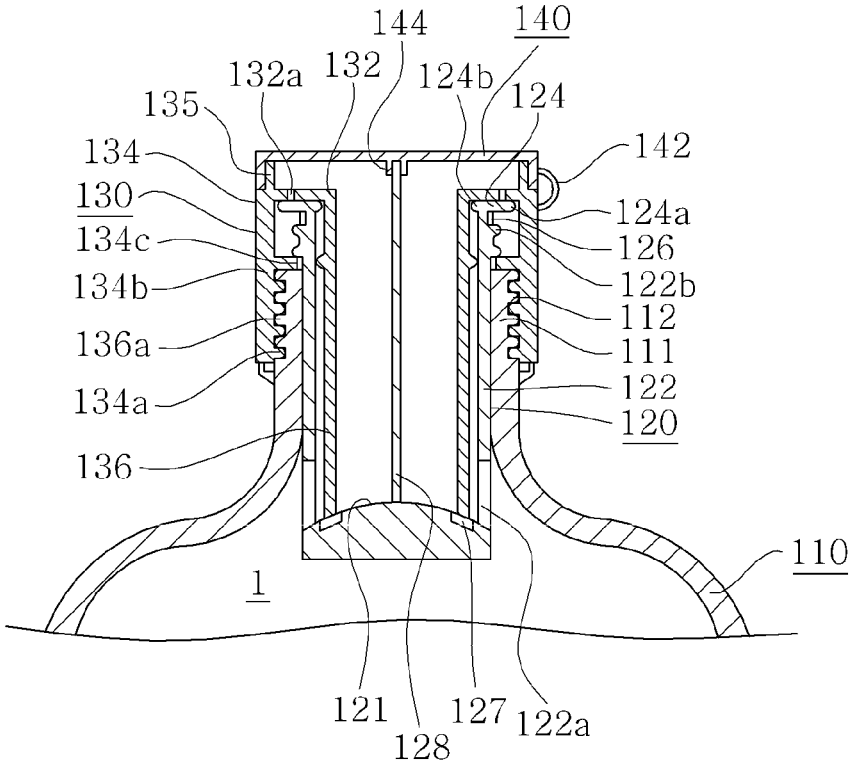
FIG. 14 is a sectional view showing the assembled construction of the 9$^{th}$ embodiment of the present invention.

FIG. 14 shows the construction of the $9^{th}$ embodiment of the bottle of the present invention. As shown in the drawing, the bottle of this invention is configured such that the additive storage part 122 is partitioned into two parts so that two kinds of additives can be input into the bottle simultaneously.

Figure 15:
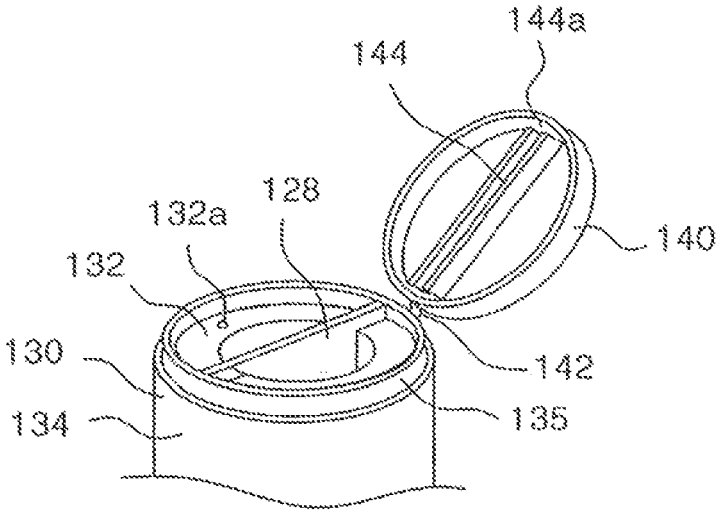
FIG. 15 is a perspective view showing an opened state of an upper cap of the 9$^{th}$ embodiment of the present invention.

The additive storage part 122 is provided with a partition wall 128 that crosses the lower surface 121 in an axial direction extending upward so that the interior of the additive storage part 122 can be partitioned into two parts. In addition, the upper cap is provided with an insertion groove 144 into which the upper end of the partition wall 128 is inserted. FIG. 15 illustrates that the insertion groove 144 is formed between two protrusions provided on the lower surface of the upper cap 140. A predetermined gap 144*a* is made on both ends of the insertion groove, thus avoiding any interference with the extension part 135.

In the $9^{th}$ embodiment, the interior of the additive storage part 122 is partitioned into two parts by the partition wall, so that a user can input two kinds of additives into the bottle body. If the material contained in the bottle body is, for example, coffee, the user can store sugar and cream separately in the two partitioned storage spaces of the additive storage part 122 and mix them with the coffee prior to drinking. Thus, the freshness and hygiene of the product is enhanced.

Figure 16:
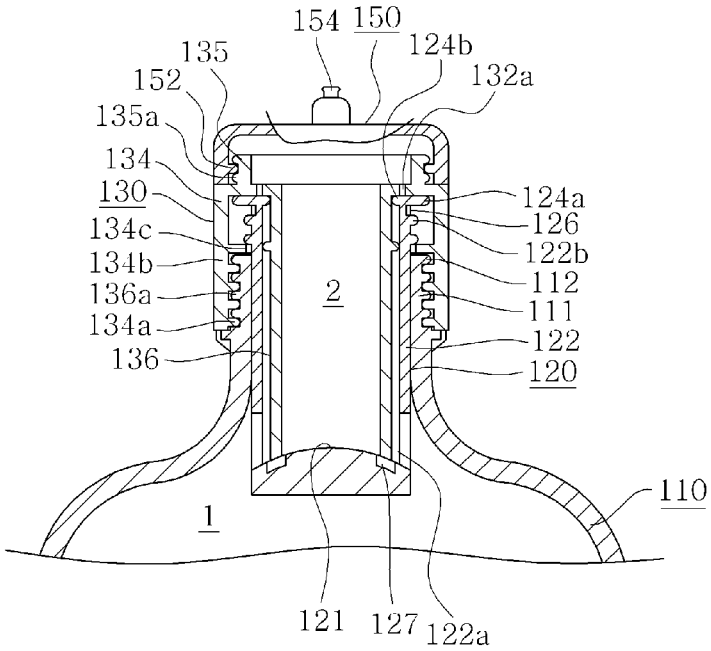
FIG. 16 is a sectional view showing the assembled construction of the 10$^{th}$ embodiment of the present invention.

FIG. 16 shows the construction of the $10^{th}$ embodiment of the present invention. This embodiment is designed such that an extension part is provided in the bottle and a sports cap is used with the bottle. The extension part 135 is provided with an external thread 135*a*, the pitch and pitch circle diameter of which are the same as those of the external thread of the mouth. The bottle is provided with a sports cap 150 that has an internal thread 152 engaging with the external thread 135*a* through a screw-type engagement. The sports cap 150 can be closed or opened by pressing or pulling out an operational button 154 provided on the upper part of the cap 150 (the construction of the operational button 154 is well-known to those skilled in the art, and thus further explanation is deemed unnecessary). Because the pitch of the external thread 135*a* is the same as that of the external thread 112 of the mouth, it is possible to use the bottle by tightening only the sports cap 150 onto the mouth 111 of the bottle body after both the opening unit 130 and the additive storage container 120 have been removed from the mouth 111. In other words, the user can drink a mixture using the sports cap 150 that is tightened to the mouth of the bottle body.

The technical spirit of the $10^{th}$ embodiment of the present invention can be applied to the upper cap 140 described in the $7^{th}$ embodiment or the $9^{th}$ embodiment. That is, an internal thread is formed on the upper cap 140 so that the upper cap 140 can be used in a state of being tightened to the mouth of the bottle body after the mouth has been opened.

Figure 17:
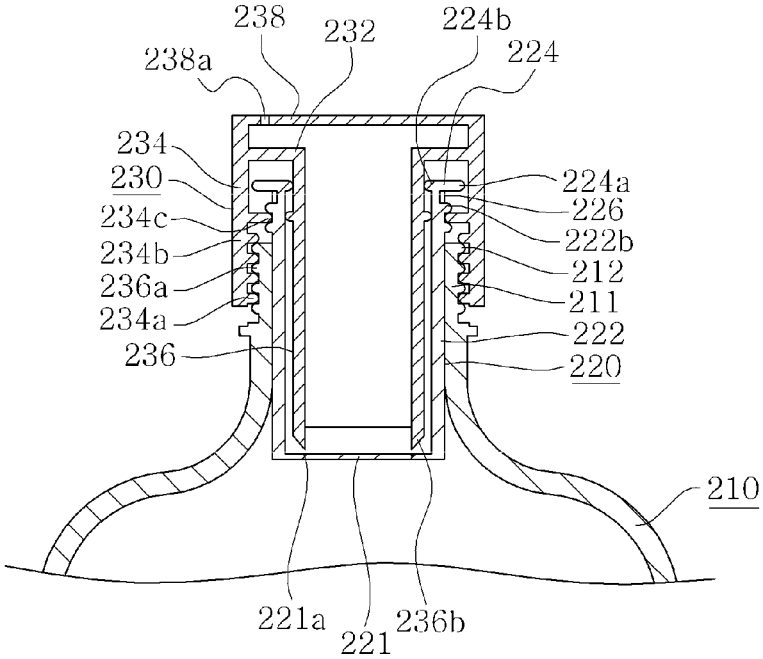
FIG. 17 is a sectional view showing the assembled construction of the 11$^{th}$ embodiment of the present invention.

FIG. 17 shows the construction of the $11^{th}$ embodiment of the present invention.

This embodiment comprises a bottle body 210 having a mouth 211 provided with an external thread 212 around the outer circumferential surface thereof, an additive storage container 220 inserted into the mouth 211 so that the container 220 can be removed from the mouth 211, and an opening unit 230 tightened to the external thread 212 of the mouth 211 through a screw-type engagement. The opening unit 230 releases an additive into the bottle body when the screw-type engagement part is tightened. The opening unit 230 removes the additive storage container 220 from the mouth 211 through its interference with the additive storage container 220 if the screw-type engagement part is released to a predetermined distance.

The additive storage container 220 comprises a cylindrical additive storage part 210 which is opened at the upper end thereof and is sealed at the lower end thereof, and a bursting part 221 that is selectively cut along a tear-off line at the lower end of the additive storage part 210.

The opening unit 230 comprises an end plate 232 that comes into contact with the open end of the additive storage part 122 which is the flange 224 with a predetermined interval, an internally threaded main cap 234 that extends downward in an axial direction from the outer circumferential edge of the end plate 232 and is tightened to the mouth 211 through a screw-type engagement, and a slider 236 that extends downward in an axial direction from the inner circumferential edge of the end plate 232, is movably inserted into the additive storage part 222, and has a blade part 236*b* at the lower part thereof. The blade parts 236*b* are formed at two diametrically opposite positions so that they face each other. The end plate 232 of the opening unit 230 is also provided with a finish plate 238 that closes the open upper end of the slider 236.

The distance L between the opening unit 230 and the flange 224 is preferably set to be long enough to rotate at an angle of 150~170 degrees further if the opening unit 230 enters deeper. That is, the opening unit 230 is designed to be completely combined to the containing piece 220 and restrict further entrance if the opening unit 230 rotates maximally to ½ rotation.

The open end of the additive storage part 210 is provided with a flange 224 that has an outside protrusion 224*a* and extends externally in a radial direction from the additive storage part 210. The outer circumferential surface of the additive storage part 210 is provided with an external thread 222*b*, the pitch of which is the same as that of the external thread 212 of the mouth 211 away from the flange 224 to a predetermined distance. Most of the inside of the main cap 234 is combined to the external thread 222*b* of the additive storage part 222 in the internally threaded path through a screw-type engagement. The outside hooking protrusion 234*b* that interferes with the outside protrusion 224*a* at a predetermined position projects internally in a radial direction.

In addition, the flange 224 is provided with an inside protrusion 224*b* that extends internally in a radial direction. An inside hooking protrusion 236*a*, engaging with the inside protrusion 224*b*, projects externally in a radial direction at the position where the outside protrusion 234*b* comes into contact with the outer circumferential surface of the slider 236.

Figure 18:
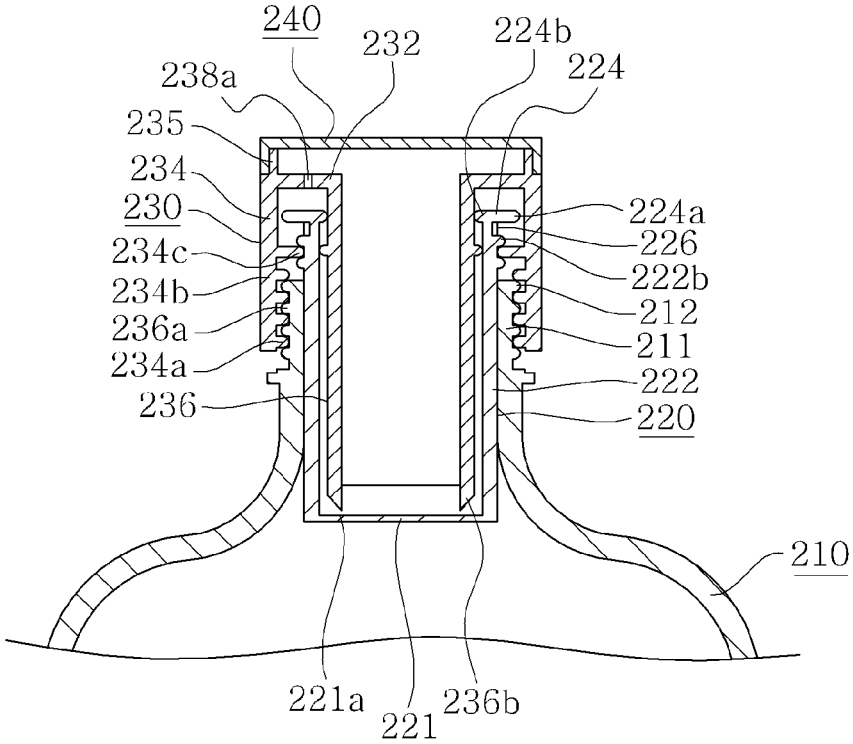
FIG. 18 is a plan view showing the key parts of the structure of the ratchets used for restriction of rotation of the opening unit and additive storage container of the 11$^{th}$ embodiment of the present invention.

As shown in FIG. 18, the additive storage part 222 has an inner ratchet 226 on the circumference close to the flange 222. The end of the outside hooking protrusion 234*b* is provided with an external ratchet 234*c* that allows the internal ratchet 226 to rotate only in one direction.

The finish plate 238 is provided with at least one communication hole 238*a* that is closed by a piece of sticker or tape and is opened as necessary.

The lower part of the additive storage container 220, which is the bursting part 221, is made of the same material as that of the additive storage part. The bursting part 221 must be designed to be relatively thin so that it can be easily torn off by the blade part 236*b* of the slider 236.

Figure 19A:
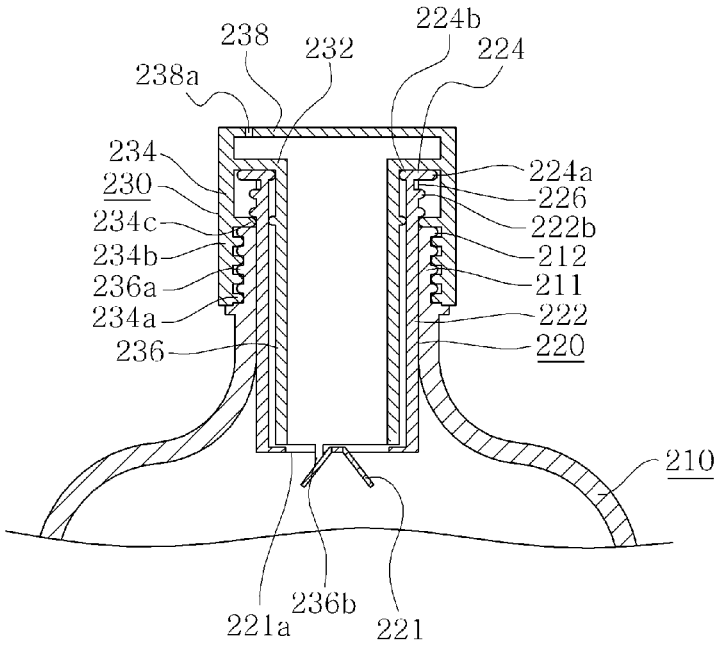
FIGS. 19A through 19C are sectional views showing the operation of the 11$^{th}$ embodiment of the present invention.
Figure 19B:
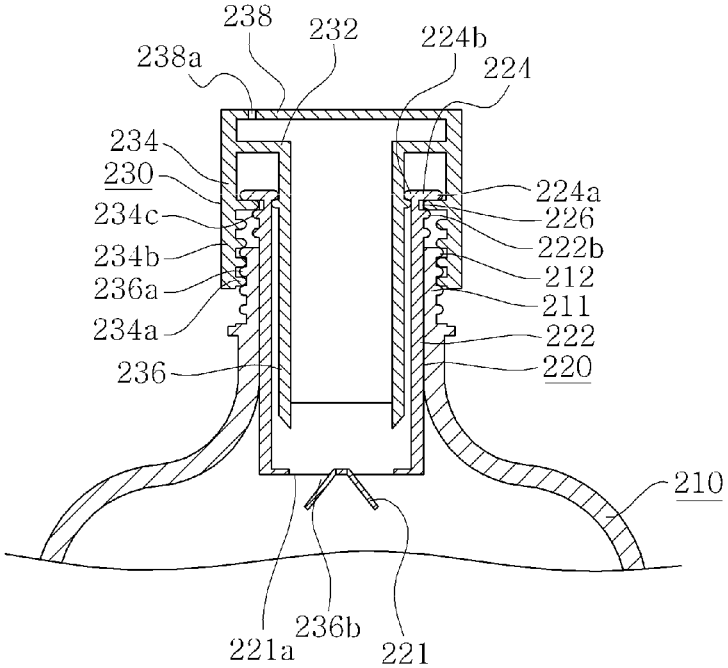
Figure 19C:
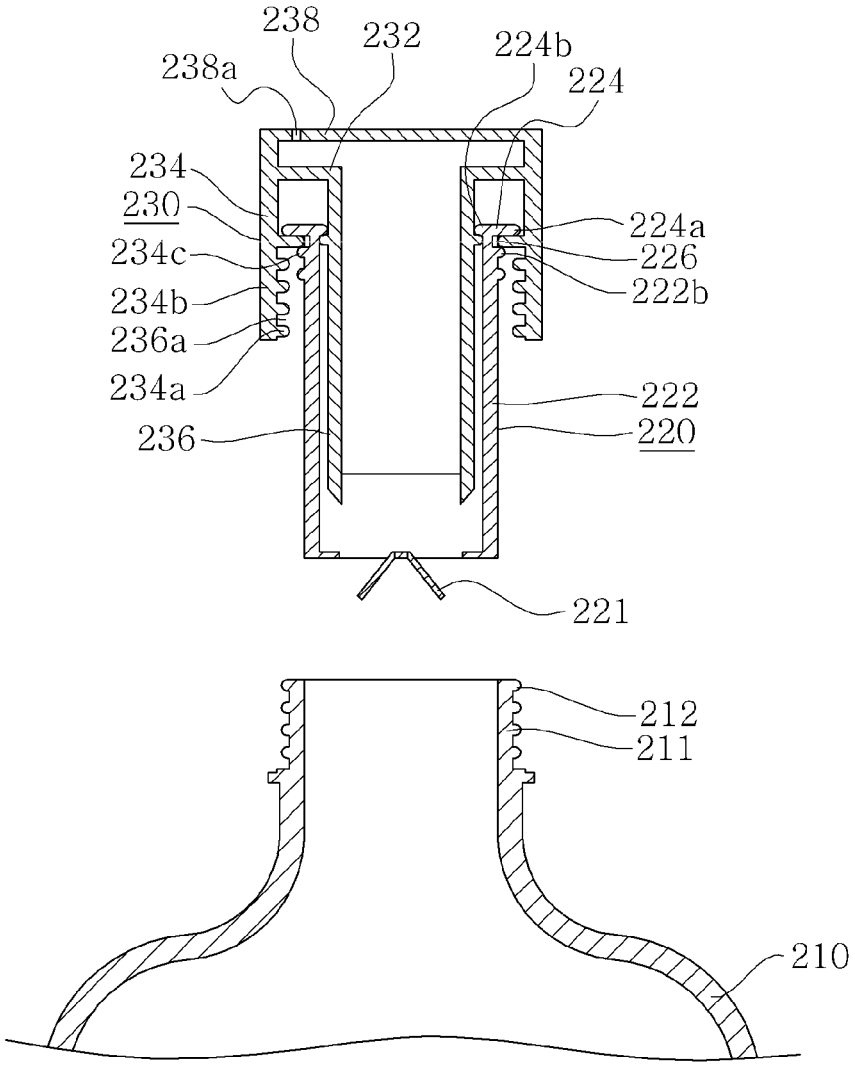

FIG. 19A and FIG. 19C show the operation of the $11^{th}$ embodiment of the bottle cap of the present invention. As shown in the drawings, the finish plate 232 is kept at a position spaced apart from the flange 224 by a predetermined distance at an initial stage which is the same as that shown in FIG. 17. In this state, the additive storage space is effectively sealed by the sealing function of the inside hooking protrusion 236*a* engaging with the inside protrusion 224*b*, so that the additive contained in the additive storage space does not leak.

In this state, if a user rotates the opening unit 230 in a tightening direction, that is, clockwise, in order to mix the additive with the material, the opening unit 230 is lowered while rotating along the external thread 224*b* of the additive storage part 222 and the external thread 212 of the mouth 211. At this moment, the opening unit 230 is allowed to rotate as much as the rotation angle corresponding to the distance between the finish plate 232 and the flange 224. Such rotation angle will be 150~170 degrees at this moment. At the same time, the blade part 236*b* on the lower part of the slider 236 tears off the bursting part 221 while moving along the tear-off line 221*a*, so that the additive is discharged into the material storage space 1 and mixed with the material. According to the present invention, the opening unit 230 rotates at an angle of about 150~170 degrees when the opening work starts at the initial stage which is the initial entrance, so that the bursting part 221 is partially attached to the additive storage part 222 and does not become completely separated from the additive storage part 222.

The opening action to open the additive storage space is done under the condition that the sticker or tape closing the communication hole 238*a* is removed, so that the additive can be easily released because atmospheric air enters the additive storage space.

In the present invention, the rotation angle of the opening unit 230 may be set to 330~360 degrees. In this state, the blade part should be made at one point so that the bursting part 221 can be completely removed from the bottle body 210, without entering into the bottle body 210.

Following is the explanation of how to detach the bottle cap from the mouth of a bottle body. If a user rotates the opening unit 230 counterclockwise when the additive and the material are completely mixed, under the condition illustrated in FIG. 19A, the internal thread 234*a* and the outside hooking protrusion 234*b* of the main cap 234 move spirally along the external thread 212 of the mouth 211 and the external thread 222*b* of the additive storage part 222 respectively, thus moving in an axial direction. At this moment, the inside hooking protrusion 236*a* moves along the inner surface of the additive storage part 222 while rubbing and sliding. If the rising action continues, the outside hooking protrusion 234*b* comes into contact with the outside protrusion 224*a* as shown in FIG. 18B. At the same time, the inside hooking protrusion 236*a* also contacts the inner protrusion 224*b*.

On the other hand, the outside ratchet 234*c* formed on the end of the outside hooking protrusion 234*b* interacts with the inside ratchet 226 of the additive storage part 222 under the conditions shown in FIG. 19B, so that relative rotation between the opening unit 230 and the additive storage container 220 is restricted. Therefore, from the state shown in FIG. 19B, the opening unit 230 rotates with the additive storage container 220 rotating. If the user further rotates the opening unit 230 in this state in the same direction, the internal thread 234*a* of the main cap 234 is released from the external thread 212 of the mouth 211. If the user rotates the opening unit 230 further in the same direction and, at the same time, pulls it out in an axial direction, the additive storage container 220 is removed from the mouth 211 of the bottle body while being rotated along with the opening unit 230 as shown in FIG. 19C.

Figure 20:
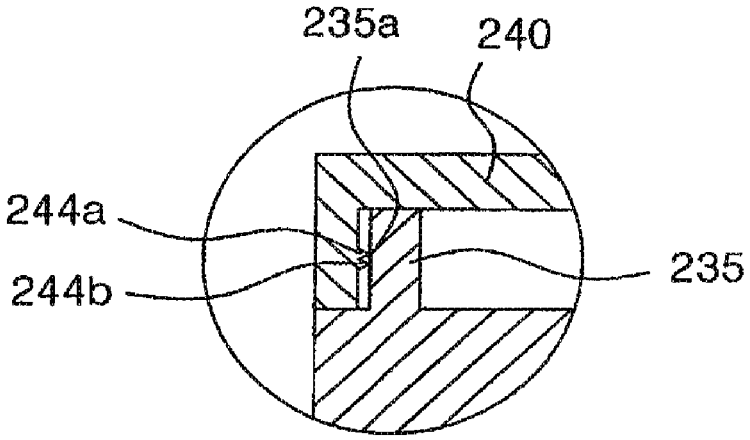
FIG. 20 is a sectional view showing the assembled construction of the 12$^{th}$ embodiment of the present invention.

FIG. 20 shows the construction of the $12^{th}$ embodiment of the bottle cap of the present invention. In this embodiment, the same reference numerals will be used for the same elements as used in the $11^{th}$ embodiment without detailed description. This embodiment illustrates the structure enabling the finish plate to be separated from the opening unit.

The extension part 235 extends downward from the outer circumferential edge of the finish plate 232 in an axial direction. An upper cap 240 is provided to selectively engage with the extension part 235.

As shown in FIG. 20, the upper cap 240 is provided on its inner surface with two seal protrusions 244*a* and 244*b* which are spaced apart from each other by a predetermined interval, and the extension part 235 is provided with a seal ring 235*a* that is inserted into the gap between the seal protrusions 244*a* and 244*b*.

The $12^{th}$ embodiment of the present invention is about a bottle that does not contain any additive when it is marketed and a user can load a desired quantity of an additive into the bottle cap by opening the upper cap 240 as necessary. In addition, even in the case in which this bottle is sold with an additive loaded in the bottle cap, this bottle can be used again after the additive has been used.

The upper cap is preferably formed on the opening unit of the present invention as shown in FIG. 9. That is, the upper cap is provided on the main cap of the opening unit and coupled to the main cap by a connection rib. Thus, the upper cap can be produced together with the opening unit through injection molding.

In the 12$^{th}$ embodiment of the present invention, the upper cap 240 is always coupled to the opening unit 230 even when it is opened, so that it can be easily managed without worry about loss.

Figure 21:
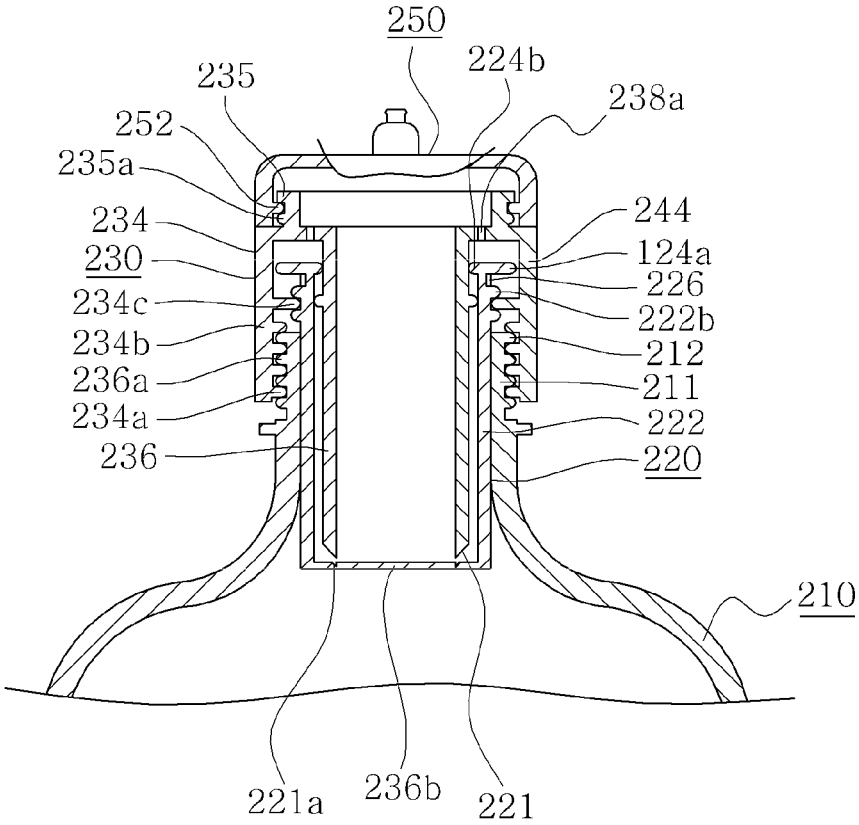
FIG. 21 is a sectional view showing the assembled construction of the 13$^{th}$ embodiment of the present invention.

FIG. 21 shows the construction of the 13$^{th}$ embodiment of the bottle cap according to the present invention. This embodiment has a structure in which a sports cap is provided on the bottle cap by using an extension part. The extension part 235 is provided with an external thread 235*b*, the pitch and pitch circle diameter of which are the same as those of the external thread of the mouth. The bottle cap is also provided with a sports cap 250 that has an internal thread 252 engaging with the external thread 235*b* through a screw-type engagement. The sports cap 250 can be closed or opened by pressing or pulling out the operation button 254 provided on the upper part of the sports cap 250. It is possible to use the bottle by combining the sports cap 250 to the mouth 211 of the bottle body after removing both the opening unit 230 and the additive storage container 220 from the mouth 211. In other words, a user can drink a mixture with the sports cap 250 tightened to the mouth 211 of the bottle body.

The 8$^{th}$, 9$^{th}$, 10$^{th}$, 12$^{th}$ and 13$^{th}$ embodiments of the present invention are configured such that a user can open the sports cap or the upper cap so as to open the main cap with the additive storage space empty, so the bottle of the present invention is particularly effective for those who want to drink bottled materials only.

Figure 22:
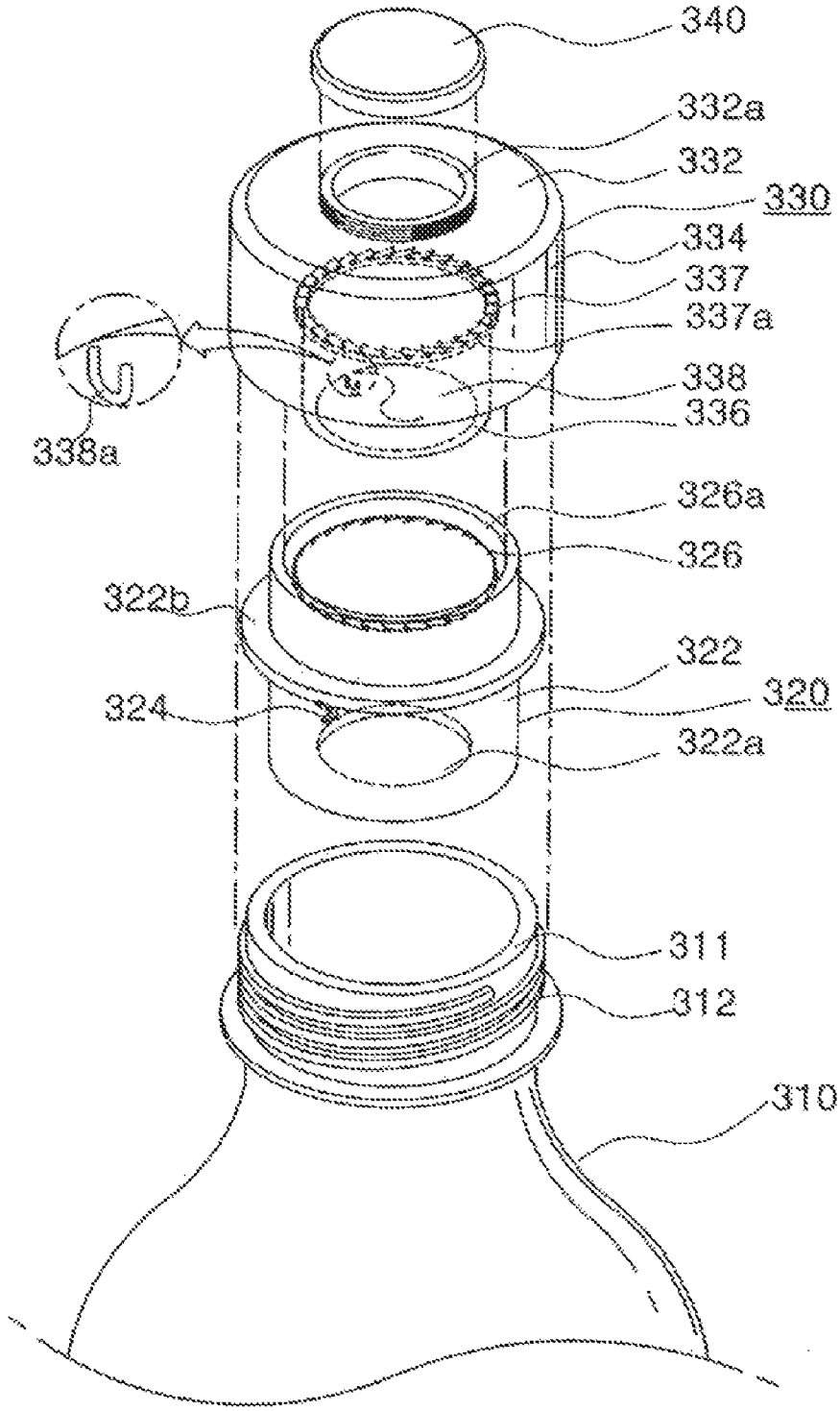
FIG. 22A is an exploded perspective view showing the construction of the 14$^{th}$ embodiment of the present invention.
FIG. 22B is an enlarged view showing Area B of FIG. 22A.
Figure 22A:
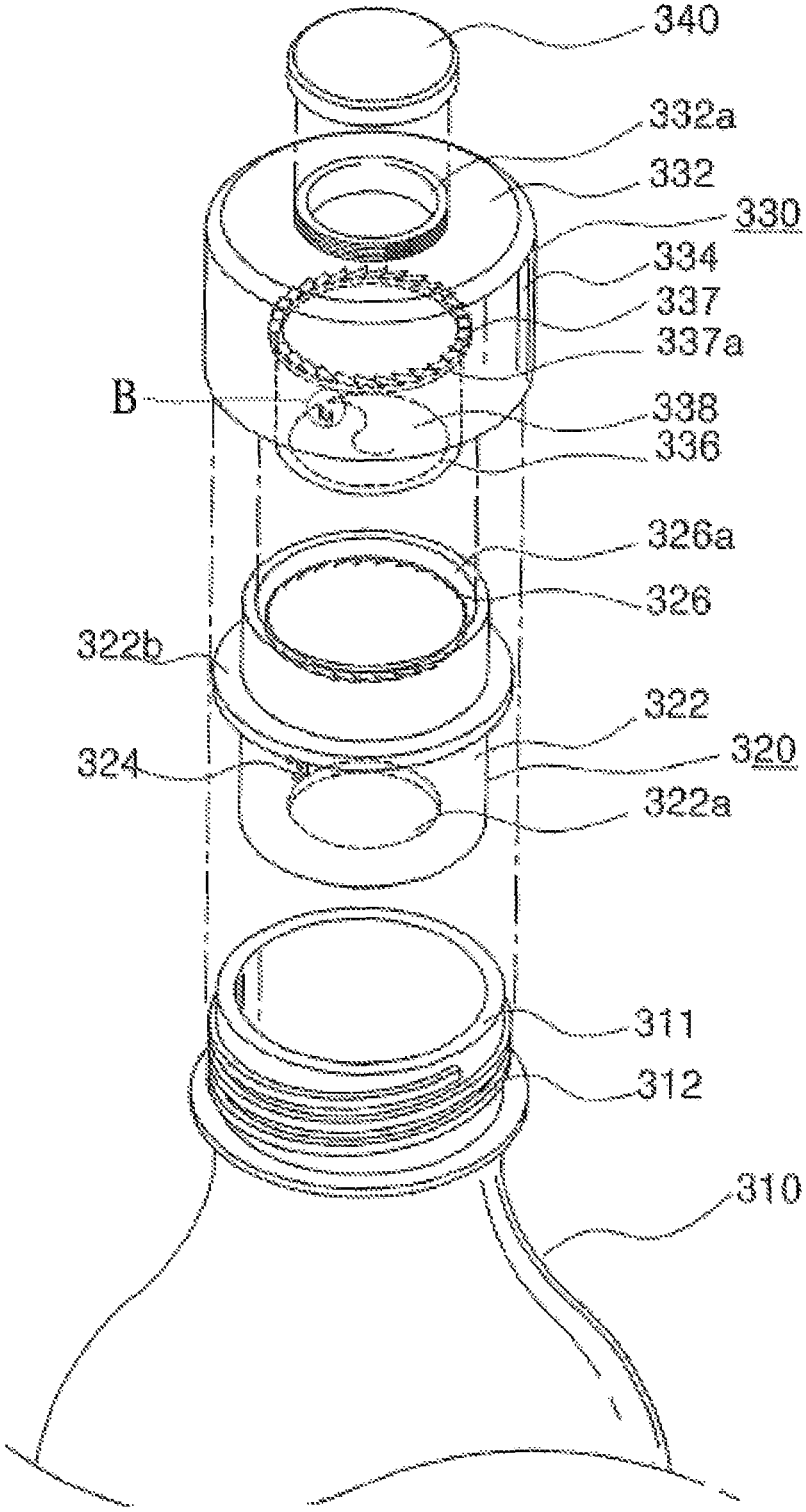
Figure 22B:
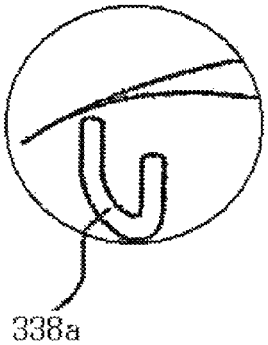
Figure 40B:
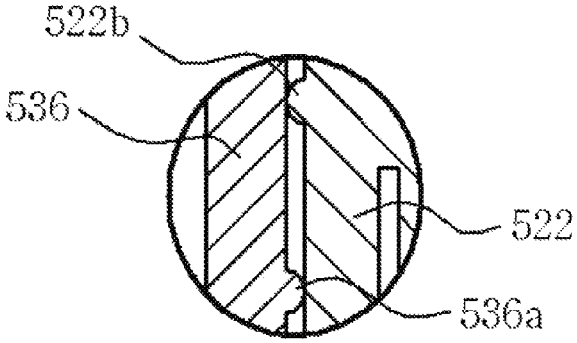
FIG. 40B is an enlarged view showing Area C of FIG. 40A.
Figure 40C:
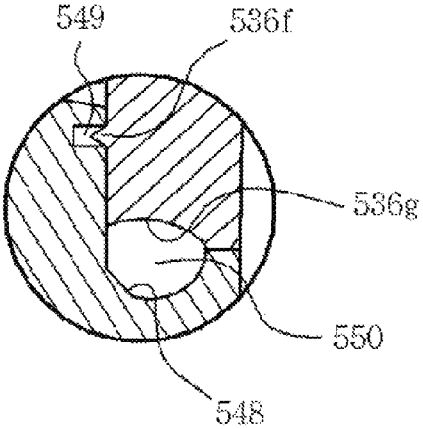
FIG. 40C is an enlarged view showing Area D of FIG. 40A.
Figure 43B:
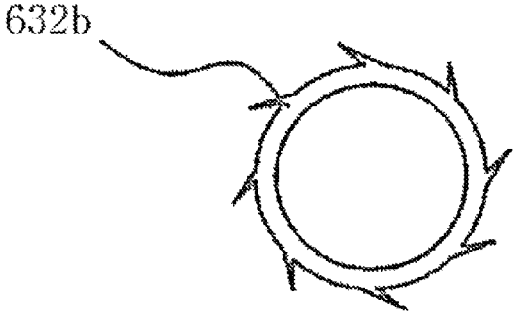
FIG. 43B is a top view of the upper ratchet plate of FIG. 43A.
Figure 23:
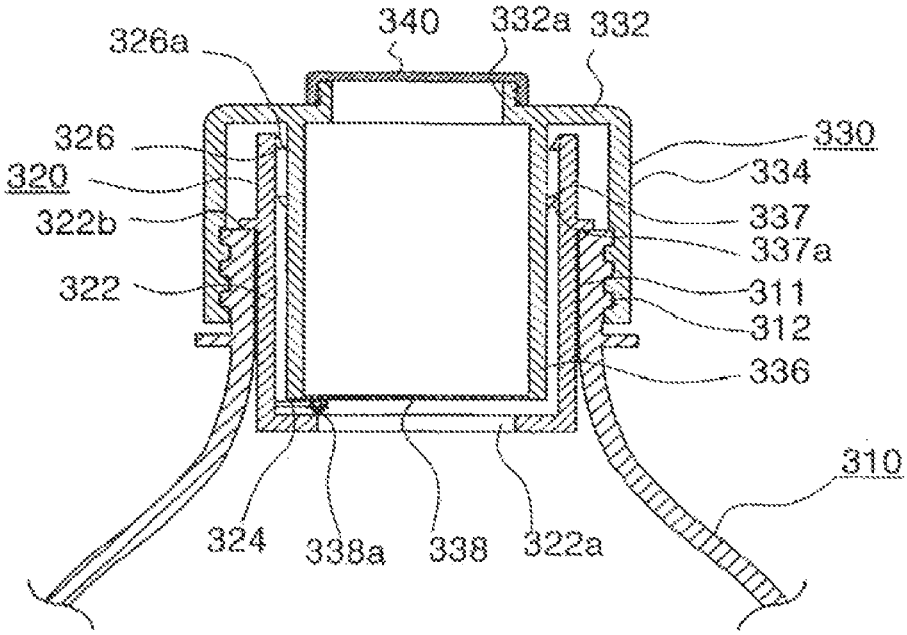
FIG. 23 is a sectional view showing the assembled construction of the 14$^{th}$ embodiment of the present invention.

FIGS. 22A and B show an exploded perspective view of the 14$^{th}$ embodiment of the present invention. FIG. 23 is a sectional view of the 14$^{th}$ embodiment. The drawings show how to discharge an additive from the additive storage container the bottle body through a thin bursting part.

According to this embodiment, the present invention comprises a bottle body 310 having a mouth 311 with an external thread 312 formed around the outer circumferential surface of the mouth 311, an additive storage container 320 inserted into the mouth 311 such that the container 320 can be removed from the mouth 311, and an opening unit 330 that is tightened to the external thread 312 of the mouth 311 through a screw-type engagement. The opening unit 330 is operated to discharge the additive from the container 320 into the bottle body 310 when the unit 330 is rotated. During the rotation, the opening unit 330 also interferes with the additive storage container 320 through a ratchet interaction at a predetermined position, so that the unit 330 can remove the additive storage container 320 from the mouth 311 of the bottle body 310.

The additive storage container 320 is a cylindrical type body which is opened at the upper end thereof and has a discharge port 322*a* at the lower end thereof. A hook 324 is integrally provided at an edge of the discharge port 322*a*.

The opening unit 330 comprises a circular end plate 332 placed above the open upper end of the additive storage part 210. A main cap 334 extends downward from the outer circumferential edge of the end plate 332 to a predetermined length in an axial direction, with an internal thread 334*a* formed on the inner circumferential surface of the sidewall of the main cap 334, thus engaging with the external thread 312 of the mouth 311. The opening unit 330 also has a slider 336 which extends downward from the inner circumferential edge of the end plate 332 to a predetermined length and is movably inserted into an additive storage part 322 of the container 320 in an axial direction.

The bursting part 338 is provided on the lower end of the slider 336 so that the lower end of the slider 336 is sealed. The lower surface of the bursting part 338 is integrally provided with a tearing pin 338*a* which is operated in conjunction with the hook 324. The bursting part 338 is made of a material which can be easily cut by an external force. In the present invention, it is preferable to produce the bursting part 338 using a thin synthetic resin which is the same material as that of the additive storage container 330. In addition, it is desirable to form a very thin tear-off line (not shown) on the bursting part 338 for easy tearing. The bursting part 338 is preferably made of a thin aluminum plate. More preferably, the bursting part 338 is designed so that the part 338 can easily burst but not remain separated after burst.

A ring-shaped fixed ratchet 326 is formed on the inner circumferential surface of the upper open end of the additive storage container 320. The outer circumferential surface of the slider 336 is integrally provided with a movable ratchet 337 that engages with the fixed ratchet 326 at a predetermined position when the opening unit 330 is loosened from the mouth 311.

The fixed and movable ratchets 326 and 337 are designed to be in surface contact with each other in an axial direction. The ratchets 326 and 337 are also designed to interfere with each other and limit rotation thereof when the opening part 330 is rotated to be loosened from the mouth 311. In addition, a slope is made on the rear surfaces of the fixed ratchet 326 and the movable ratchet 337 respectively, so that the slider 336 can be easily inserted into the additive storage container 320.

The reference numeral 322*b* in the drawings denotes a stop ring which limits the position of the additive storage container 320 relative to the mouth 311. The reference numeral 332*a* denotes a gateway; and the numeral 340 denotes an upper cap used to open or close the gateway 332*a*.

The operation of the above-mentioned embodiment will be described herein below. FIG. 23 shows an initial state of the present invention. In this state, the opening unit 330 is completely tightened to the mouth 311. The fixed ratchet 326 and the movable ratchet 337 remain separated from each other in an axial direction, while the tearing pin 338*a* is in contact with the hook 324. The fixed and movable ratchets 326 and 337 have slopes 326*a* and 337*a* so that the upper open end of the additive storage container 320 can be elastically deformed externally in a radial direction for assembling when the slider 336 initially enters the additive storage part 210.

Figure 24A:
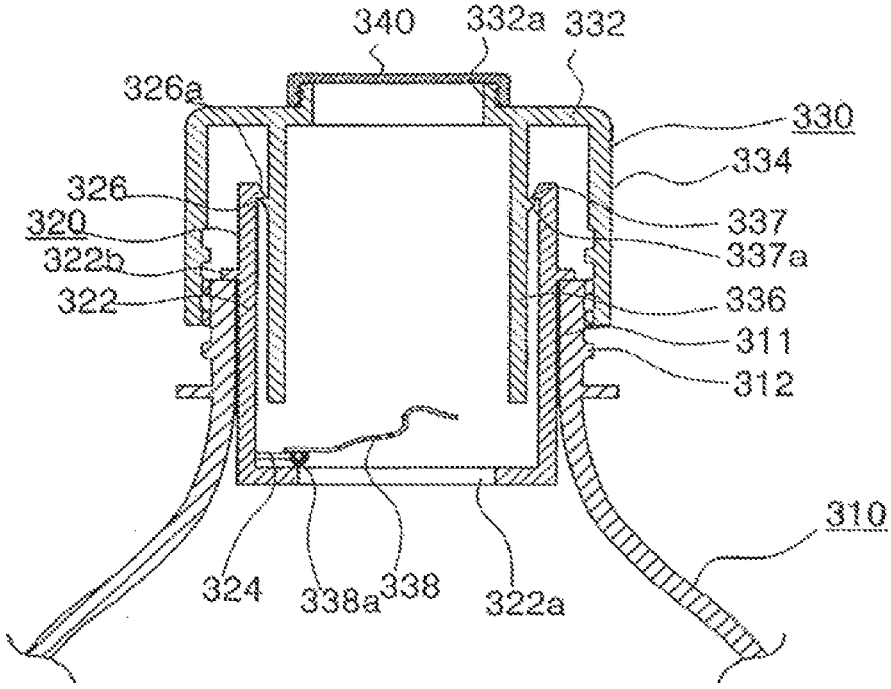
FIGS. 24A and 24B are sectional views showing the operation of the 14$^{th}$ embodiment of the present invention.

In this state, if a user rotates the opening unit 330 counterclockwise, the bursting part 338 tears off and the additive is discharged into the bottle body 310 through the discharge port 322*a* because the tearing pin 338*a* is caught by the hook 324 as shown in FIG. 24A. If the opening unit 330 continues to rotate and rise up, the movable ratchet 337 comes into engagement with the fixed ratchet 326. From this state, the rotation of the opening unit 330 induces rotation of the additive storage container 320, so that the additive storage container 320 is moved upward in the axial direction. Described in detail, the fixed ratchet 326 and the movable ratchet 337 are prevented from rotating relative to each other, and the opening unit 330 tends to move in the axial direction, so that slippage occurs between the inner surface of the mouth 311 and the additive storage container 320. Thus, the container 320 starts moving.

Figure 24B:
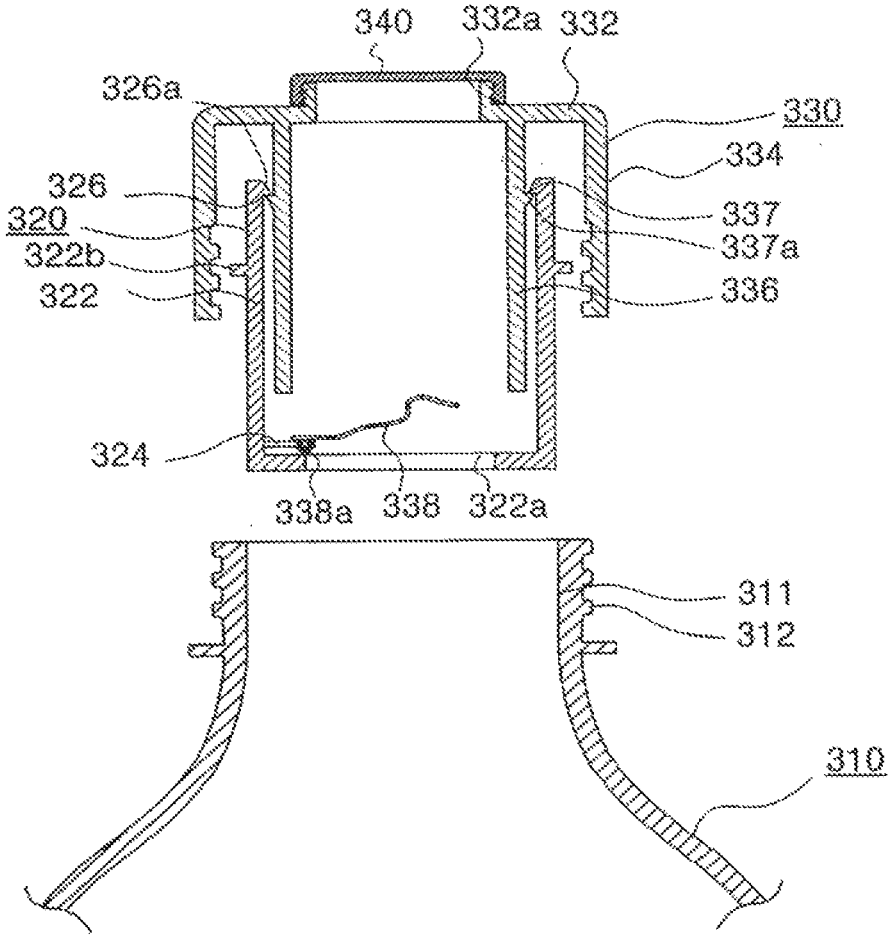

After the opening unit 330 is completely loosened from the mouth 311, the opening unit 320 is pulled in an axial direction. Thus, the additive storage container 320 is completely removed from the mouth 311 as shown in FIG. 24B.

Figure 25:
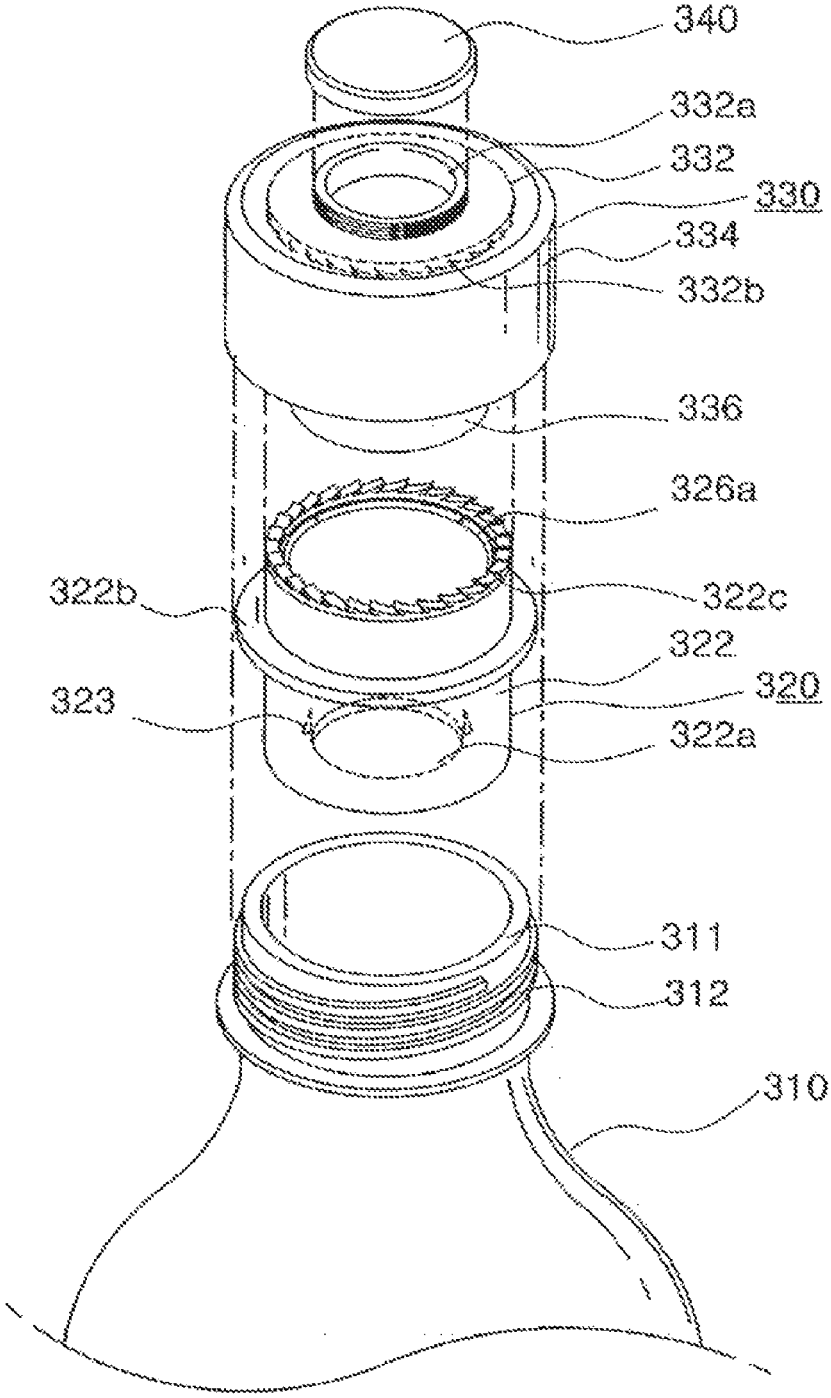
FIG. 25 is an exploded perspective view showing the construction of the 15$^{th}$ embodiment of the present invention.
Figure 26:
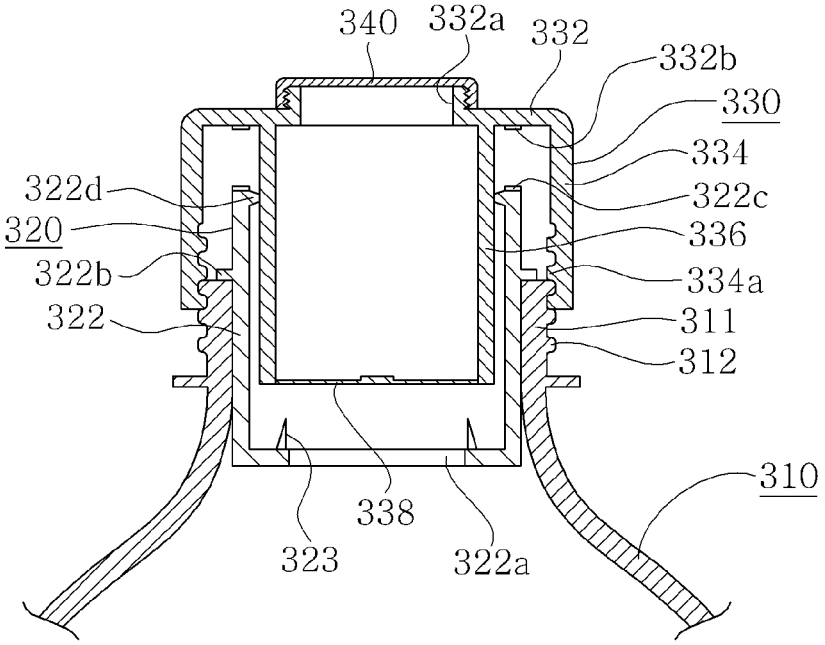
FIG. 26 is a sectional view showing the assembled construction of the 15$^{th}$ embodiment of the present invention.

FIGS. 25 and 26 show the 15$^{th}$ embodiment of the present invention. In this embodiment, the same elements as those of the 14$^{th}$ embodiment carry the same reference numerals as those of the 14$^{th}$ embodiment and further explanation is deemed unnecessary. This embodiment provides a modification of the construction of the separation means.

As shown in FIGS. 25 and 26, the additive storage container 320 is provided with a cylindrical storage part 322 that is open at the upper end thereof and has a discharge port 322*a* at the lower end thereof, with a plurality of cutting tips 323 protruding upward in axial directions at positions around the discharge port 322*a*. The upper open end of the additive storage container 320 has a ring-type fixed ratchet 322*c*. The lower end of a slider 336 of the opening unit 330 is integrally provided with a bursting part 338 that gets torn off by the cutting tips 323. Furthermore, the inner surface of an end plate 332 of the opening unit 330 is integrally provided with a movable ratchet 332*b* at a position corresponding to the fixed ratchet 322*c*. The movable ratchet 332*b* allows the fixed ratchet 322*c* to rotate in one direction only. The inner circumferential surface of the upper open end of the additive storage container 320 is provided with a seal protrusion 322*d* that is in close contact with the outer circumferential surface of the slider 336 to move in a sliding manner.

Figure 27A:
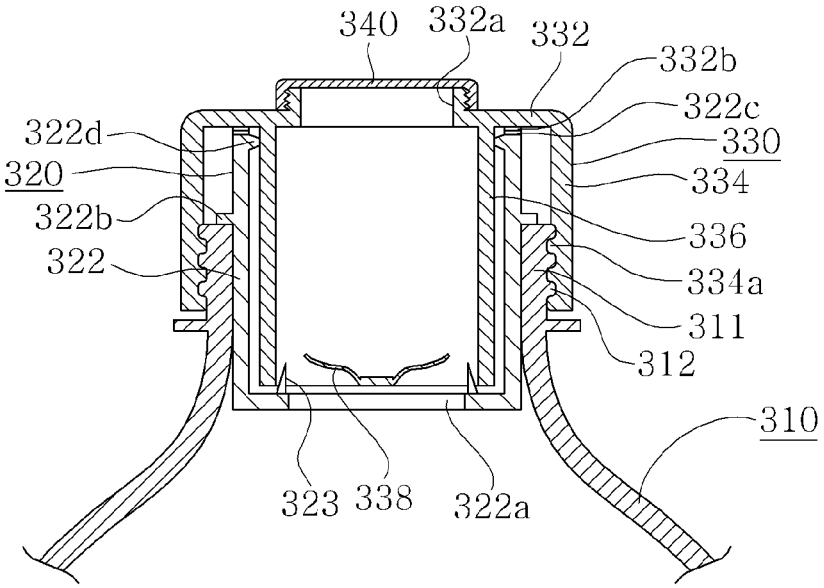
FIGS. 27A and 27B are sectional views showing the operation of the 15$^{th}$ embodiment of the present invention.

The 15th embodiment of the present invention is operated as follows. In the following description, the technical term "clockwise" is also a direction in which the opening unit 330 is tightened onto the mouth 311, while the term "counterclockwise" means the direction in which the opening unit 330 is loosened. As shown in FIG. 26, if a user rotates the opening unit 330 clockwise in an initial state, the internal thread 334*a* of the main cap 334 rotates along the external thread 312 of the mouth 311 and starts to move toward the lower part of the mouth 311 (in a direction to be tightened). At the same time, the slider 336 moves down and the bursting part 338 of the slider 336 gets torn off by the cutting tips 323 disposed at the lower end of the container 320, so that an additive is discharged into the bottle body 310 through the discharge port 322*a*. The more the slider 336 moves down, the bigger the burst is. Thus, the additive is completely discharged from the container 320 into the bottle body 310 when the opening operation is finished as shown in FIG. 27A.

Figure 28A:
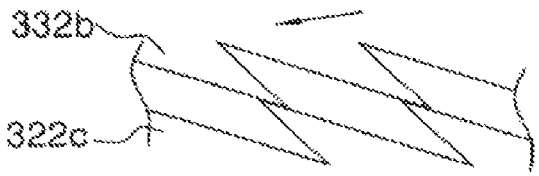
FIGS. 28A through 28C are enlarged sectional views showing the operation of a movable ratchet and a fixed ratchet of the 15$^{th}$ embodiment of the present invention.
Figure 28B:
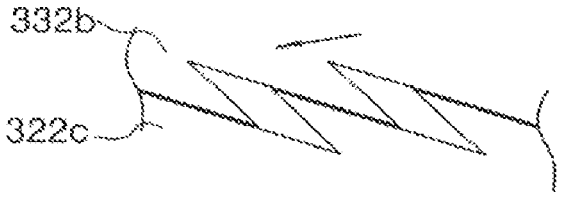

In addition, when the opening unit 330 rotates, the movable ratchet 332*b* also rotates along with the opening unit 330 and falls down. As shown in FIG. 28A, the movable ratchet 332*b* interferes with the fixed ratchet 322*c* at a predetermined position. At this time, the teeth of the ratchets 332*b* and 322*c* are arranged to allow mutual rotation thereof, and the teeth of the ratchets are elastically deformed, so that the movable ratchet 322*c* passes over the fixed ratchet 322*c* and enters the state shown in FIG. 28B.

Figure 27B:
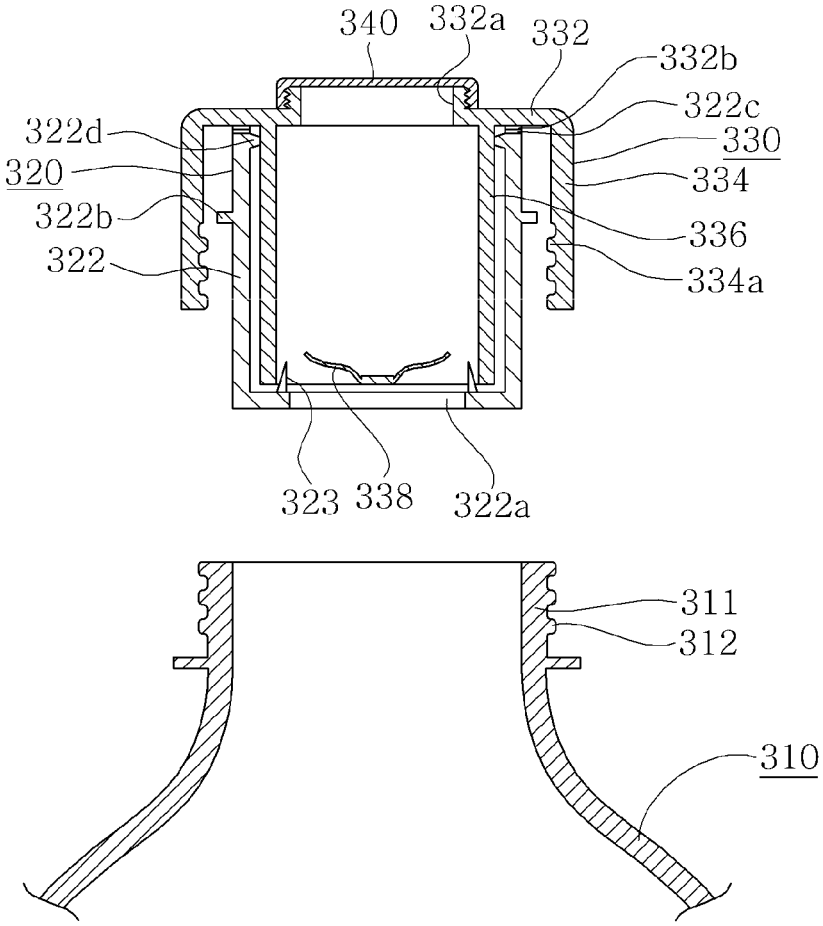
Figure 28C:
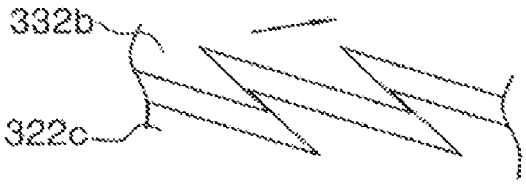
Figure 29:
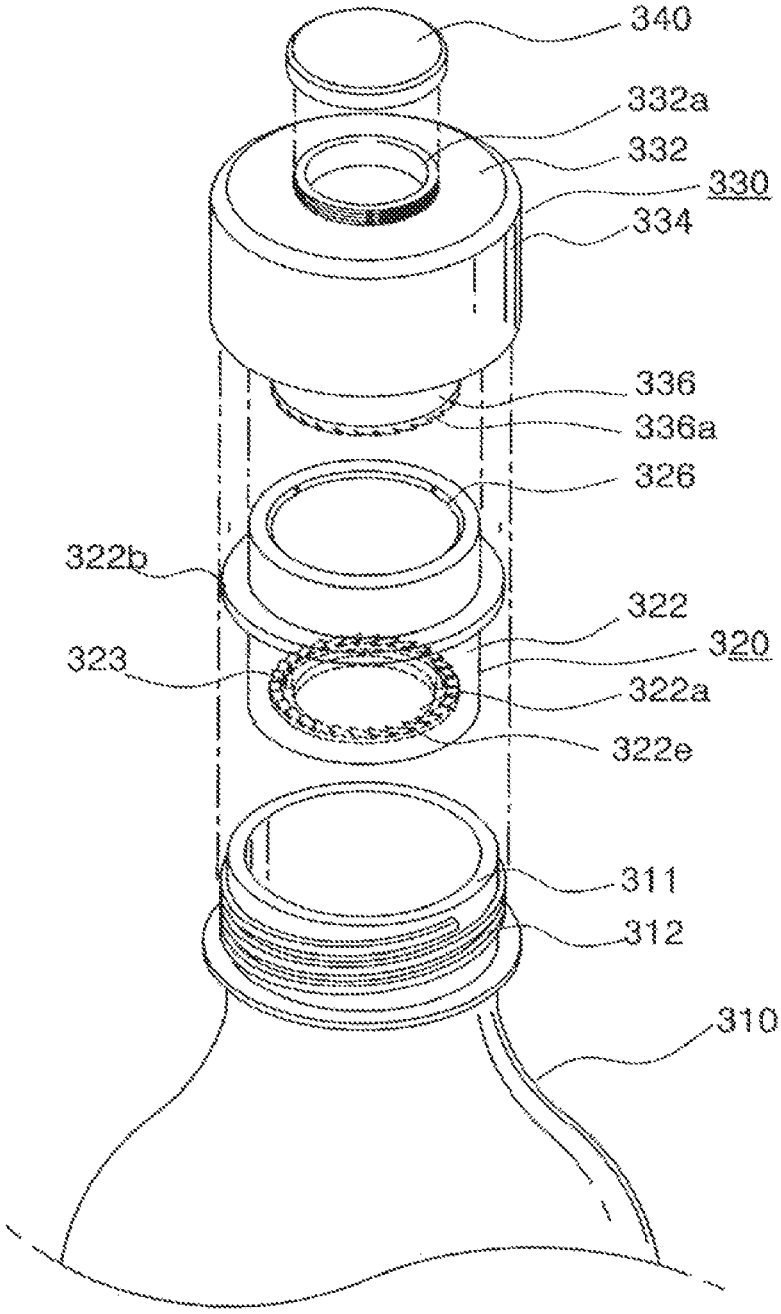
FIG. 29 is an exploded perspective view showing the construction of the 16$^{th}$ embodiment of the present invention.
Figure 30:
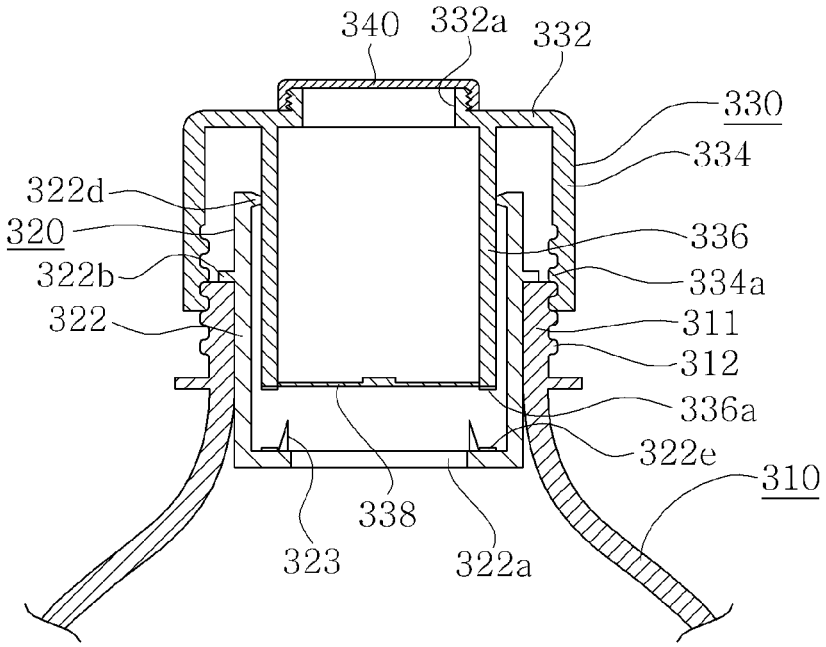
FIG. 30 is a sectional view showing the assembled construction of the 16$^{th}$ embodiment of the present invention.
Figure 31A:
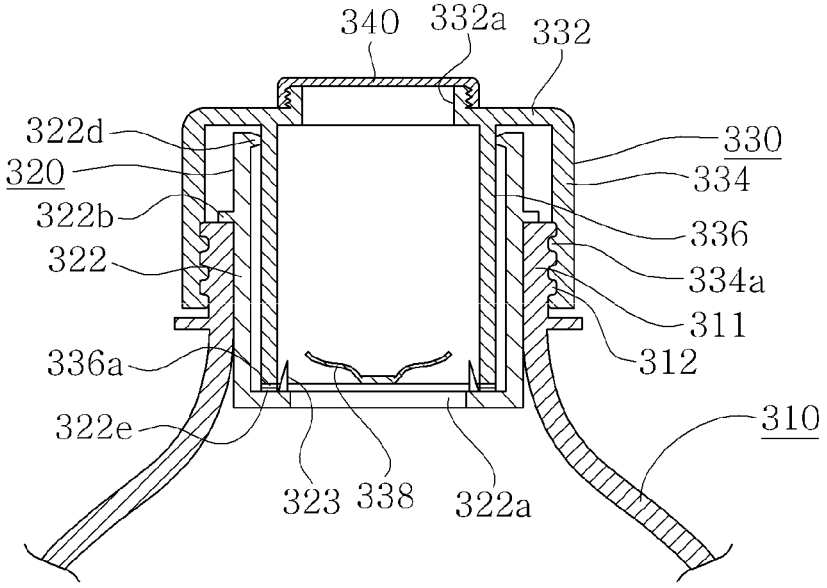
Figure 31B:
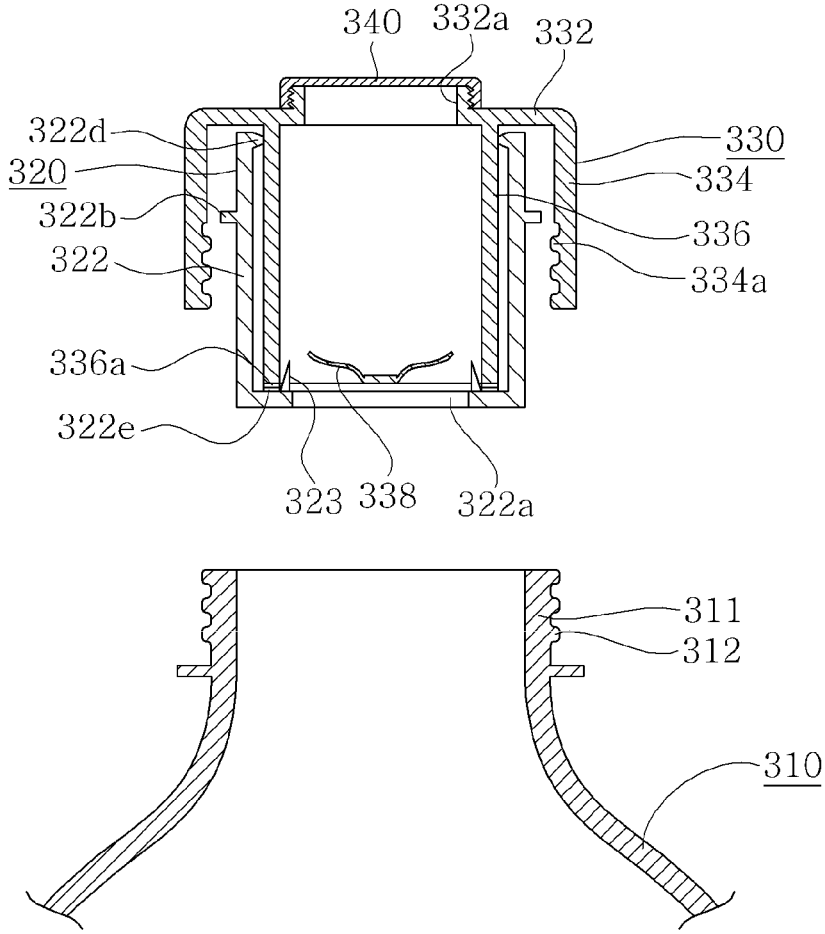

On the other hand, if the user rotates the opening unit 330 counterclockwise in this state, the movable ratchet 332*b* rotates in an inverse direction along the same path as when the ratchet 332*b* enters, as shown in FIG. 28C. At this moment, however, the fixed ratchet 322*c* limits rotating and rising of the movable ratchet 332*b*, unlike the entering state. So, the additive storage container 320 rotates along with the opening unit 330. In the above state, the internal thread 334*a* of the opening unit 330 rotates and rises along the external thread 312 of the mouth 211, so that the opening unit 330 and the additive storage container 320 are removed from the mouth 311 simultaneously, as shown in FIG. 27B.

FIGS. 29 through 31B show the 16$^{th}$ embodiment of the present invention. In this embodiment, the same elements as those of the 15$^{th}$ embodiment carry the same reference numerals as those of the 15$^{th}$ embodiment and further explanation is deemed unnecessary. This embodiment provides a modification of the construction of the separation means of the present invention.

Around the discharge port 322*a* of an additive storage container 320, a ring-type fixed ratchet 322*e* is integrally provided. A movable ratchet 336*a*, which allows the fixed ratchet 322*e* to rotate in one direction only, is integrally provided at the lower end of a slider 336 of an opening unit 330 at a position corresponding to the fixed ratchet 322*e*.

The operation of the 16$^{th}$ embodiment that has the above-mentioned construction remains the same as that described for the 15$^{th}$ embodiment of the present invention. The only difference between the two embodiments is the location of the fixed ratchet 322*e* and the movable ratchet 336*a*. A detailed explanation of the 16$^{th}$ embodiment is thus deemed unnecessary.

Figure 32:
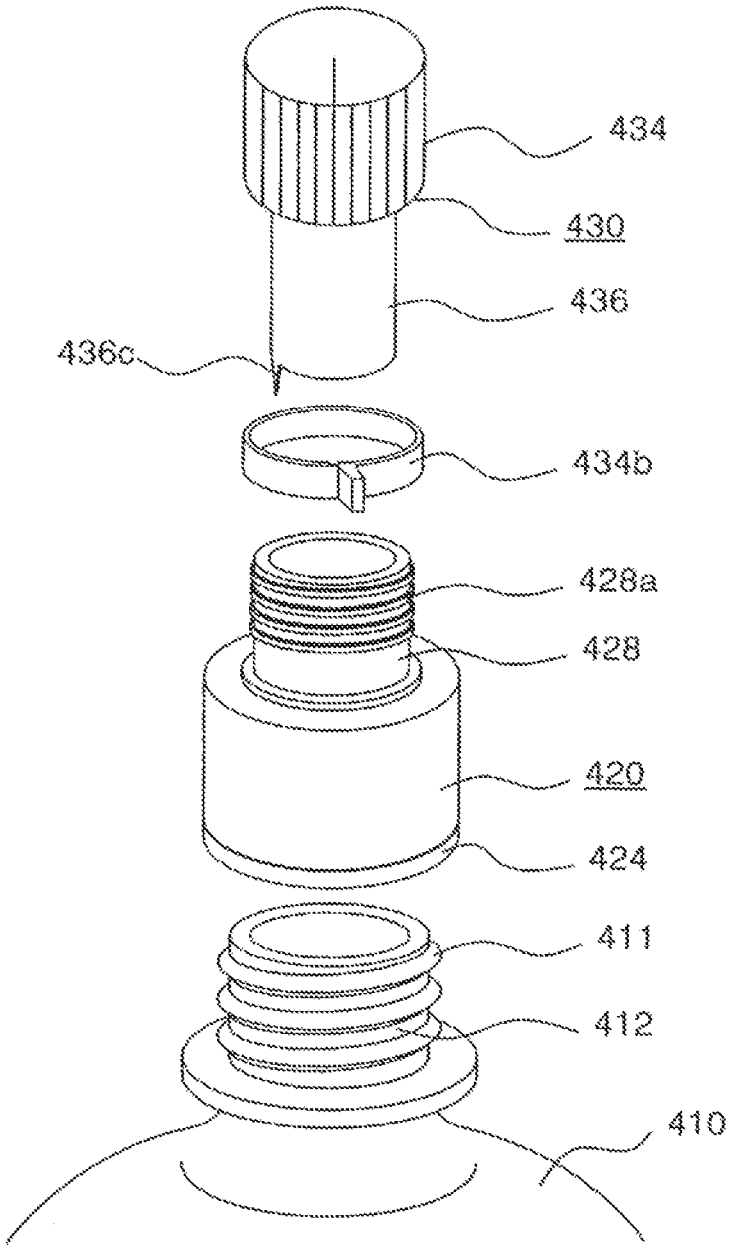
FIG. 32 is an exploded perspective view showing the construction of the 17$^{th}$ embodiment of the present invention.
Figure 33A:
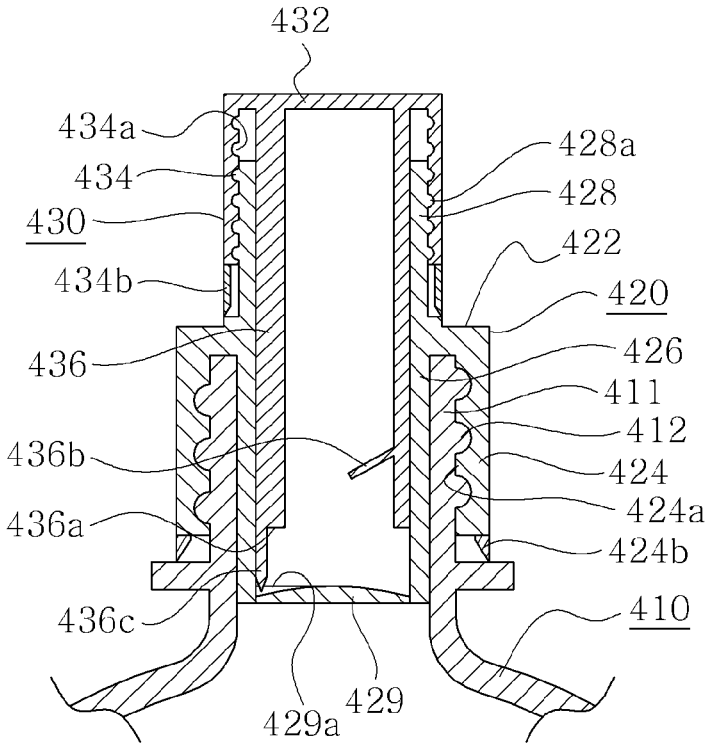
FIG. 33A is a longitudinal sectional view showing the construction of the 17$^{th}$ embodiment of the present invention.
Figure 33B:
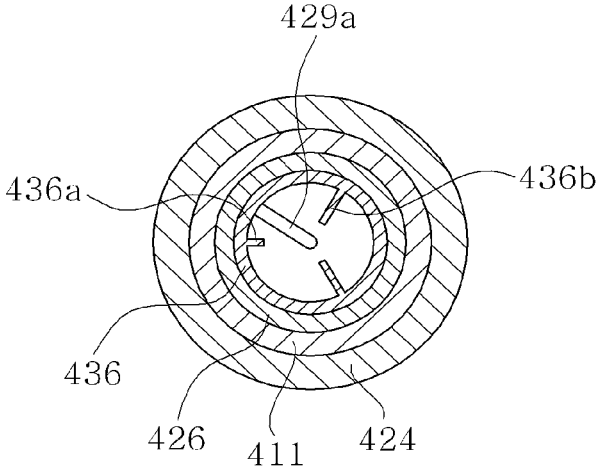
FIG. 33B is the horizontal sectional view showing the construction of the 17$^{th}$ embodiment of the present invention.

FIG. 32 is an exploded perspective view showing the construction of the bottle cap according to the 17$^{th}$ embodiment of the present invention. FIG. 33A shows a longitudinal sectional view of the assembled bottle cap, while FIG. 33B shows a transverse sectional view of the assembled bottle cap. This embodiment provides the construction that has an additive stirring unit to discharge a cohesive additive from the additive storage container into the bottle body more effectively.

This embodiment comprises a bottle body 410 that has a mouth 411 with an external thread 412 formed around the outer circumferential surface of the mouth 411; and an additive storage container 420 that is inserted into the mouth 411 such that the container 420 can be removed from the mouth 411. This embodiment also has an opening unit 430 that is tightened to the additive storage container 420 through a screw-type engagement. This opening unit 430 is configured such that, when it rotates in a predetermined direction, it stirs an additive using a stirring unit and, at the same time, discharges the additive from the additive storage container 420 into the bottle body 310. Furthermore, the opening unit 430 interferes with the additive storage container 420 at a predetermined position, thus removing the additive storage container 420 from the mouth 411.

The additive storage container 420 is composed of a circular end plate 422 that is placed on the upper open end of an additive storage part 426; a main cap 424 that extends downward in an axial direction from the outer circumferential edge of the end plate 422 and has an internal thread 424*a* combined to the mouth 411; and the additive storage part 426 that extends downward in an axial direction from the inner circumferential edge of the end plate 422 and is movably inserted into the mouth 411 in an axial direction. A bursting part 429 is provided at the lower end of the additive storage part 426. This bursting part 429 is partially but firmly combined to the additive storage part 426 by a holder 429*a*. In addition, an extension part 428 extends upward from the inner circumferential edge of the end plate 422 in a direction opposite to the additive storage part 426, with an external thread 428*a* formed around the outer circumferential surface of the extension part 428.

The opening unit 430 comprises a circular finish plate 432; an upper cap 434 that extends downwards in an axial direction from the outside edge of the finish plate 432 and has an internal thread 434*a* engaging with the external thread 428*a* of the extension part 428 through a screw-type engagement; and a slider 436 that extends in an axial direction from the finish plate 432 at a position spaced apart from the upper cap 434 and is inserted into the extension part 428 and the additive storage part 426.

The lower end of the upper cap 434 is provided with a fixed band 434*b* that limits downward movement of the upper cap 434. The fixed band 434*b* is designed to have a tearing-off line so that it can be easily separated from the upper cap 434 when an external force is applied thereto.

The lower end of the slider 436 is provided with a cutting edge 436*c*. The cutting edge 436*c* protrudes downward and cuts the bursting part 429 when the slider 436 rotates and moves downward. As shown in FIG. 33B, a stirring protrusion 436*a* and a stirring rod 436*b* are formed on the slider 436. The stirring protrusion 436*a* is formed along the length of the slider 436 and extends inwards in a radial direction. In the present invention, each of the stirring protrusion 436*a* and the stirring rod 436*b* is preferably set to be at least one in number.

In the present invention, the upper cap 434 and the extension part 428 engage with each other through a right-hand thread engagement, while the main cap 424 and the mouth 411 engage with each other through a left-hand thread engagement.

The reference numeral 424*b* in the drawings denotes a tap to prevent any unexpected opening of the additive storage container 420.

Figure 34A:
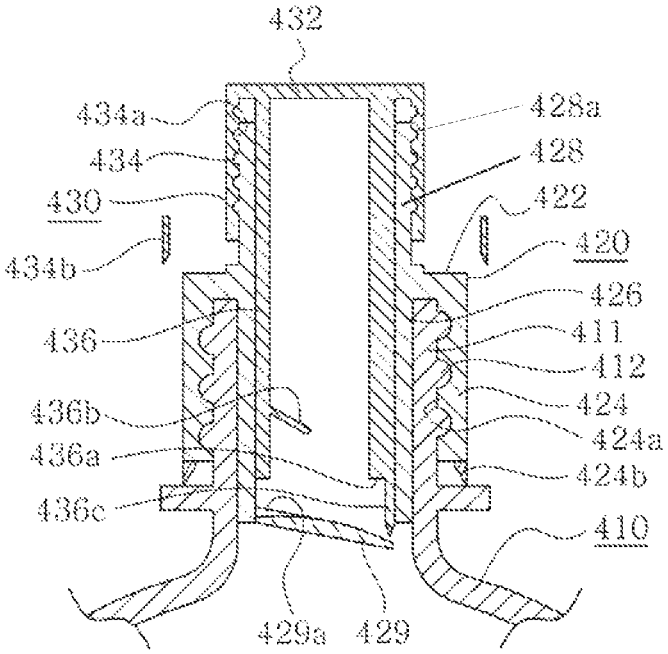
FIGS. 34A through 34C are sectional views showing the operation of the 17$^{th}$ embodiment of the present invention.
Figure 34B:
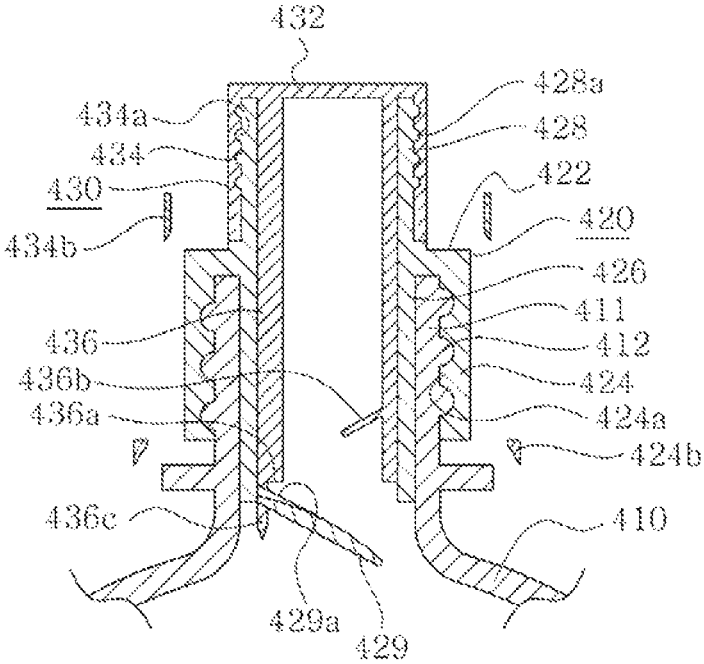

The 17$^{th}$ embodiment of the present invention having the above-mentioned construction will be operated as follows. If a user separates the fixed band 434*b* from the opening unit 430 at the initial stage as shown in FIG. 33A and then rotates the opening unit 430 counterclockwise, the opening unit 430 moves downward because the upper cap 434 and the extension part 428 engage with each other through the right-hand thread engagement. Thus, the cutting edge 436*c* cuts the bursting part 427, so that an additive is discharged downward from the additive storage container 420 and is input into the bottle body 410 as shown in FIG. 34A. In the present invention, the opening unit 430 is designed to rotate, as shown in FIG. 34B, within an angular range of 330° to 350° which excludes the holder 429*a* when the opening unit 430 moves completely down, so that the bursting part 437 maintains its connection to the slider 426 after the bursting part 437 is torn off.

When the opening unit 430 moves downward, the stirring protrusion 436*a* and the stirring rod 436*b* rotate together with the opening unit 420 and stir the additive in the container 420, so that the additive can be easily discharged from the container 420.

Figure 34C:
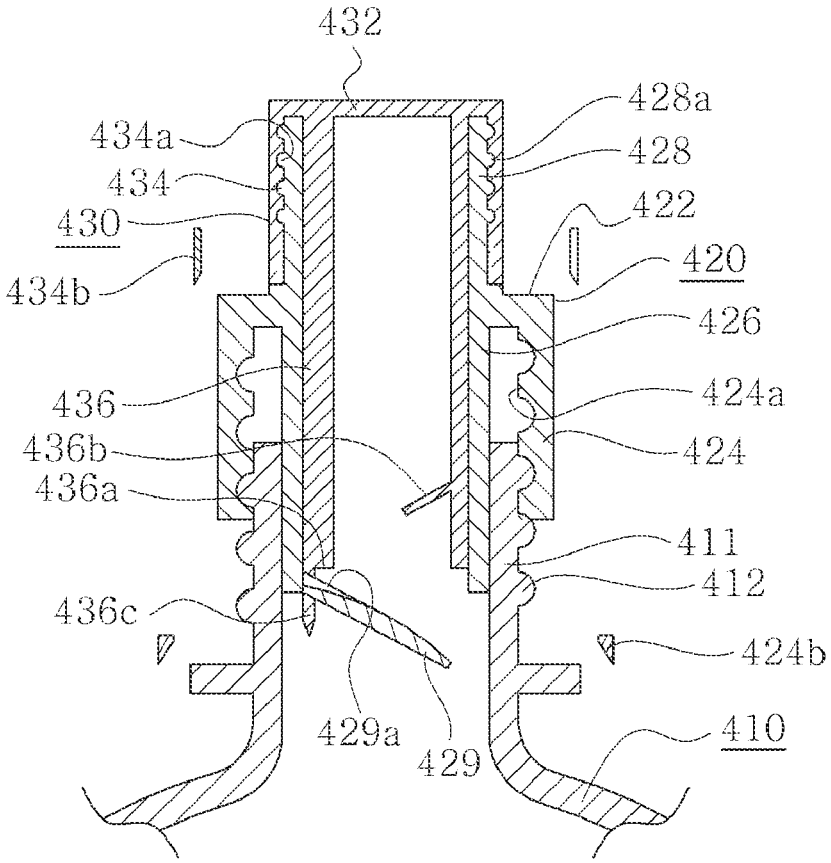

If the user further rotates the opening unit 420 counterclockwise, the rotational force of the opening unit 420 is transmitted to the additive storage container 430. Therefore, the internal thread 412*a* of the main cap 412 and the external thread 412 of the mouth 411 rotate together in the additive storage container 430. At this moment, the main cap 424 and the mouth 411 engage with each other through the left-hand thread engagement as described above, so that the unexpected-opening prevention tap 424*b* is torn off and then the opening unit 420 is separated from the mouth 411, as shown in FIG. 34C.

Figure 35:
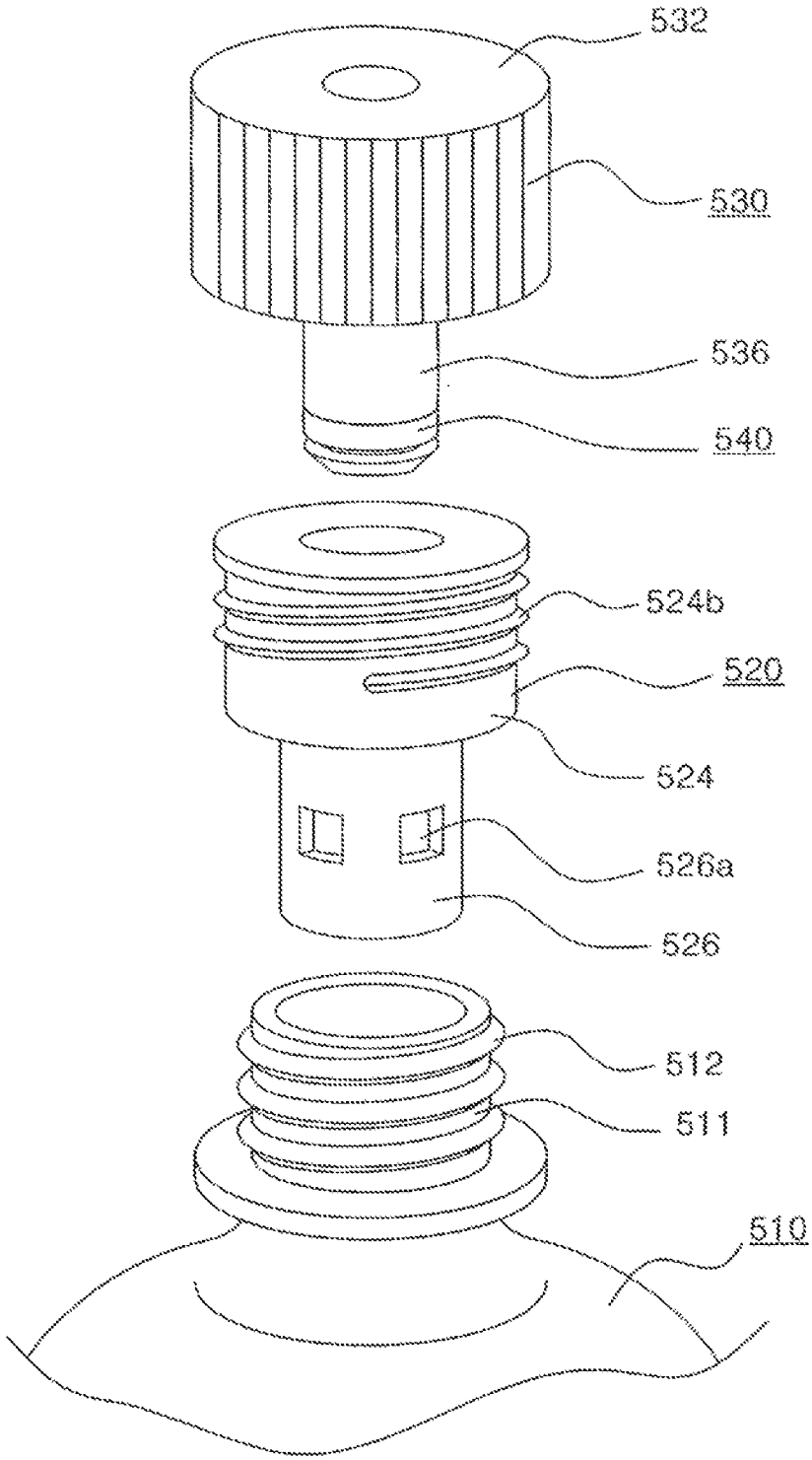
FIG. 35 is an exploded perspective view showing the construction of the 18$^{th}$ embodiment of the present invention.
Figure 36:
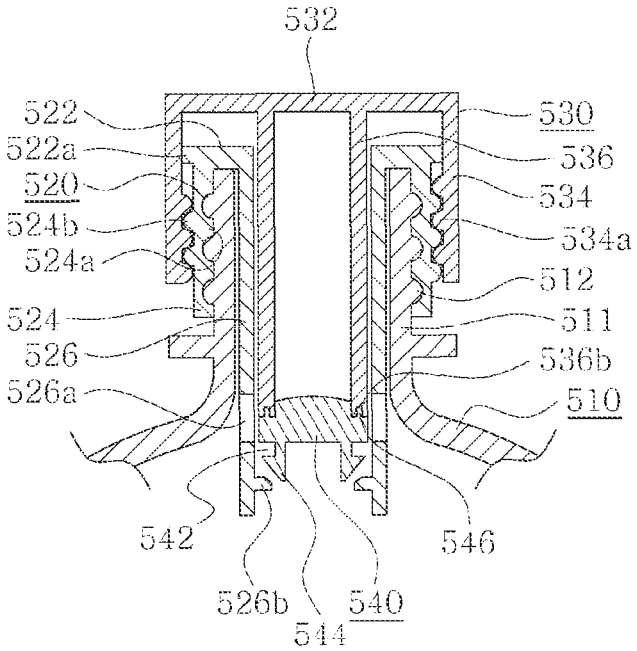
FIG. 36 is a sectional view showing the construction of the 18$^{th}$ embodiment of the present invention.

FIG. 35 is an exploded perspective view showing the construction of the 18$^{th}$ embodiment of the present invention. FIG. 36 is a longitudinal sectional view of the assembled bottle cap according to this embodiment. This embodiment proposes a plug which is provided on the additive storage space.

This embodiment comprises: a bottle body 510 that has a mouth 511 with an external thread 512 formed around the outer circumferential surface of the mouth 511; an additive storage container 520 that is inserted into the mouth 511 such that the container 520 can be removed from the mouth 511; and an opening unit 530 that is tightened to the additive storage container 520 through a screw-type engagement and discharges an additive from the container 520 into the bottle body 510 when the unit 520 is rotated. During the rotation of the opening unit 530, the unit 530 interferers with the additive storage container 520 at a predetermined position, and removes the additive storage container 520 from the mouth 511.

The additive storage container 520 is composed of a circular end plate 522 that is formed on the upper open end of an additive storage part of the container 520, a main cap 524 that extends downward in an axial direction from the outer circumferential edge of the end plate 422 and has an internal thread 524*a* engaging with the mouth 511, and an inner cap 526 that extends downward in an axial direction from the inner circumferential edge of the end plate 522 and is movably inserted into the mouth 511 in an axial direction. The lower end of the inner cap 526 is provided with a hooking protrusion 526*b* which protrudes inwards in a radial direction, and a discharge port 526*a* is formed on the inner cap 526 at a position above the hooking protrusion 526*b*. An external thread 524*b* is formed around the outer circumferential surface of the main cap 524. The outer circumferential edge of the end plate 522 is provided with a stopper 522*a* that extends outwards in a radial direction and prevents the opening unit 530 from being separated from the container 520.

The opening unit 530 comprises a circular finish plate 532; an upper cap 534 that extends downward in an axial direction from the outer circumferential edge of the finish plate 532 and has an internal thread 534*a* engaging with the external thread 524*b* of the main cap 524 through a screw-type engagement; and a slider 536 that extends downward in an axial direction from the finish plate 532 at a position spaced apart from the upper cap 534 and is inserted into the inner cap 526 of the storage container 520.

The lower part of the slider 536 is provided with a plug 540 such that the plug 540 can be removed from the slider 536. The plug 540 is provided with a hook 544 that forms a stopper engaging with the stop protrusion 526*b*. In addition, the upper part of the plug 540 is provided with a seal protrusion 546 that is inserted into a seal groove 536*b* formed at the lower end of the slider 536.

Figure 37A:
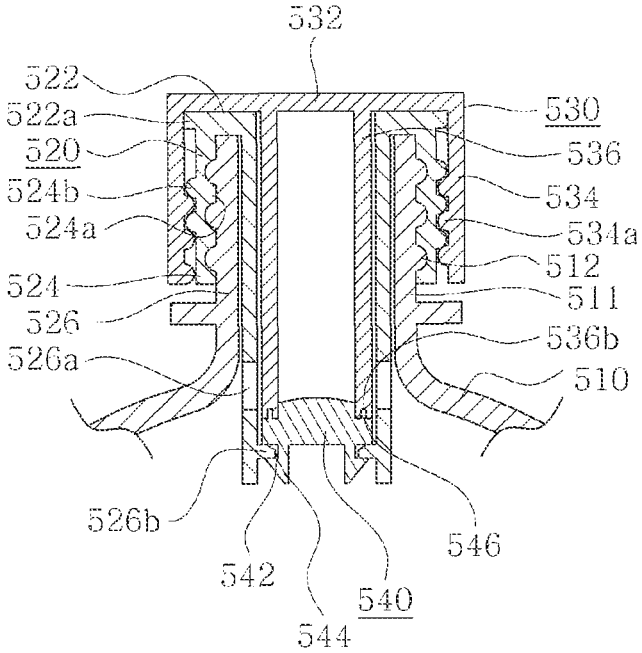
FIGS. 37A through 37C are sectional views showing the operation of the 18$^{th}$ embodiment of the present invention.
Figure 37B:
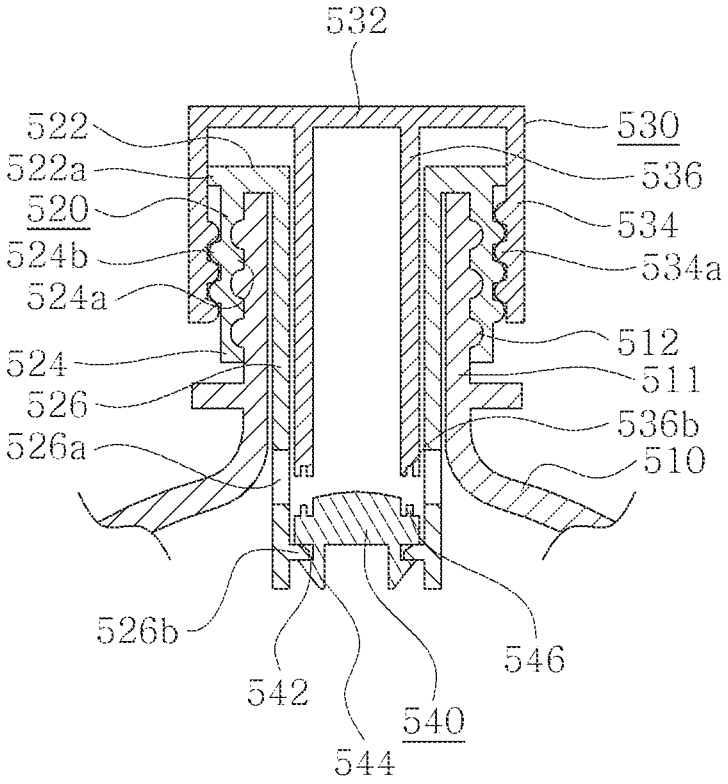

The 18$^{th}$ embodiment of the present invention is operated as follows. If a user rotates the opening unit 530 clockwise at the initial stage as shown in FIG. 36, the opening unit 530 moves downward due to an interaction between the external thread 524*b* and the internal thread 534*a*. As a result, the state shown in FIG. 37A is entered. In this embodiment, the end of the hook 544 is configured as a tapered shape, so that the plug 540 can smoothly pass over the stop protrusion 526*b* and be firmly hooked by the stop protrusion 526*b*. In this situation, if the user rotates the opening unit 530 counterclockwise, the opening unit 530 rises up due to an interaction between the external thread 512 and the internal thread 524*a*. In the above state, the plug 540 is stopped by the stop protrusion 526*b*, so that the plug 540 is separated from the slider 536 and an additive is discharged from the container 520 into the bottle body 510 through the discharge port 526*a* as shown in FIG. 37B.

Figure 37C:
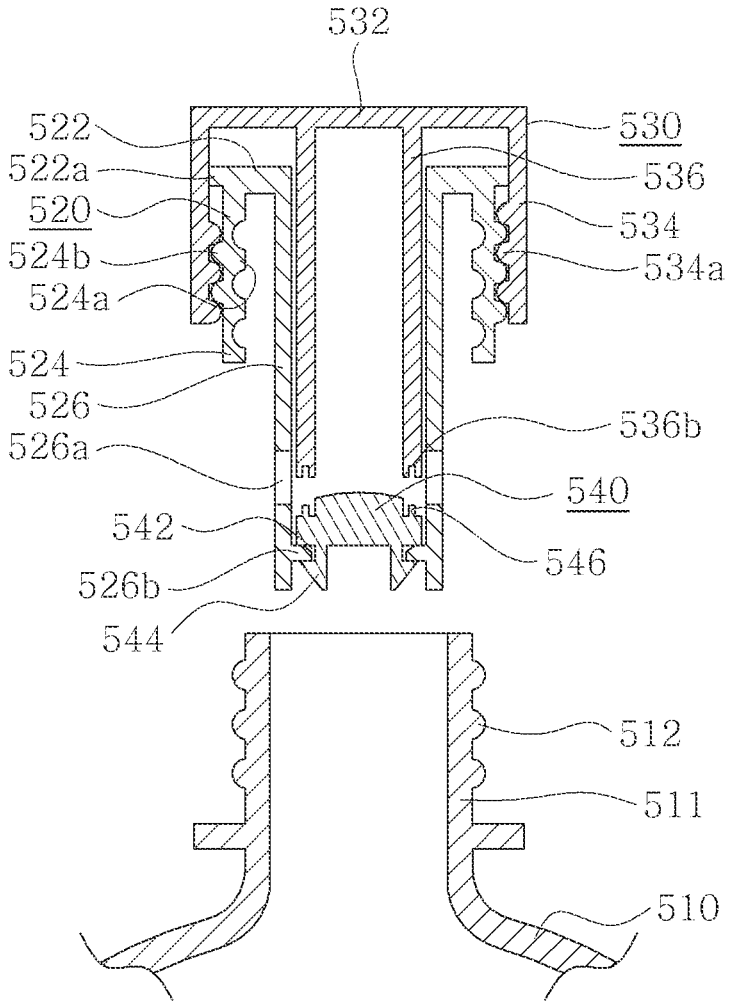

If the user rotates the opening unit 530 further counterclockwise, the internal thread 534*a* is held by the stopper 522*a*, so that the rotational force of the opening unit 530 is transferred to the additive storage container 530. Therefore, the part of the additive storage container 530 in which the internal thread 522*a* of the main cap 522 and the external thread 512 of the mouth 511 engage with each other is rotated. In the above state, the main cap 522 and the mouth 511 engage with each other through a left-hand thread engagement, so that the additive storage container 520 can be removed from the mouth 511 as shown in FIG. 37C.

Figure 38:
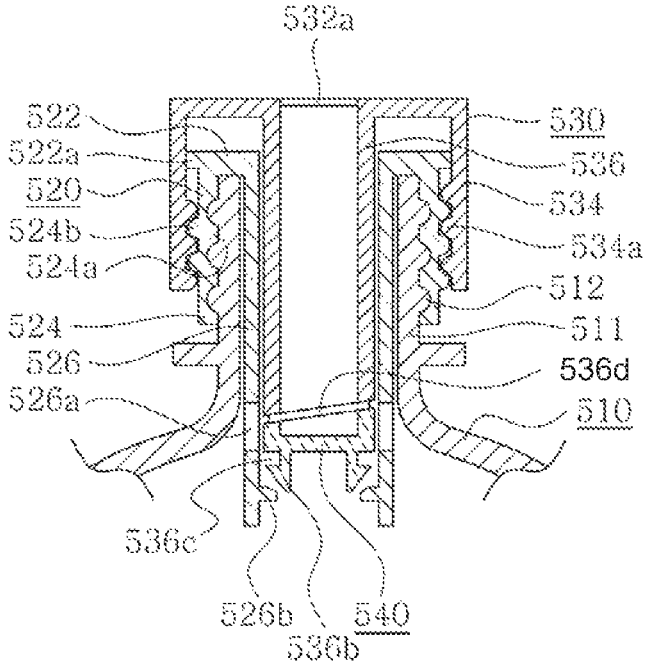
FIG. 38 is a sectional view showing the construction of the 19$^{th}$ embodiment of the present invention.

FIG. 38 shows the construction of the 19$^{th}$ embodiment of the present invention. This embodiment is a modification of the 18$^{th}$ embodiment of the present invention and comprises: a plug 540 which is formed on the lower part of the slider 536 such that the plug 540 is connected to the slider 536 by a tear-off part 536*d*. The connection between the plug 540 and the tear-off part 536*d* can be easily torn off by any external force. Because the lower part of the slider 532 is provided with the plug 540, an open port 532*b* is formed through the finish plate 532, thus opening the upper end of the slider 536 and being used to fill an additive storage container 520 with an additive. This open port 532*b* is sealed by a sealing means 532*a* after loading the additive in the container 520. An aluminum plate or a thin synthetic resin film is preferably used as the sealing means 532*a*.

Figure 39A:
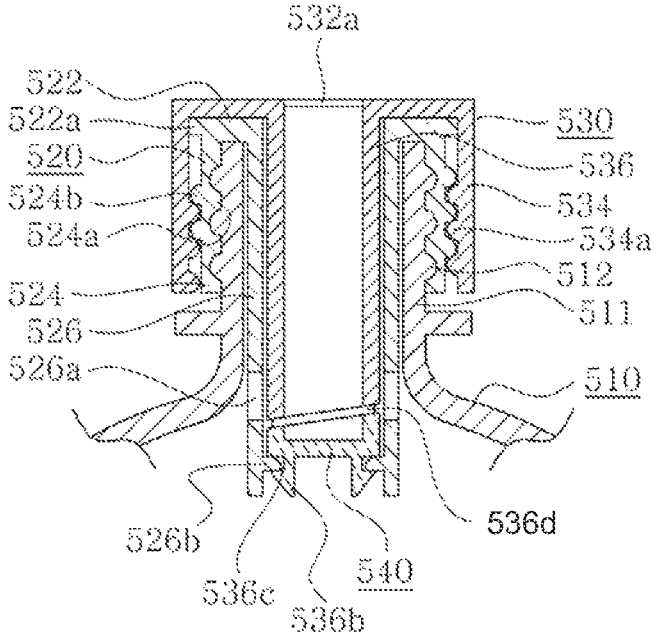
FIGS. 39A, 39B and 39C are sectional views showing the operation of the 19$^{th}$ embodiment of the present invention.
Figure 39B:
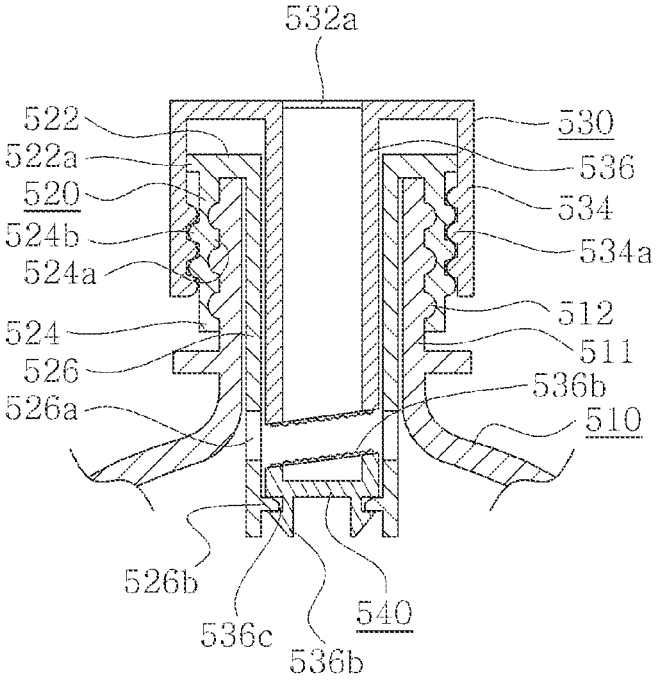
Figure 39C:
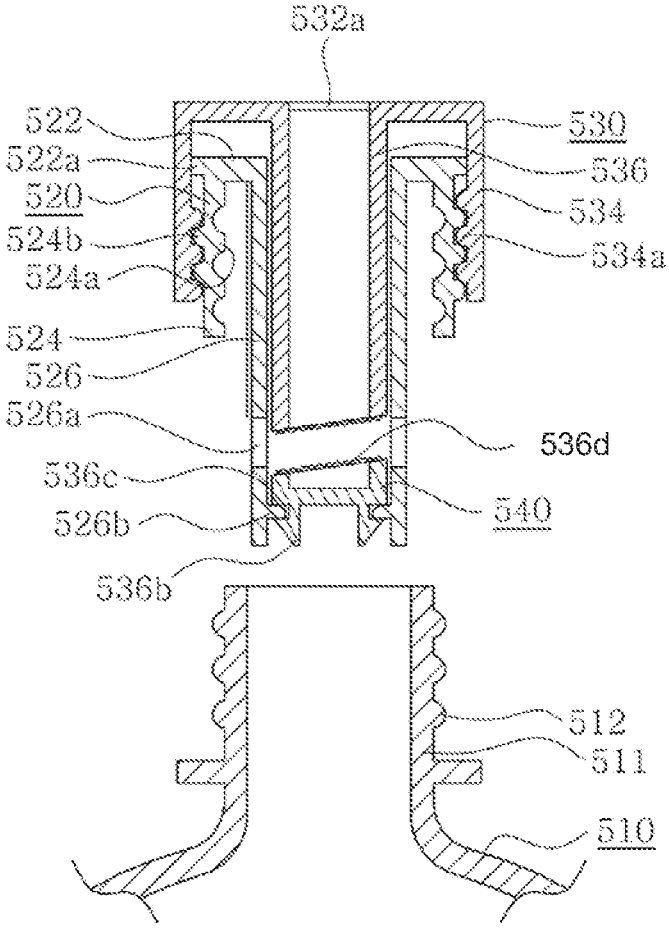
Figure 40A:
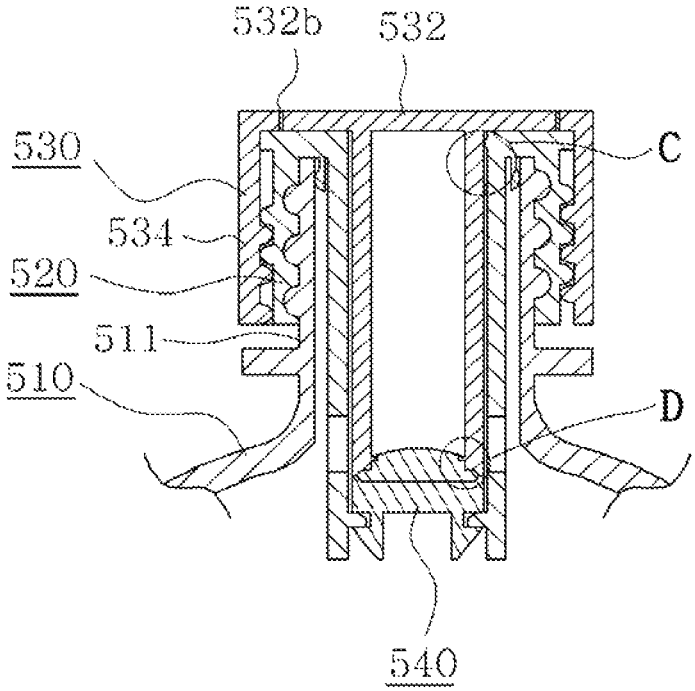
FIG. 40A is a sectional view showing the construction of the 20$^{th}$ embodiment of the present invention.
Figure 41:
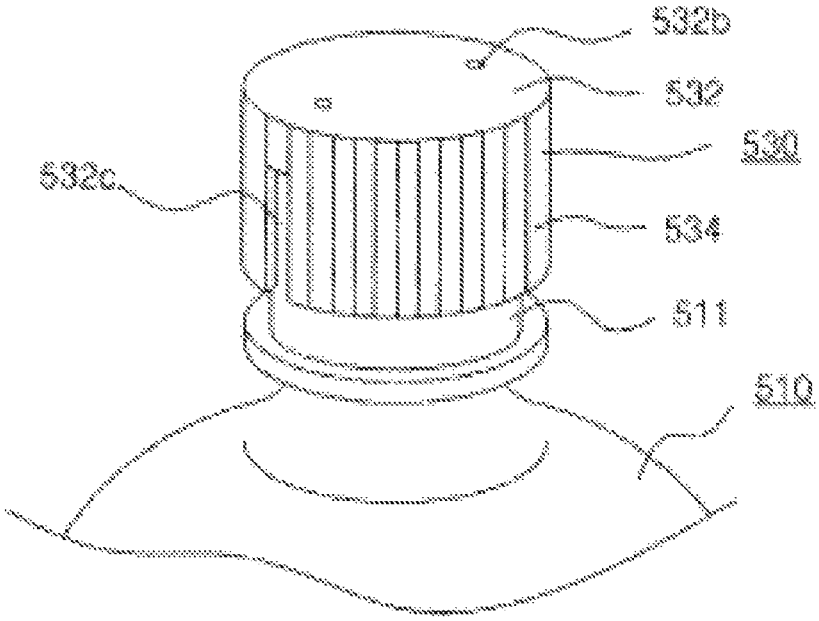
FIG. 41 is a perspective view showing the assembled construction of the 20$^{th}$ embodiment of the present invention.
Figure 42A:
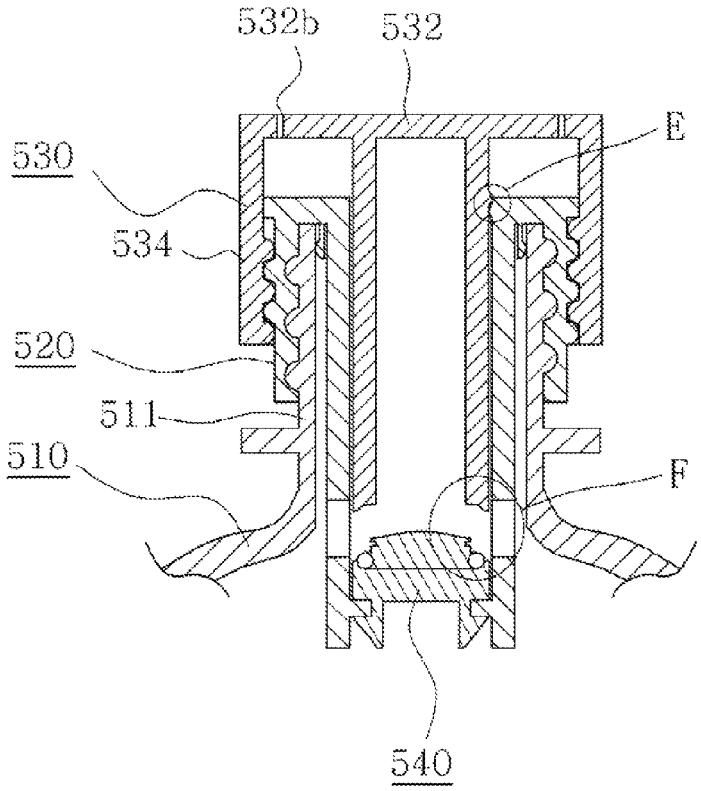
FIGS. 42A and 42B are sectional views showing the operation of the 20$^{th}$ embodiment of the present invention.
Figure 42C:
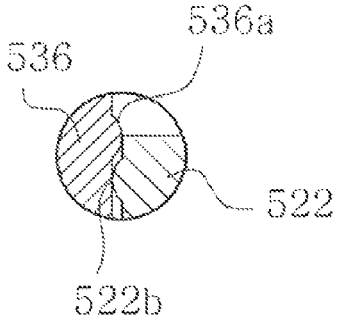
FIG. 42C is an enlarged view showing Area E of FIG. 42A.
Figure 42D:
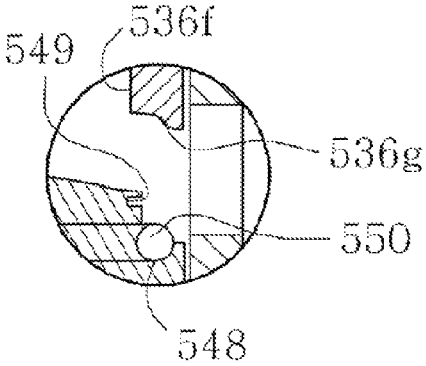
FIG. 42D is an enlarged view showing Area F of FIG. 42A.
Figure 42B:
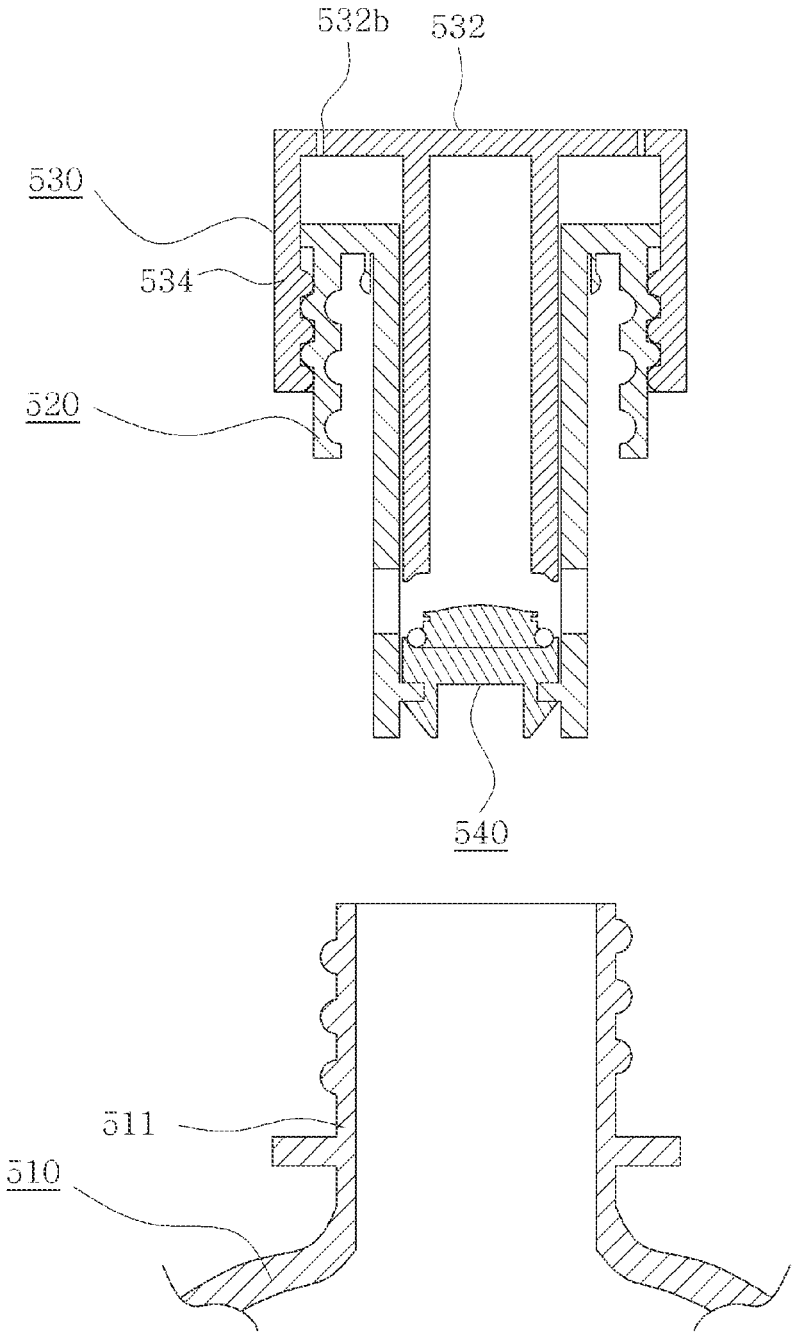
Figure 43:
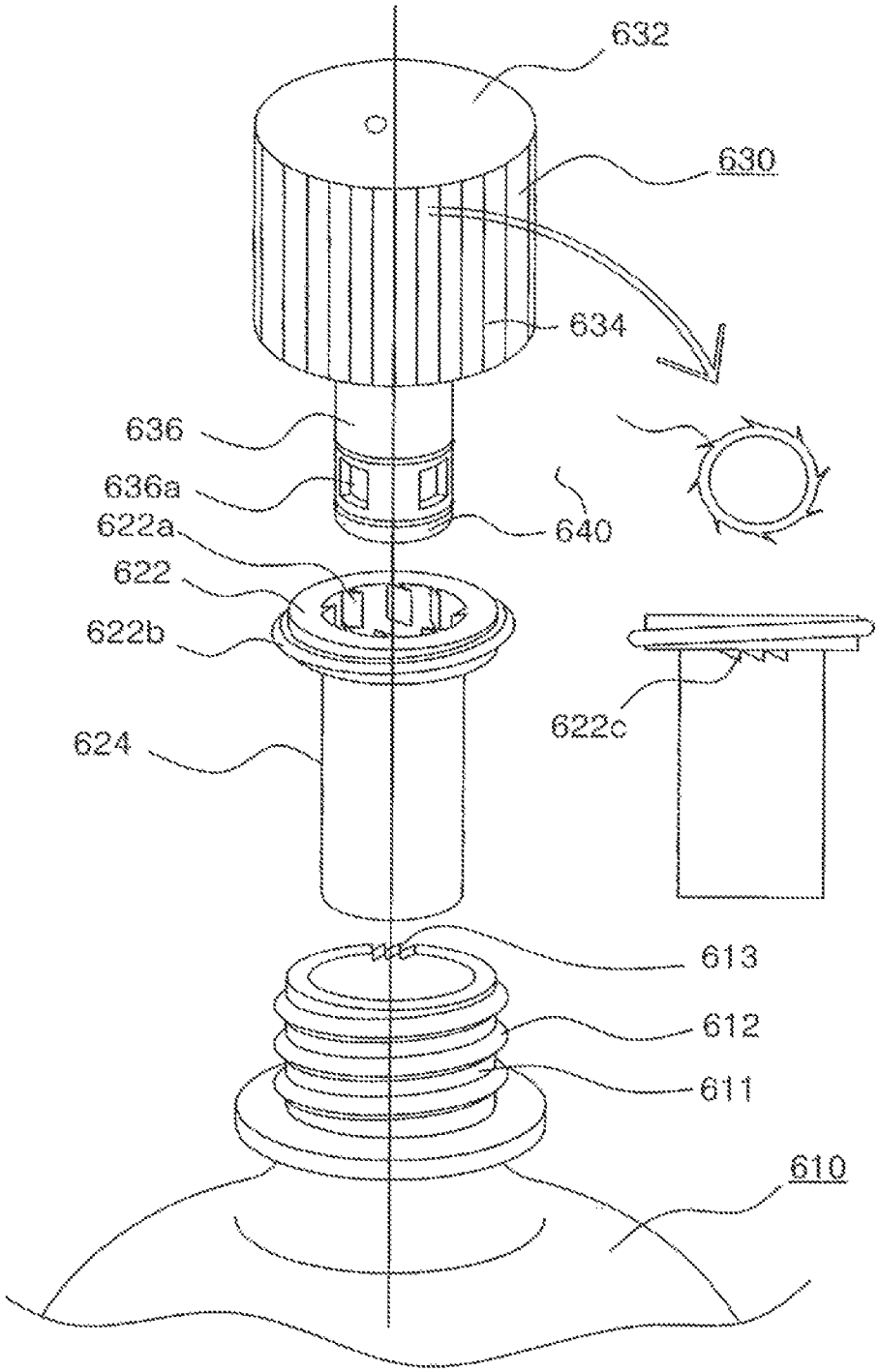
FIG. 43A is an exploded perspective view showing the construction of the 21$^{st}$ embodiment of the present invention.
FIG. 43C is a side view of the circular end plate of FIG. 43A.
Figure 43A:
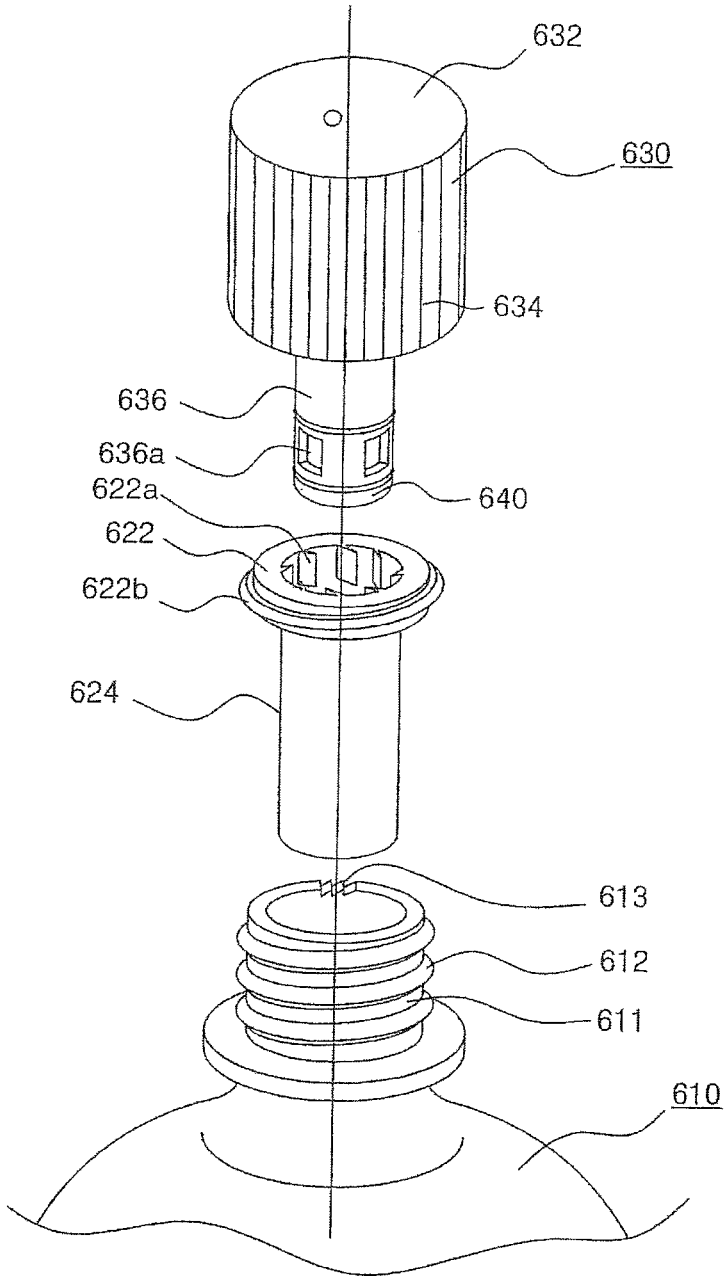
Figure 43B:
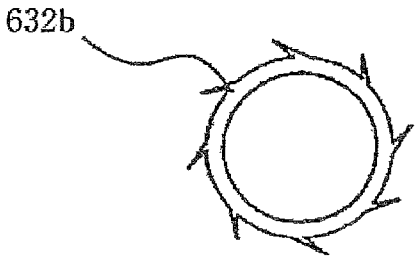
Figure 43C:
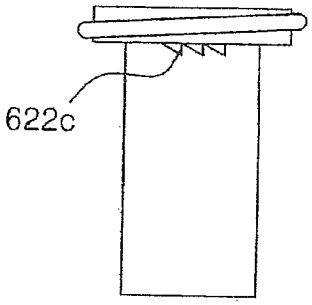

This embodiment is operated in the same manner as that described for the 18$^{th}$ embodiment of the present invention, except for the fact that the tear-off part 536*d* is torn off and the additive is input from the container 520 into the bottle body 510 as shown in FIG. 39B when the opening unit 530 is rising up after moving downward as shown in FIG. 39A from the initial stage as shown in FIG. 38. If the user rotates the opening unit 530 further in the same direction, the additive storage container 520 is removed from the mouth 511, as shown in FIG. 39C, in the same manner as described for the 18$^{th}$ embodiment.

FIGS. 40A through 42D show the 20$^{th}$ embodiment of the present invention. This embodiment has the structure which more effectively seals the junction between the plug and the slider. In the following description, the explanation for the elements of the same construction and operation that are the same as those of the 18$^{th}$ embodiment is not given.

According to this embodiment, interference protrusions 536*e* and 522*b* that interfere with each other during axial movement thereof are formed on the facing surfaces of both the slider 536 and the inner cap 522. In addition, the upper part of the plug 540 is provided with a locking groove 549 that is locked to a locking protrusion 536*f* which protrudes downward from the lower end of the inner circumferential edge of the slider 536. A seal ring 550 is provided between the plug 540 and the lower part of the slider 536. The seal ring 550 is closely held between a lower seal locking groove 548 formed in the plug 540 and an upper seal locking groove 536*g* formed along the lower end of the slider 536. The surface area formed with both the upper seal locking groove 536*g* and the lower seal locking groove 548 is made smaller than the sectional area of the seal ring 550, so that the seal ring 550 is elastically deformed during its installation and closes the gap between the grooves 548 and 536*g*, thus enhancing the seal effect.

The two interference protrusions 536*e* and 522*b* are designed to interfere with each other and make a sound when they pass over each other. The finish plate 532 is formed with a sound port 532*b* used to transmit the sound of the interference protrusions 536*e* and 522*b* externally.

According to this embodiment, the plug 540 and the slider 536 can be effectively sealed by the seal ring 550, the locking protrusion 536*f* and the locking groove 549, so that it is possible to reduce leakage of the additive during distribution of the bottle cap. Furthermore, it is possible to efficiently mix the material and the additive of the bottle together by inverting the bottle with the opening action of the opening unit being stopped at the moment when a sound is generated by the interference protrusions.

FIGS. 43A, 43B, 43C and 44 show the 21$^{st}$ embodiment of the present invention.

This embodiment comprises: a bottle body 610 that is composed of a mouth 611 having an external thread 612 formed around the outer circumferential surface of the mouth 611; an additive storage container 620 that is movably inserted into the mouth 611 such that the container 620 can be removed from the mouth 611; and an opening unit 630 that is combined to the additive storage container 620 through a screw-type engagement. The opening unit 630 moves downward and discharges an additive from the additive storage container into a bottle body at the early stage of rotation thereof. The opening unit 630 also interferes with the additive storage container 620 and removes the additive storage container 620 from the mouth 611 during rising movement thereof.

The additive storage container 620 comprises a circular end plate 622 formed on the open end of the additive storage part 611, and an inner cap 624 that extends downward in an axial direction from the inner circumferential edge of the end plate 622 and is axially inserted into the mouth 611 in an axial direction.

The outer circumferential surface of the end plate 622 is provided with an external thread 622*b* that is the same as the external thread 612 of the mouth 611.

A lower ratchet 613 is formed on the top of the mouth 611, while an upper ratchet 622*c* is formed on the lower surface of the end plate 622, so that the additive storage container 620 is allowed to rotate only in one direction relative to the mouth 611.

The opening unit 630 comprises: a circular finish plate 632 placed on the open top of the end plate 622; an upper cap 634 that extends downward in an axial direction from the outer circumferential edge of the finish plate 632 and has an internal thread 634*a* engaging with both the external thread 622*b* of the additive storage container 620 and the external thread 612 of the mouth 611; and a slider 636 which extends downward in an axial direction from the finish plate 632 at a position spaced apart from the upper cap 634 and is inserted into the inner cap 624.

At least two discharge ports 636*a* are formed around the circumferential surface of the lower part of the slider 636.

Ring-type seal protrusions 636*b* and 636*c* are formed around the outer circumferential surface of the slider 636 at positions above and below the discharge ports 636*a*, so that the protrusions 636*b* and 636*c* are in close contact with the inner circumferential surface of the inner cap 624, thus preventing an additive from leaking through the discharge ports 636*a*.

The slider 636 is formed with a wedge 636*d* on its lower end, so that it is possible to prevent the slider 636 from rising up over a predetermined position relative to the inner cap 624. Furthermore, a bursting film 640 that closes the lower ends of both the inner cap 624 and the slider 636 is provided. The bursting film 640 is preferably made of an aluminum film.

On the other hand, the inner circumferential surface of the end plate 622 is provided with a lower ratchet plate 622*a* while the lower surface of the finish plate 632 is provided with an upper ratchet plate 632*b* that interferes with the lower ratchet plate 622*a* so that the opening unit 630 is allowed to rotate in only one direction relative to the additive storage container 620.

To input an additive into the additive storage container, the finish plate 632 is formed with the open port 632*a*. The open port 632*a* is sealed with a separate sealing means (not shown) after the additive is loaded into the additive storage container. An aluminum plate or a thin synthetic resin film is preferably used as the sealing means.

Figure 44:
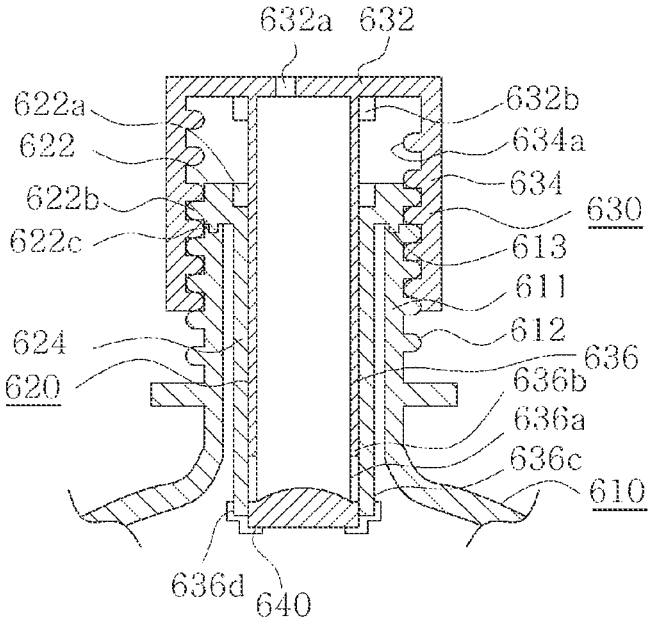
FIG. 44 is a sectional view showing the construction of the 21$^{st}$ embodiment of the present invention.
Figure 45A:
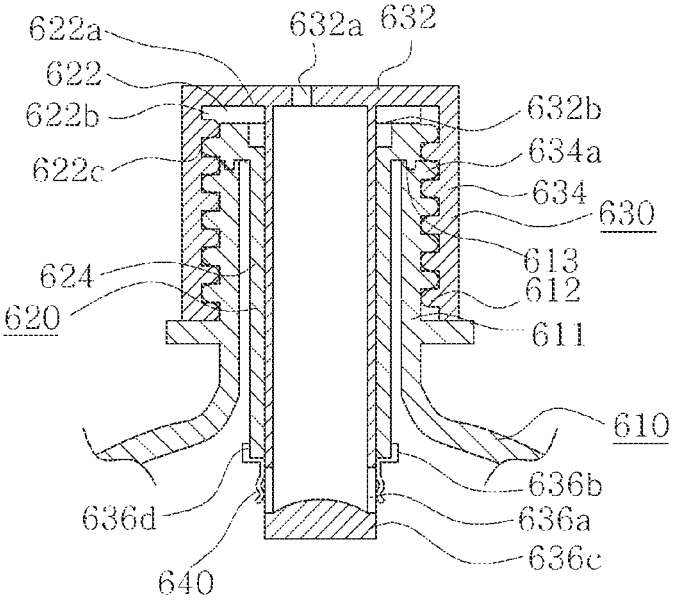
FIGS. 45A and 45B are sectional views showing the operation of the 21$^{st}$ embodiment of the present invention.

The bottle cap according to this embodiment is operated as follows. If a user rotates the opening unit 630 clockwise at an initial stage as shown in FIG. 44, the opening unit 530 moves downward due to the interaction between the external thread 612*b* and the internal thread 634*a*. As a result, the state as shown in FIG. 45A is accomplished. At this moment, the lower end of the slider 636 tears off the bursting film 640 and moves downward, so that the additive is discharged from the additive storage container 620 into the bottle body through the discharge ports 636*a*. In the above state, the additive storage container 620 is not allowed to rotate clockwise due to both the lower ratchet 613 and upper ratchet 622, so that the container 620 is not moved. In addition, the upper ratchet plate 632*b* engages with the lower ratchet plate 622*a*.

Figure 45B:
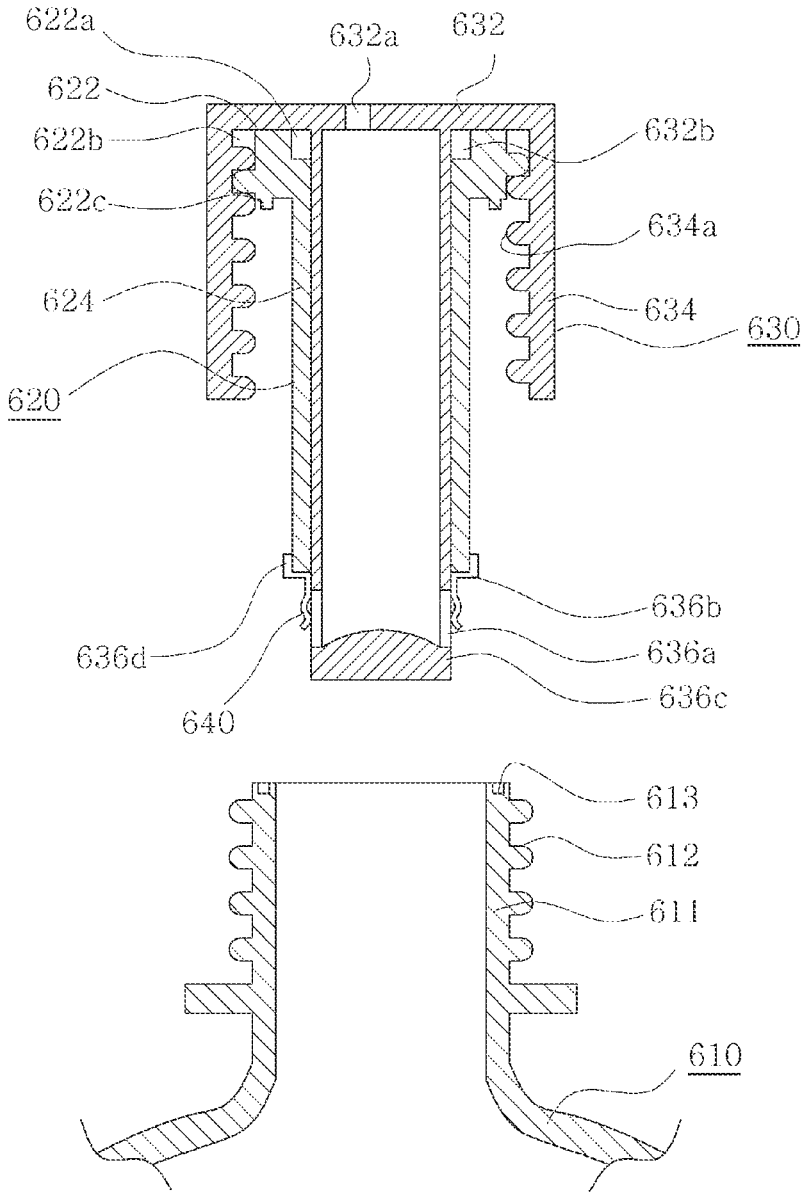

In this situation, if the user rotates the opening unit 630 counterclockwise, the upper ratchet plate 632*b* of the opening unit 630 engages with the lower ratchet plate 622*a* mutually, so that the rotational force of the opening unit 630 is transferred to the additive storage container 620. Furthermore, the lower ratchet 613 and the upper ratchet 622 are allowed to be rotated counterclockwise, so that the opening unit 630 rises up due to the mutual interaction between the internal thread 634*a* of the opening unit 630 and the external thread 612 of the mouth 611 with the screw-type engagement part between the additive storage container 620 and the opening unit 630 being kept unchanged. As a result, as shown in FIG. 45B, the additive storage container 620 rises up and is removed from the bottle body during its rotation.

Figure 46A:
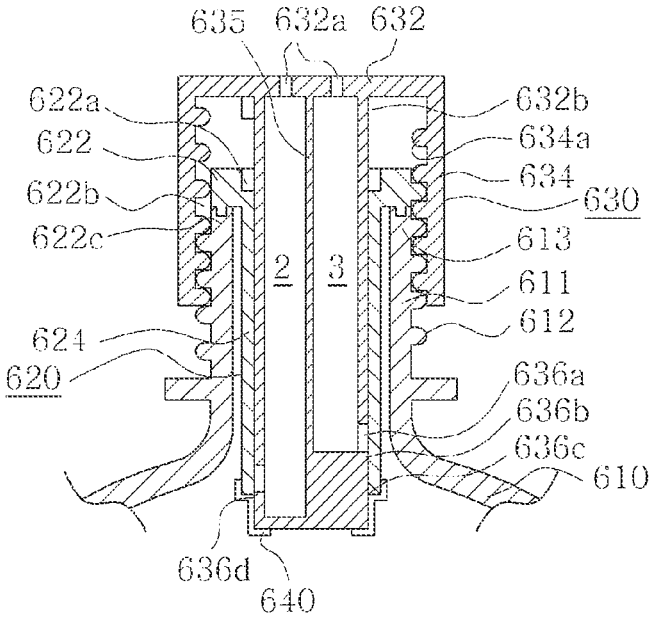
FIGS. 46A and 46B are sectional views showing the construction and operation of the 22$^{nd}$ embodiment of the present invention.
Figure 46B:
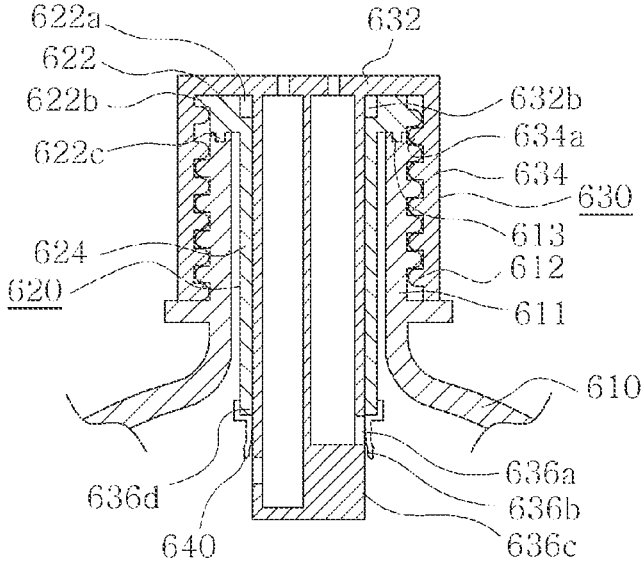

FIGS. 46A and 46B show the construction of the 22$^{nd}$ embodiment of the present invention. A detailed explanation of those elements of the construction and operation that are the same as those of the 21$^{st}$ embodiment of the present invention is not given in the following description. This embodiment is a modification of the 21$^{st}$ embodiment, and has the construction in which the additive storage space is divided into two parts to contain two kinds of additives therein.

As shown in FIG. 46A, a slider 636 extends from an opening unit 630 and defines therein an additive storage space which is divided in an axial direction by the partition wall 635 into two additive storage spaces 2 and 3. The opening unit also has a finish plate 632 that is provided with an open port 632*a*. This open port 632*a* allows a user to load additives in the two storage spaces 2 and 3 while the lower parts of the two additive storage spaces 2 and 3 are respectively provided with discharge ports 636*a* that discharge the additives into the bottle body 610. This 22$^{nd}$ embodiment of the present invention is the same as the 21$^{st}$ embodiment in terms of operation.

Figure 47A:
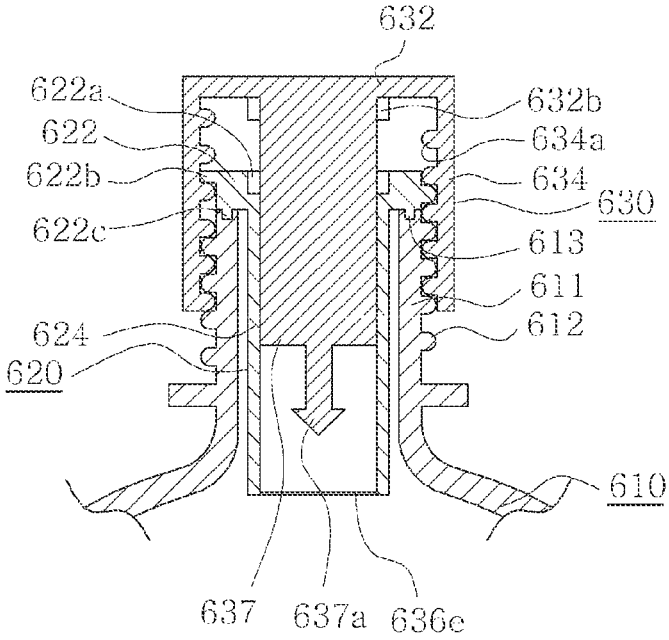
FIGS. 47A and 47B are sectional views showing the construction and operation of the 23$^{rd}$ embodiment of the present invention.
Figure 47B:
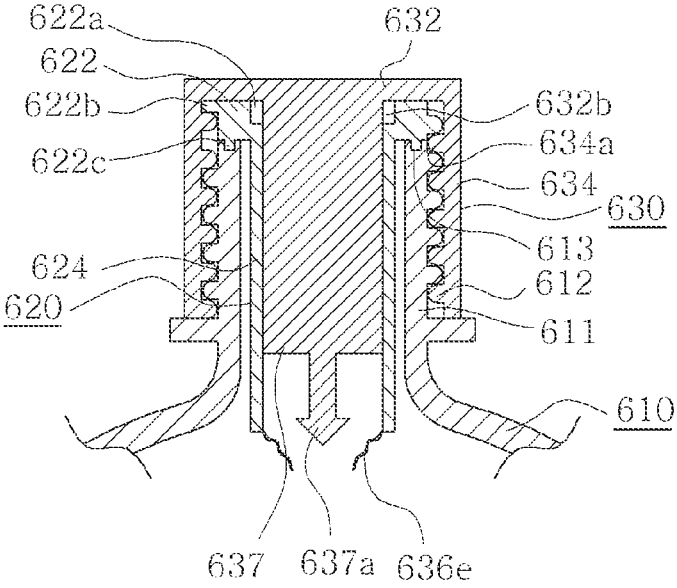

FIGS. 47A and 47B show the construction of the 23$^{rd}$ embodiment of the present invention. This embodiment provides a modification to the 21$^{st}$ embodiment. This 23$^{rd}$ embodiment comprises: a bursting film 636*a* that is provided at the lower end of an inner cap 624 of an additive storage container 620 in order to form an additive storage space 2 therein; a cylindrical slider 637 that extends downward from a finish plate 632 and is movably inserted into the inner cap 624; and a cutting edge 637*a* that tears off the bursting film 636*e* at the lower end of the slider 637. In this 23$^{rd}$ embodiment, at least one reinforcing rib may be provided around the support shaft of the cutting edge 637*a* to increase the strength of the support shaft of the cutting edge 637*a*. Furthermore, the bursting film 636*a* is preferably made of a thin aluminum film. However, it should be understood that the bursting film may be formed as a thin film which is produced using the same material as that of the inner cap 624 of the additive storage container 620 through a molding process, with a tear-off line provided on the thin film. Most of the operation of the 23$^{rd}$ embodiment is the same as that of the 21$^{st}$ embodiment, except that the bursting film 636*e* in this 23$^{rd}$ embodiment is torn off by the cutting edge 637*a* and an additive is discharged from the additive storage space 2 into the bottle body 610 while the opening unit 620 is moved downward, as shown in FIG. 47B.

Figure 48:
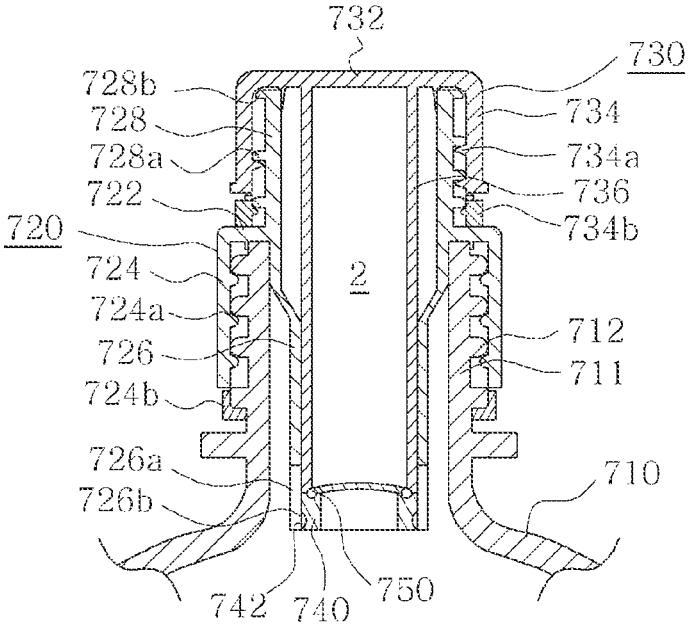
FIG. 48 is a sectional view showing the construction of the 24$^{th}$ embodiment of the present invention.
Figure 49:
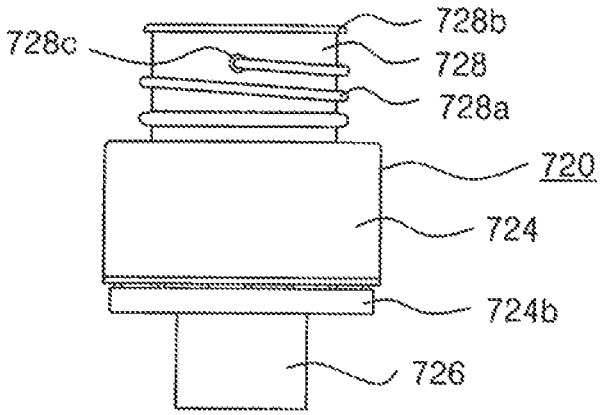
FIG. 49 is a side view showing the appearance of an additive storage container of the 24$^{th}$ embodiment of the present invention.

FIGS. 48 and 49 show the construction of the 24$^{th}$ embodiment of the bottle cap of the present invention. In this embodiment, the bottle cap is configured such that an additive is discharged from an additive storage container into a bottle body when the bottle cap is rotated in one direction, and the additive storage container can be removed from the mouth of the bottle body when the bottle cap is rotated in the opposite direction.

This embodiment comprises: a bottle body 710 that has a mouth 711 provided with an external thread 712 around its outer circumferential surface; an additive storage container 720 that is inserted into the mouth 711 such that the container 720 can be removed from the mouth 711; and an opening unit 730 that is combined to the additive storage container 720 through a screw-type engagement. The opening unit 730 discharges an additive from the additive storage container 720 into the bottle body 710 during rotation thereof in one direction, and separates the additive storage container 720 from the mouth 711 due to its interference with the additive storage container 720 at a predetermined position during rotation thereof in the opposite direction.

The additive storage container 720 comprises: a circular end plate 722 that is placed above the open upper end of the mouth 711; a main cap 724 that extends downward in an axial direction from the outer circumferential edge of the end plate 722 and has an internal thread 724*a* tightened to the mouth 711 through a screw-type engagement; and an inner cap 726 that extends downward in an axial direction from the inner circumferential edge of the end plate 722 and is placed in the mouth 711 such that the inner cap 726 can be moved in an axial direction. The inner cap 726 has a step 726*c* so that the inner cap 726 is spaced apart from the inner circumferential surface of the mouth 711. Furthermore, the lower end of the inner cap 726 has a plurality of discharge ports 726*a*. An extension part 728 extends upward from the inner circumferential edge of the end plate 722 so that the extension part 728 is opposite the inner cap 726. The outer circumferential surface of the extension part 728 has an external thread 728*a*. The extension part 728 is also provided with a stopper 728*b* which extends outward in a radial direction and limits upward movement of the internal thread 734*a*, which will be described in detail later herein.

The lower end of the main cap 724 is provided with a skirt 724*b* which restricts the undesirable opening of the main cap 724. This skirt 724*b* is coupled to the main cap 724 by a tear-off means, so that the skirt 724*b* can be easily separated from the upper cap 724 by an external force.

The opening unit 730 comprises: a circular finish plate 732; an upper cap 724 that extends downward in an axial direction from the outer circumferential edge of the finish plate 732 and has an internal thread 734*a* engaging with the external thread 728*a* of the extension part 728 through a screw-type engagement; and a slider 736 that extends downward from the finish plate 724 at a position which is spaced apart from the upper cap 734. The slider 736 extends downward in an axial direction from the finish plate 732 and is closely inserted into the inner cap 726.

The lower end of the upper cap 734 is provided with a skirt 734*b* which restricts the undesirable opening of the upper cap 734. This skirt 734*b* is coupled to the lower end of the upper cap 734 by a tear-off means, so that the skirt 734*b* can be easily separated from the upper cap 734 by any external force.

The lower end of the slider 736 is provided with a plug 740 that seals the interior of the slider 736 and can be separated from the slider 736. The plug 740 has a stop ring 742 that engages with a stop protrusion 726*b* so that axial movement of the plug 740 relative to the slider 736 is restricted.

A seal ring 750 is placed between the lower part of the slider 736 and the plug 740 so that the additive storage space 2 can be sealed.

Figure 50A:
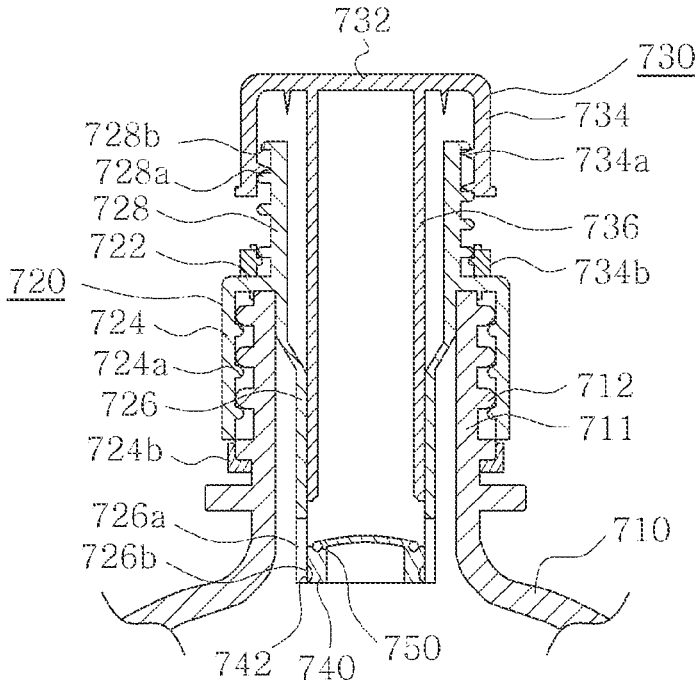
FIGS. 50A and 50B are sectional views showing the operation of the 24$^{th}$ embodiment of the present invention.

The 24$^{th}$ embodiment of the present invention having the above-mentioned construction is operated as follows. If a user rotates the opening unit 720 at the initial stage as shown in FIG. 48, the upper cap 734 that has been tightened to the extension part 728 through a right-hand thread engagement is separated from the skirt 734*b* and rises upward. As shown in FIG. 50A, therefore, the additive in the storage space 2 is discharged downward into the bottle body 710 through the discharge ports 726*a*. During the rotation, the opening unit 720 rises up to a predetermined height so that the internal thread 734*a* of the upper cap 734 escapes from the external thread 728*a* of the extension part 728. At this moment, the opening unit 720 cannot move further upward due to the stopper 728*b*, but idle-rotates around the extension part 728.

Thus, the user can feel the idle-rotation of the opening unit 730 around the extension part 728 by his/her fingers and can recognize that the additive and the bottled material are completely mixed together.

Figure 50B:
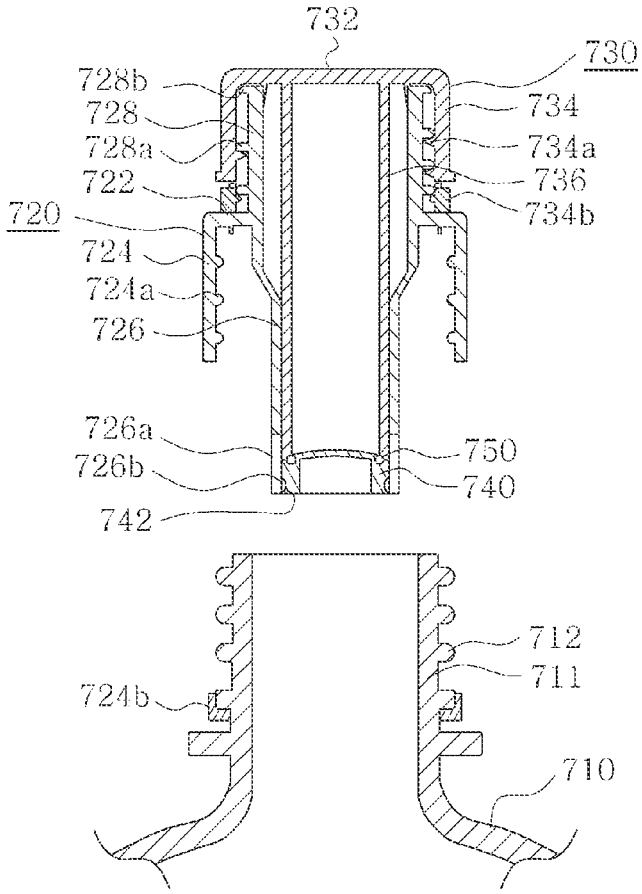

If the user rotates the opening unit 730 counterclockwise, the opening unit 730 is tightened to the extension part 728 again through a screw-type engagement and moves downward to the initial stage as shown in FIG. 48. In this situation, if the user further rotates the opening unit 730 counterclockwise, the rotational force of the opening unit 730 is transmitted to the additive storage container 720. Thus, the internal thread 724*a* of the main cap 724 of the additive storage container 720 is rotated relative to the external thread 712 of the mouth 711. At this moment, the internal thread 724*a* of the main cap and the external thread 712 of the mouth are tightened together through a left-hand thread engagement, so that the skirt 724*b* for preventing the undesired opening of the container 720 is separated from the main cap 724 and the additive storage container 720 can be removed from the mouth 711 as shown in FIG. 50B.

Figure 51:
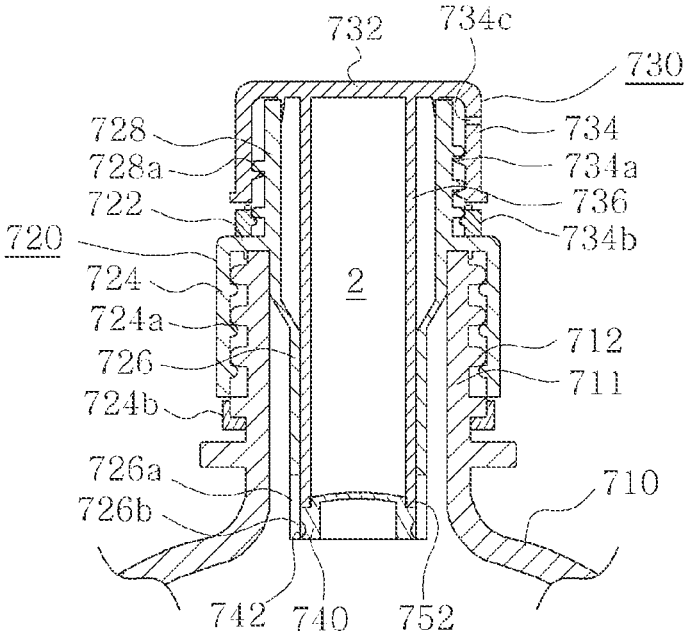
FIG. 51 is a sectional view showing the construction of the 25$^{th}$ embodiment of the present invention.
Figure 52:
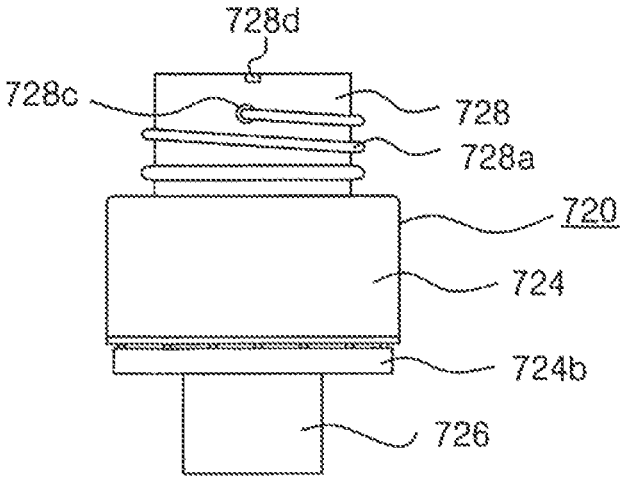
FIG. 52 is a side view showing the appearance of an additive storage container of the 25$^{th}$ embodiment of the present invention.

FIGS. 51 and 52 show the 25$^{th}$ embodiment of the present invention. In this embodiment, the same definitions are used for those elements that are the same as those of the 24$^{th}$ embodiment, and a detailed explanation of the elements is deemed unnecessary. This embodiment is altered from the 24$^{th}$ embodiment of the present invention, and shows how to make the seal structure of the plug 740 more effective. According to this embodiment, a cylindrical seal ring 752 is provided in the lower part of the interior of the slider 726. This seal ring 752 is integrated with the slider 726 by injection-molding the slider 726 with the seal ring 752 inserted in the cavity of a mold when the slider 726 is produced. In other words, the sealing ring 752 is made through a double injection molding process.

In addition, the extension part 728 does not include a stopper, unlike the 24$^{th}$ embodiment. A sound port 734*b* is formed through the upper cap 724.

Figure 53A:
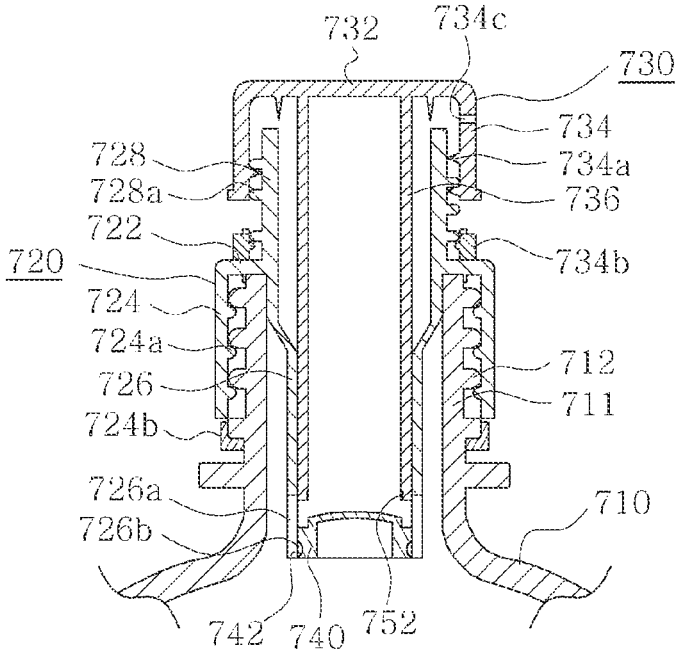
FIGS. 53A and 53B are views showing the operation of the 25$^{th}$ embodiment of the present invention.
Figure 53B:
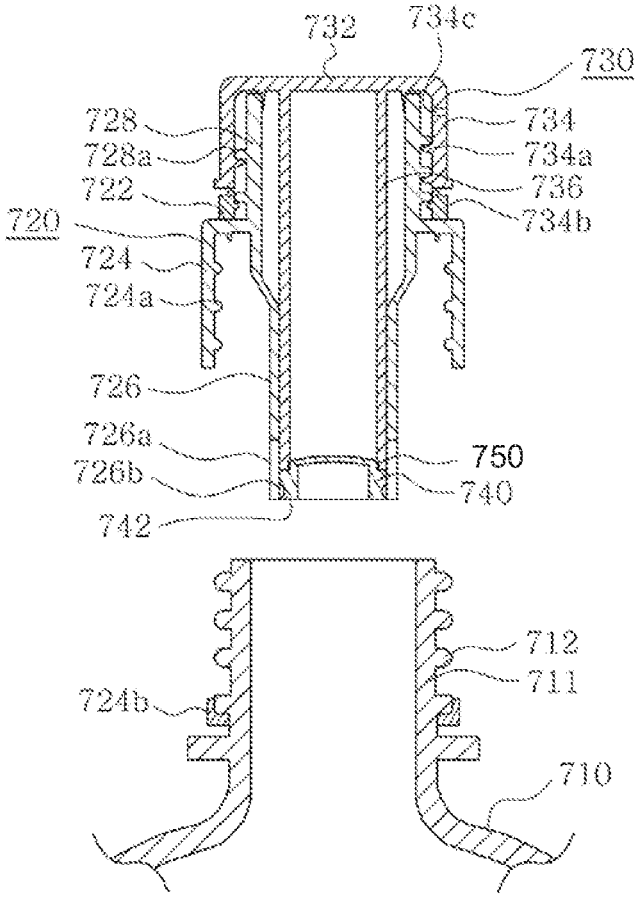

FIGS. 53A and 53B illustrate the operation of the 25$^{th}$ embodiment. During the operation of this embodiment, when the opening unit 730 escapes from the internal thread 728*a* of the extension part 728, the internal thread 734*a* interferes with a sound generation protrusion 728*c* and sound is generated. The sound is transferred to the atmosphere through the sound port 734*b*, so that the user can realize that the opening unit 730 is fully open and the additive has been completely discharged into the bottle body 710. Thus, the user can tighten the opening unit 730 to the mouth of the bottle body in accordance with a method of using the bottle of this invention. Thereafter, this embodiment is operated in the same manner as that described for the 24$^{th}$ embodiment.

The above-mentioned 25$^{th}$ embodiment can effectively maintain the seal between the slider 726 and the plug 740, so that it is possible to prevent the additive from being deteriorated.

INDUSTRIAL APPLICABILITY

As described above, the present invention makes it possible to contain, keep and circulate two different kinds of materials in isolated spaces of one bottle. When using the materials, the isolated spaces communicate with each other as a result of a predetermined operation, so that a user can mix and use the two materials easily. The bottle of the present invention can, therefore, prevent inconvenience and save resources because it is not necessary to contain two different materials in two different bottles. For actual use (for example, fir distributing beverage samples), this bottle enhances the freshness of the materials and the reliability of the products. In other words, the present invention prevents the properties of the materials from being changed or deteriorated, which may occur when they are stored in a mixed state for a lengthy period.

Furthermore, this bottle allows a user to mix the materials together at an exact mixture ratio, so that the bottle can prevent chemical and physical properties of the materials from being changed or deteriorated. Thus, this bottle maintains the desired properties of the materials.

In addition, the rotation of an opening unit relative to the mouth of a bottle body removes an additive storage container from the bottle body as well as releasing additive into the bottle body, so that the bottle is convenient to use.

The invention claimed is:

1. A bottle, comprising:

a bottle body having a mouth with an external thread formed around an outer circumferential surface of the mouth;

an additive storage container having an end plate being in surface contact with an open end of the mouth, a main cap extending downward in an axial direction from an outer circumferential edge of the end plate and having an internal thread combined to the mouth through a screw-type engagement, an inner cap extending in an axial direction from an inner circumferential edge of the end plate and being movably inserted into the mouth, with a discharge port and a hook protrusion provided on an end of the inner cap;

an opening unit comprising a finish plate provided on an upper part of the inner cap, an upper cap extending in an axial direction from an outer circumferential edge of the finishing plate provided on an upper part and having an internal thread combined to the outer circumferential surface of the main cap, and a slider extending in an axial direction from the end plate and movably inserted into the additive storage container in an axial direction, and sealed by a plug at an end thereof;

wherein the plug has a seal protrusion that is combined to a seal groove formed on a lower end of the slider so that the plug is coupled to the slider to be separated from the slider; and wherein the plug is integrally formed on a lower end of the slider, with a thin tear-off line formed between the plug and the slider.

2. The bottle according to claim 1, wherein the tear-off line is an inclined line.

3. The bottle according to claim 1, wherein an upper part of the outer circumferential surface of the plug is provided with a locking groove that engages with a locking protrusion that projects inward from an inner surface of the slider, so that the plug is coupled to the slider to be separated from the slider.

4. The bottle according to claim 3, wherein a seal ring is provided between the plug and the slider.

5. The bottle according to claim 4, wherein an interference protrusion is provided between the slider and the inner cap so that, when the slider and inner cap are moving relative to each other in axial directions, a sealed state between the slider and inner cap is maintained and a click sound is generated.

6. The bottle according to claim 5, wherein the finishing plate provided on an upper part is provided with a sound port that emits the click sound generated from the interference protrusion to the atmosphere.

7. A bottle, comprising:

a bottle body having a mouth with an external thread formed around an outer circumferential surface of the mouth;

an additive storage container having an end plate being in surface contact with an open end of the mouth, a main cap extending in an axial direction from an outer circumferential edge of the end plate and having an internal thread engaging with the external thread of the mouth through a screw-type engagement, an inner cap extending in an axial direction from an inner circumferential edge of the end plate and movably inserted into the mouth, with a plurality of discharge ports formed around a lower end of the inner cap, and an extension part extending upward from the inner circumferential edge of the end plate so that the extension part is opposite the inner cap, with an external thread formed around an outer circumferential surface of the extension part;

a plug mounted to a lower end of the inner cap, thereby sealing an axial opening of the inner cap;

an opening unit comprising a finish plate placed on an upper end of the extension part, an upper cap extending in an axial direction from an outer circumferential edge of the finishing plate provided on an upper part and engaging with the external thread of the extension part, and a slider extending in an axial direction from an inner surface of the end plate and movably inserted into the inner cap, so that an end of the slider is sealed by the plug; and wherein the plug is provided at a lower end thereof with a stop ring that engages with a stop protrusion provided around a lower end of an inner surface of the inner cap so that axial movement of the plug relative to the slider is restricted.

8. The bottle according to claim 7, wherein a seal ring is provided on an upper end of the plug so that the seal ring comes into contact with a lower end of the slider.

9. The bottle according to claim 7, wherein a cylindrical seal ring is provided in a lower part of the interior of the slider so that the cylindrical seal ring comes into contact with an upper end of the plug.

10. The bottle according to claim 9, wherein the cylindrical seal ring is integrated with the slider through a double injection molding process in which the cylindrical seal ring is inserted in a cavity of a mold when the slider is produced by injection molding.

11. The bottle according to claim 7, wherein the extension part is provided with a stopper which extends outward in a radial direction around the outer circumferential surface of the extension part and limits upward movement of the upper cap to a predetermined position.

12. The bottle according to claim 11, wherein the extension part is provided with an interference protrusion that interferes with the upper cap, thus generating sound, while the upper cap is provided with a sound port to transmit the sound outside the bottle.

* * * * *